US007753811B2

(12) United States Patent
Mark

(10) Patent No.: US 7,753,811 B2
(45) Date of Patent: Jul. 13, 2010

(54) GRIP TRAINING DEVICE

(76) Inventor: Justin A. Mark, 15919 Colgate, Clinton Township, MI (US) 48035

( * ) Notice: Subject to any disclaimer, the term of this patent is extended or adjusted under 35 U.S.C. 154(b) by 152 days.

(21) Appl. No.: 11/851,808

(22) Filed: Sep. 7, 2007

(65) Prior Publication Data

US 2008/0064539 A1 Mar. 13, 2008

Related U.S. Application Data

(60) Provisional application No. 60/824,867, filed on Sep. 7, 2006.

(51) Int. Cl.
*A63B 69/00* (2006.01)

(52) U.S. Cl. ..... 473/422; 473/458; 473/451; 434/247; D21/713; D21/707

(58) Field of Classification Search ..... 473/422, 473/431, 450, 451, 458, 464, 598, 596; D21/713, D21/707; 434/247
See application file for complete search history.

(56) References Cited

U.S. PATENT DOCUMENTS

| | | | | | |
|---|---|---|---|---|---|
| 1,598,865 | A | | 9/1926 | Limerick | |
| 1,803,121 | A | | 4/1931 | Meurisse | |
| 2,266,390 | A | | 12/1941 | Blanchfield et al. | |
| 2,448,731 | A | | 9/1948 | Park | |
| 2,925,273 | A | * | 2/1960 | Pratt | 473/451 |
| 3,110,494 | A | * | 11/1963 | Morgan | 473/458 |
| 4,738,450 | A | | 4/1988 | Wexler | |
| 4,772,019 | A | * | 9/1988 | Morgan | 473/601 |
| 4,991,838 | A | * | 2/1991 | Groves | 473/451 |
| 5,048,829 | A | * | 9/1991 | Prokupek | 473/595 |
| 5,080,359 | A | | 1/1992 | Thill | |
| 5,407,193 | A | * | 4/1995 | McGinley | 473/451 |
| 5,588,648 | A | | 12/1996 | Stebbins | |
| 5,607,152 | A | * | 3/1997 | Strassburger | 473/451 |
| 5,700,211 | A | | 12/1997 | Mackie | |
| 5,984,813 | A | | 11/1999 | Cinnella | |

(Continued)

FOREIGN PATENT DOCUMENTS

GB 2169839 A 7/1986

(Continued)

OTHER PUBLICATIONS

Roger Clemens Pitching Trainer Baseball—http://www.amazon.com/Roger-Clemens-Pitching-Trainer-Baseball/dp/B000MQFHWS/re—Franklin Sports, Inc. MLBP 2000.*

(Continued)

*Primary Examiner*—Mitra Aryanpour
(74) *Attorney, Agent, or Firm*—Senniger Powers LLP

(57) ABSTRACT

A grip training device is used to teach a person the proper grip of a ball in usage. More specifically, the grip training device may take the form of a baseball having finger position indicia on it. The finger position indicia may be constituted in several different ways, including by depressions sized and arranged to receive the fingers. The arrangement of the indicia shows how to grip the baseball for throwing different pitches.

4 Claims, 73 Drawing Sheets

U.S. PATENT DOCUMENTS

| | | | | |
|---|---|---|---|---|
| 6,663,519 | B2 * | 12/2003 | Kuhn et al. | 473/597 |
| 7,059,862 | B2 * | 6/2006 | McGinley | 434/247 |
| D546,911 | S * | 7/2007 | Kirschbaum et al. | D21/713 |
| 2006/0068952 | A1 | 3/2006 | Davignon, II | |
| 2006/0217220 | A1 | 9/2006 | Davignon, II | |
| 2006/0252587 | A1 | 11/2006 | Hu | |
| 2007/0155545 | A1 | 7/2007 | Owen | |

FOREIGN PATENT DOCUMENTS

| | | |
|---|---|---|
| JP | 53014779 A | 2/1978 |

OTHER PUBLICATIONS

GLS Greg Larson Sports, 2002 Full Line Catalog, p. 286: bottom of page—"Screw Ball".

* cited by examiner

GRIP TRAINING DEVICE

CROSS REFERENCE TO RELATED APPLICATION

This application is the non-provisional of U.S. application Ser. No. 60/824,867, filed Sep. 7, 2006.

BACKGROUND OF THE INVENTION

Balls are thrown by hand in many sporting events, including baseball, softball, wiffle ball, American football, and cricket, among others. Both the grip of the thrower's hand and the way the ball is thrown can have a significant impact upon the ball's path, speed, and movement during its flight through the air. With baseball, for example, a pitcher can use these different hand grips and different ways to throw the ball to execute different kinds of pitches. By varying the grip and throwing motion, the rotation of the baseball and the movement of the seams of the baseball can be manipulated to pass through the air differently as the baseball spins, thereby providing different affects on ball trajectory, speed, and movement. Common pitches may include a two-seam fastball, a four-seam fastball, a slider, a fork ball (split finger), a sinker, a cutter, a curveball, a screwball, a changeup, and a knuckleball, among others. Other sports requiring the throwing of balls by hand may also include their own set of different pitches.

Learning a variety of pitches is the goal of many young athletes, but the task can be difficult because there is much to learn, including pitch-specific grips and pitch-specific throwing dynamics. The present invention aims to facilitate this learning process by developing balls that are specifically shaped and sized for teaching the grip associated with a particular pitch.

BRIEF DESCRIPTION OF THE DRAWINGS

Corresponding reference characters indicate corresponding parts throughout the several views of the drawings.

DETAILED DESCRIPTION

Figure 1:
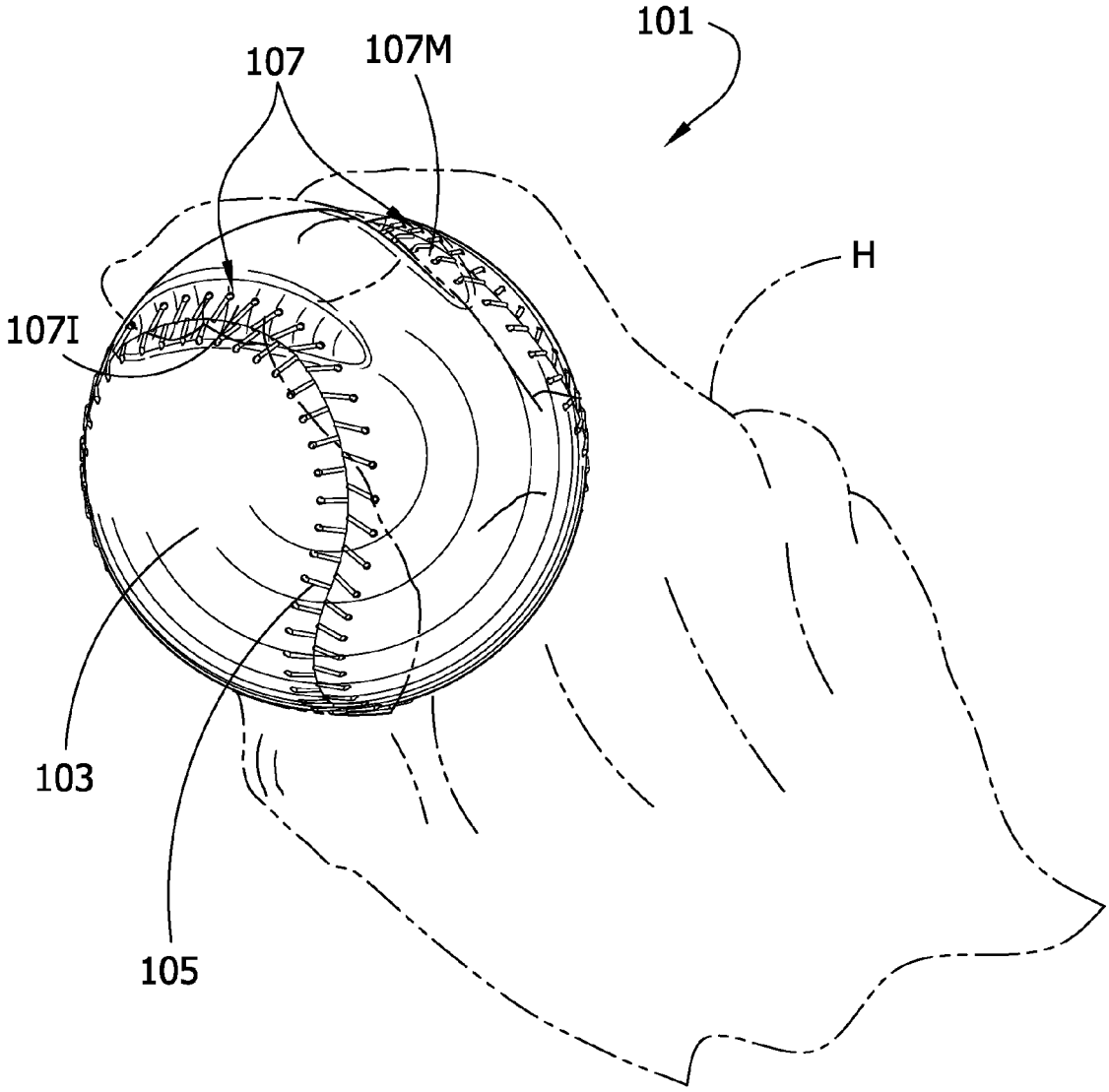
FIG. 1 is a perspective from a rear and right side vantage of a grip training device of a first embodiment for a two seam fastball grip and showing a hand in phantom gripping the device.
Figure 2:
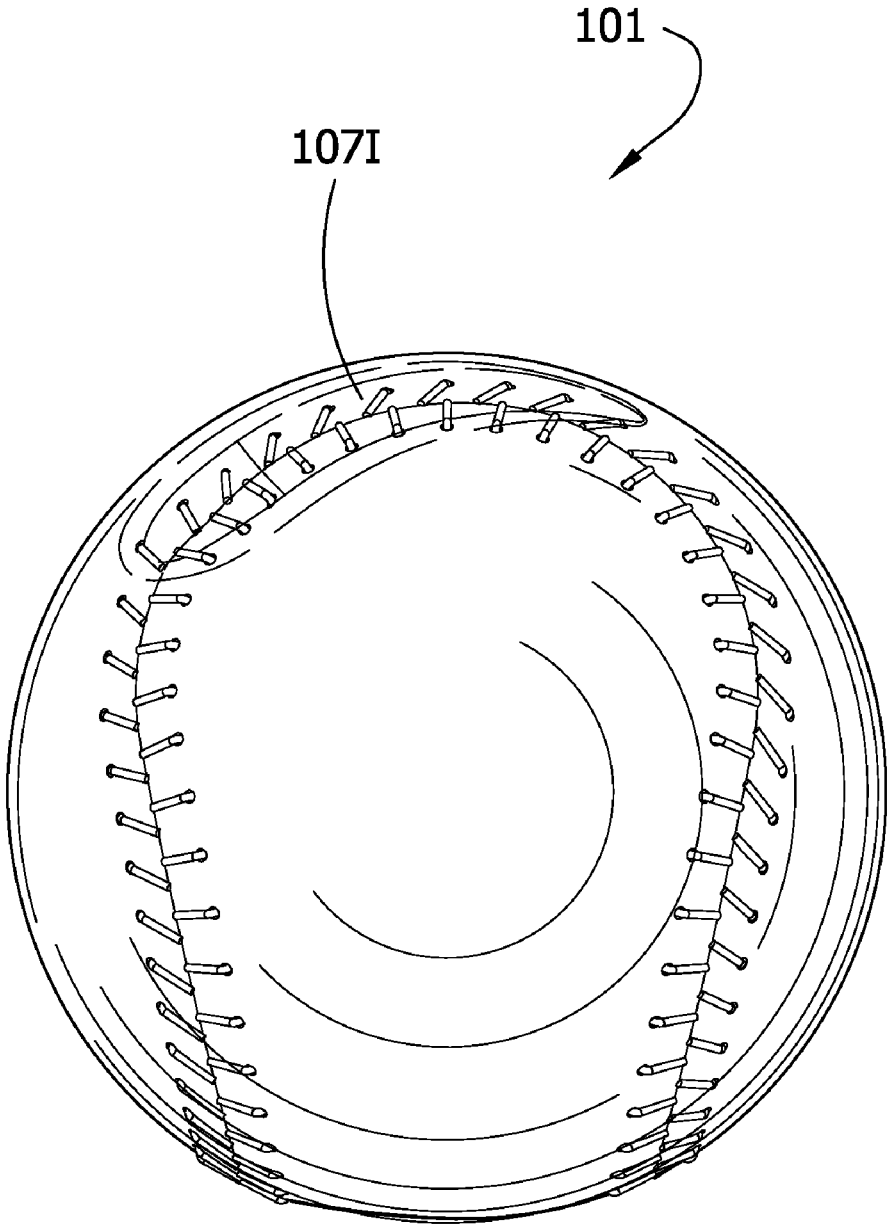
FIG. 2 is right side elevation of the grip training device of FIG. 1.
Figure 3:
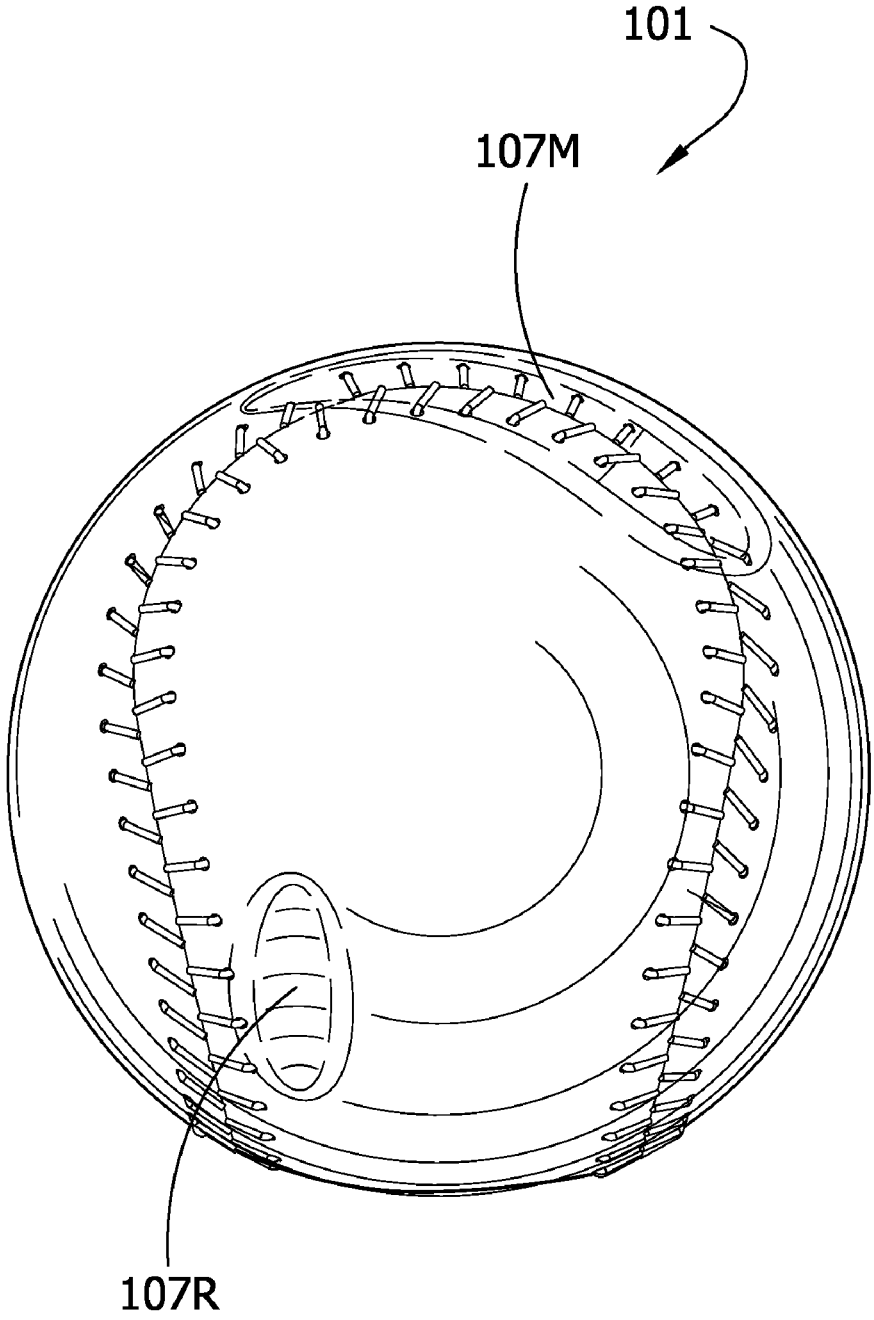
FIG. 3 is a left side elevation thereof.
Figure 4:
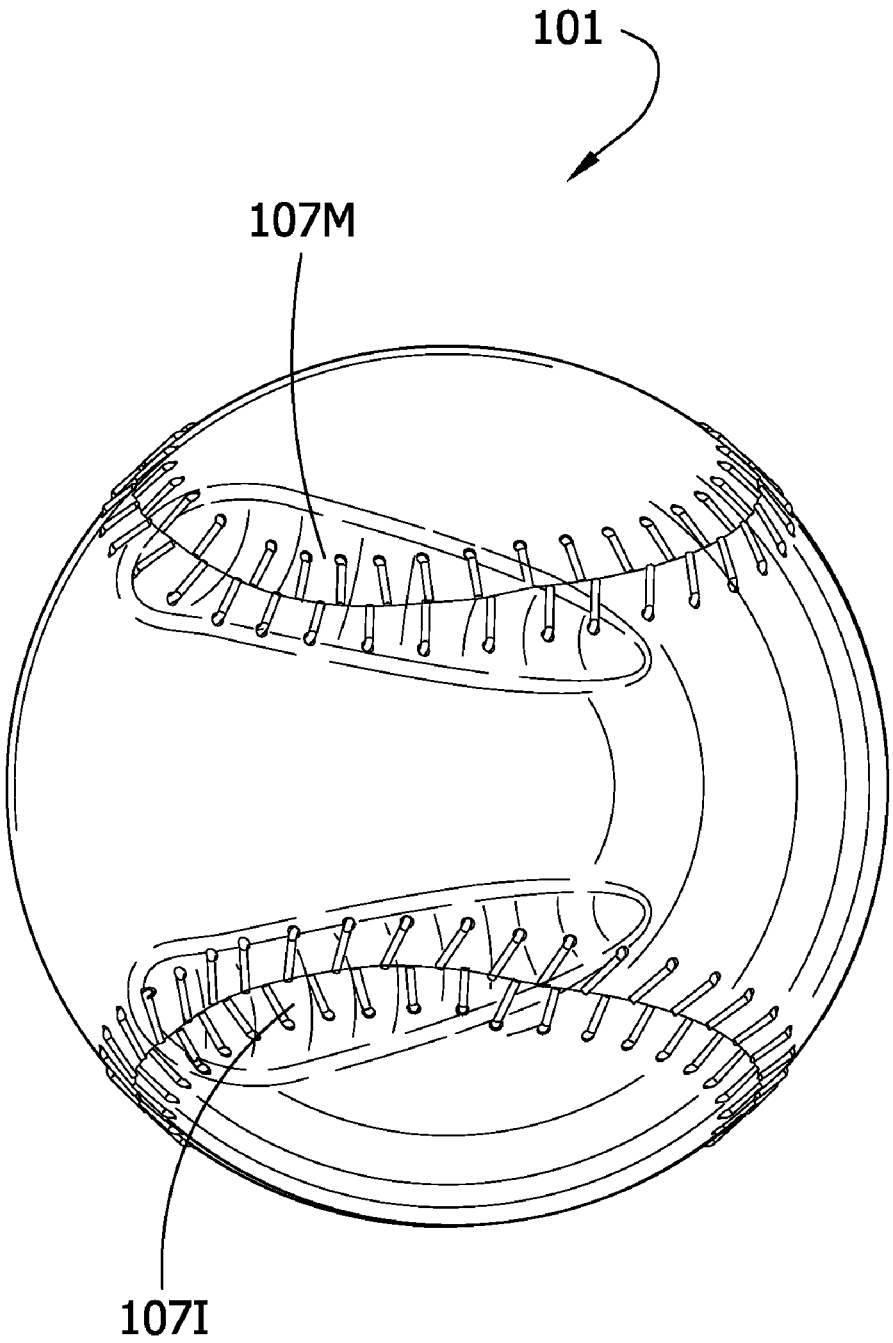
FIG. 4 is a top plan view thereof.
Figure 5:
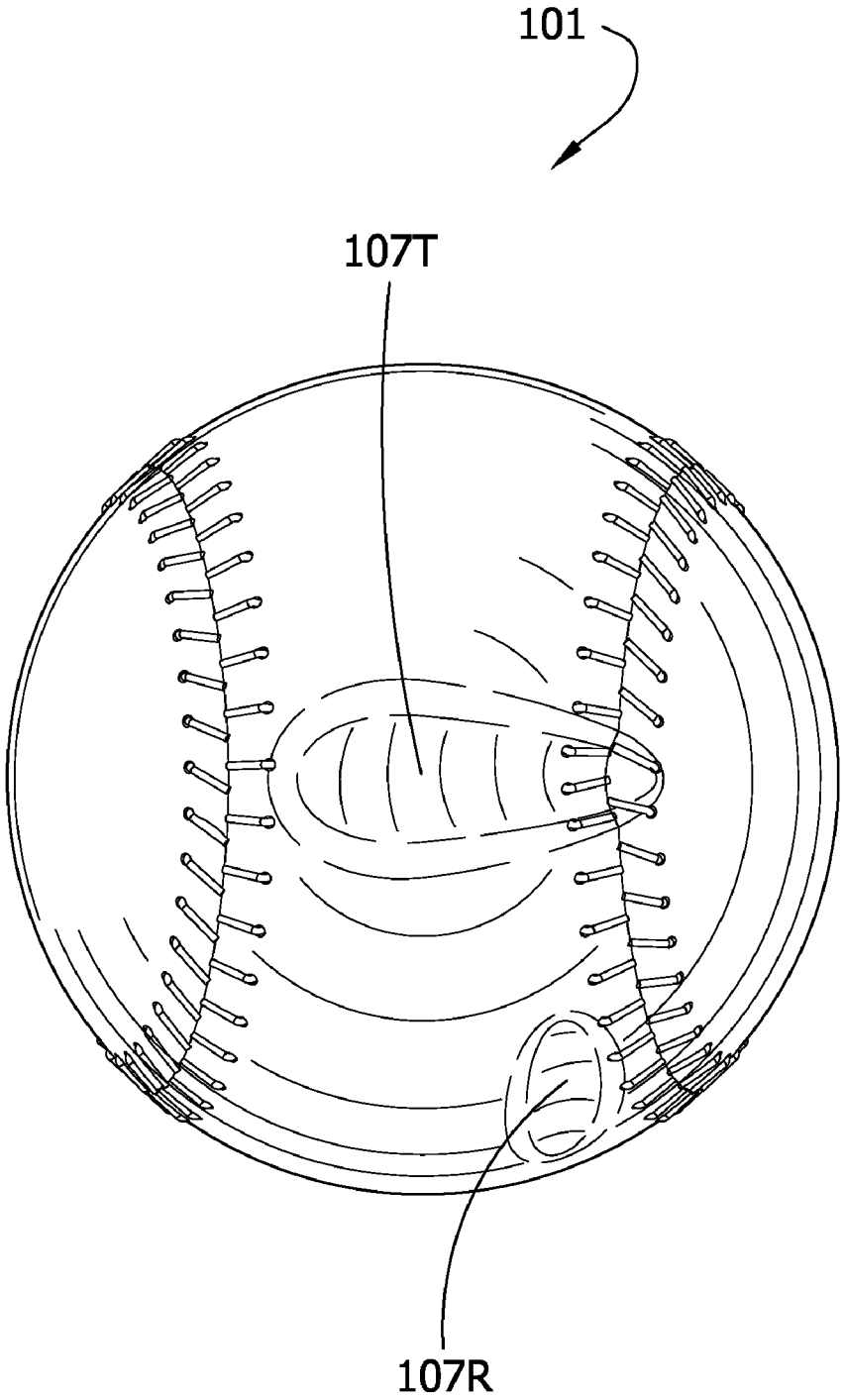
FIG. 5 is a bottom plan view thereof.
Figure 6:
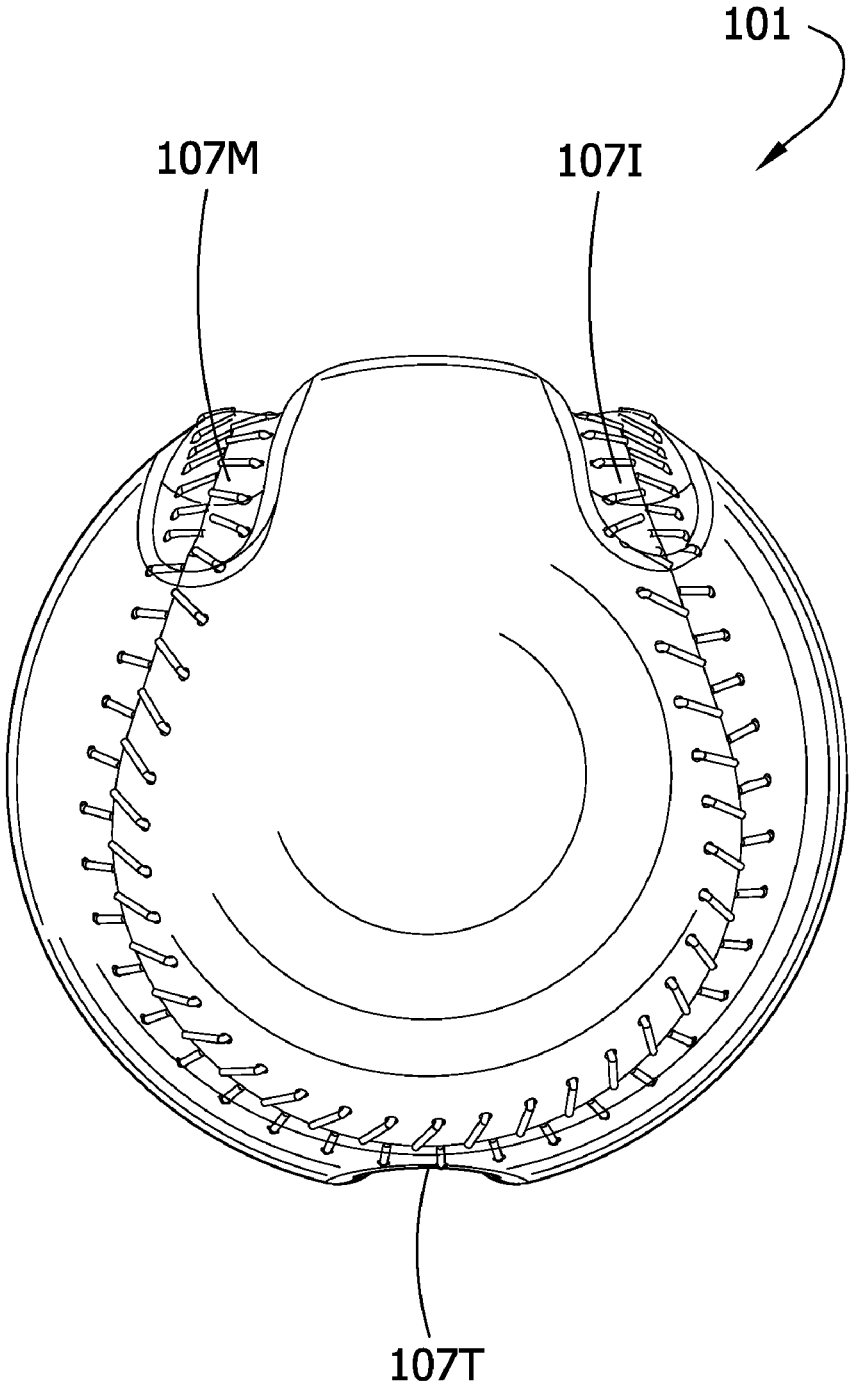
FIG. 6 is a front elevation thereof.
Figure 7:
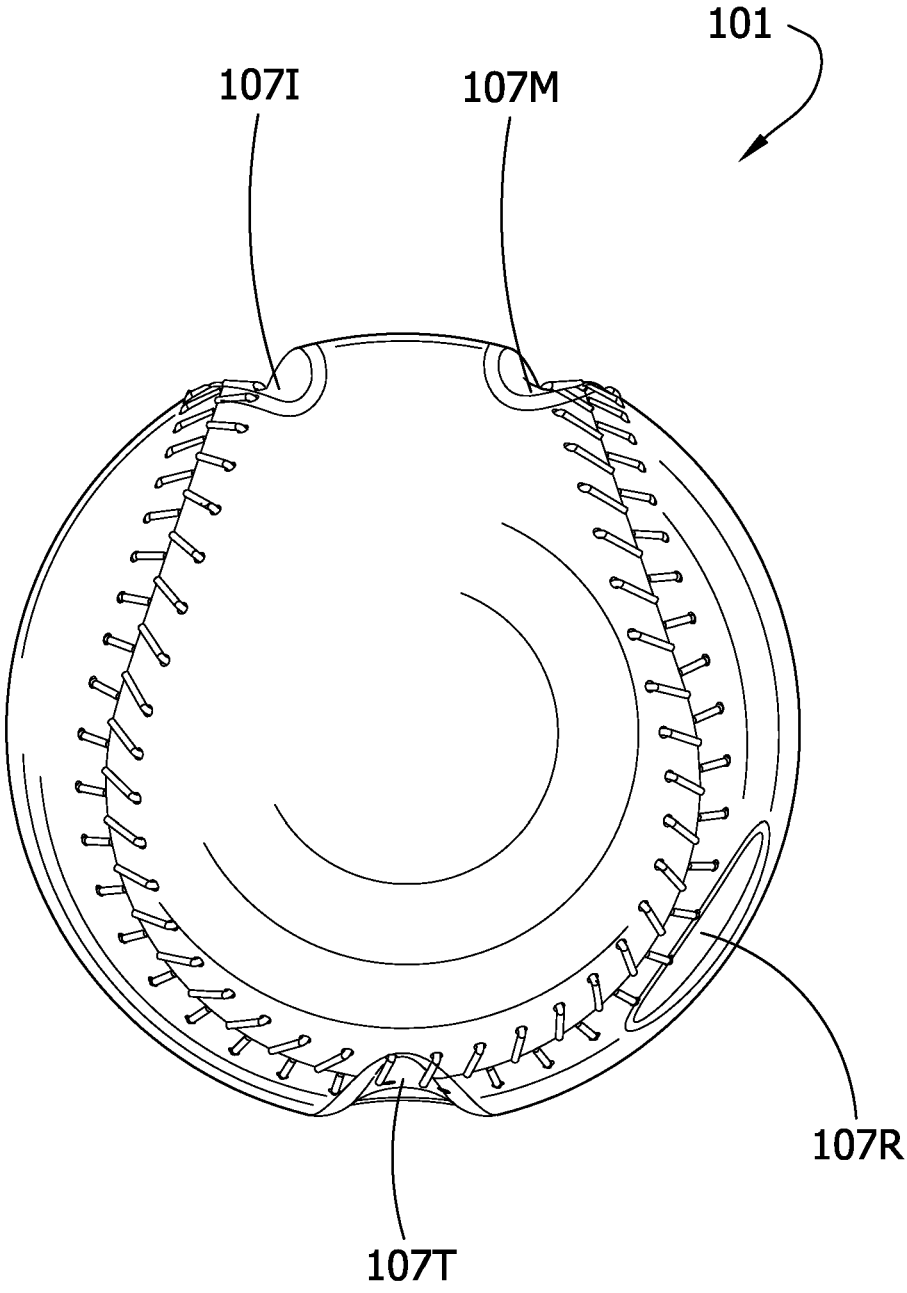
FIG. 7 is a rear elevation thereof.
Figure 8:
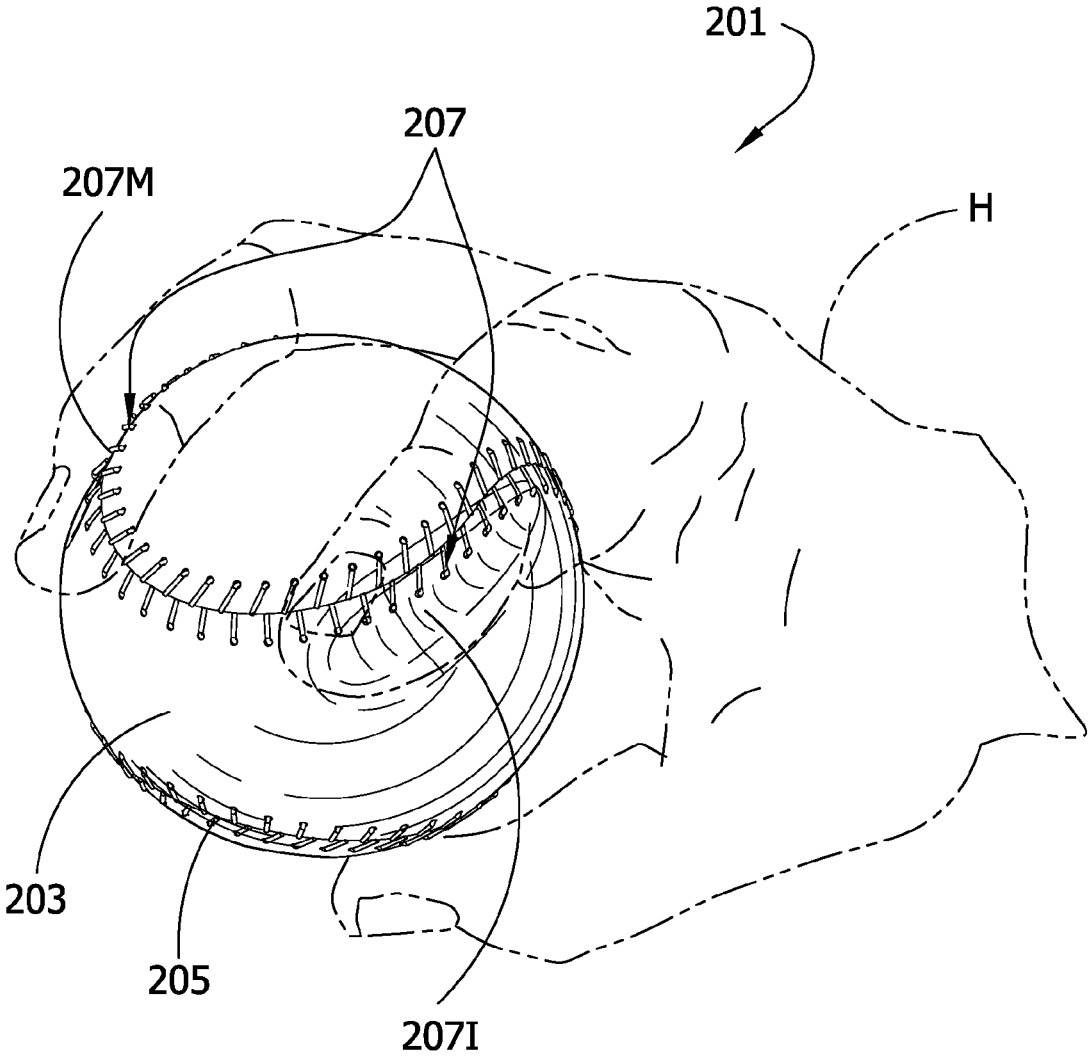
FIG. 8 is a perspective from a front and right side vantage of a grip training device of a second embodiment for a split finger grip and showing a hand gripping the device in phantom.
Figure 9:
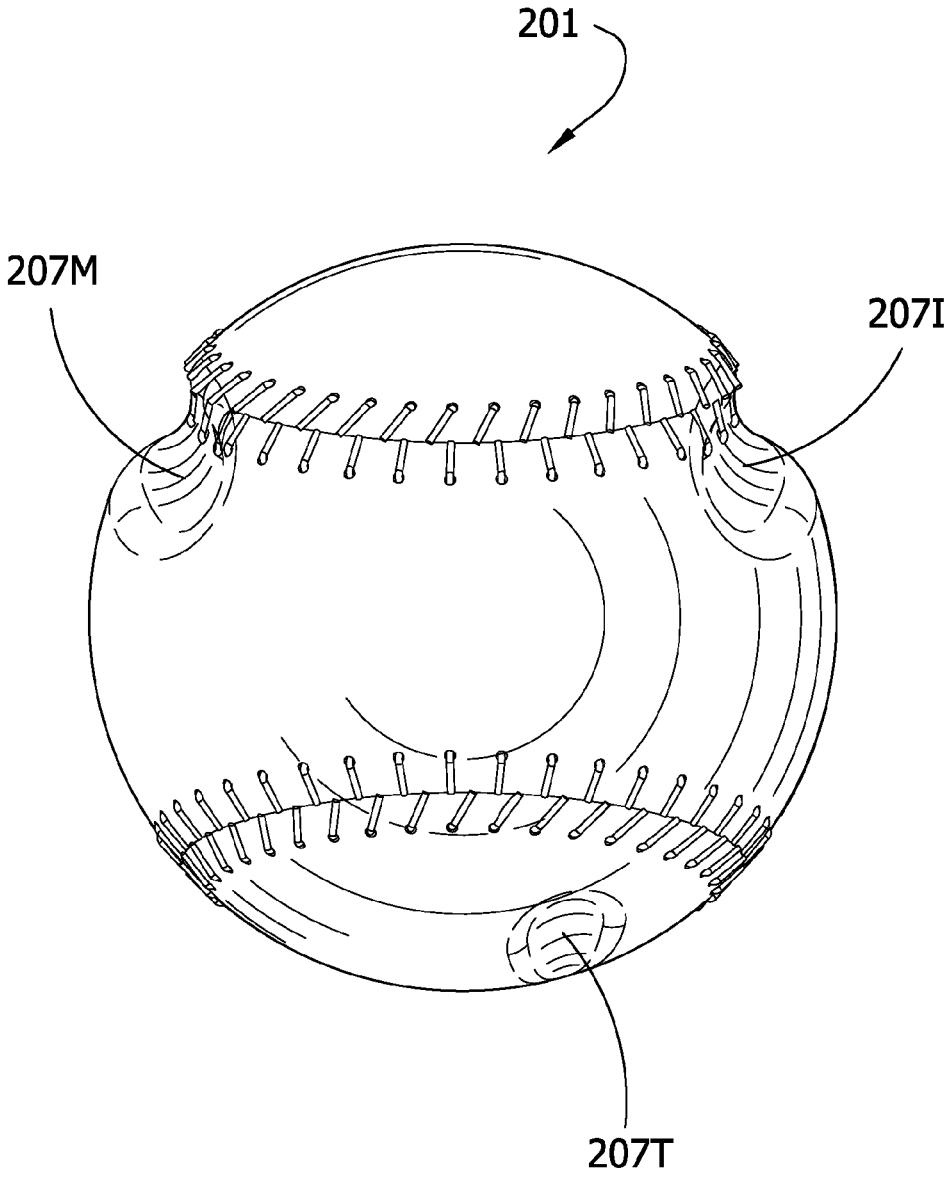
FIG. 9 is a front elevation of the grip training device of FIG. 8.
Figure 10:
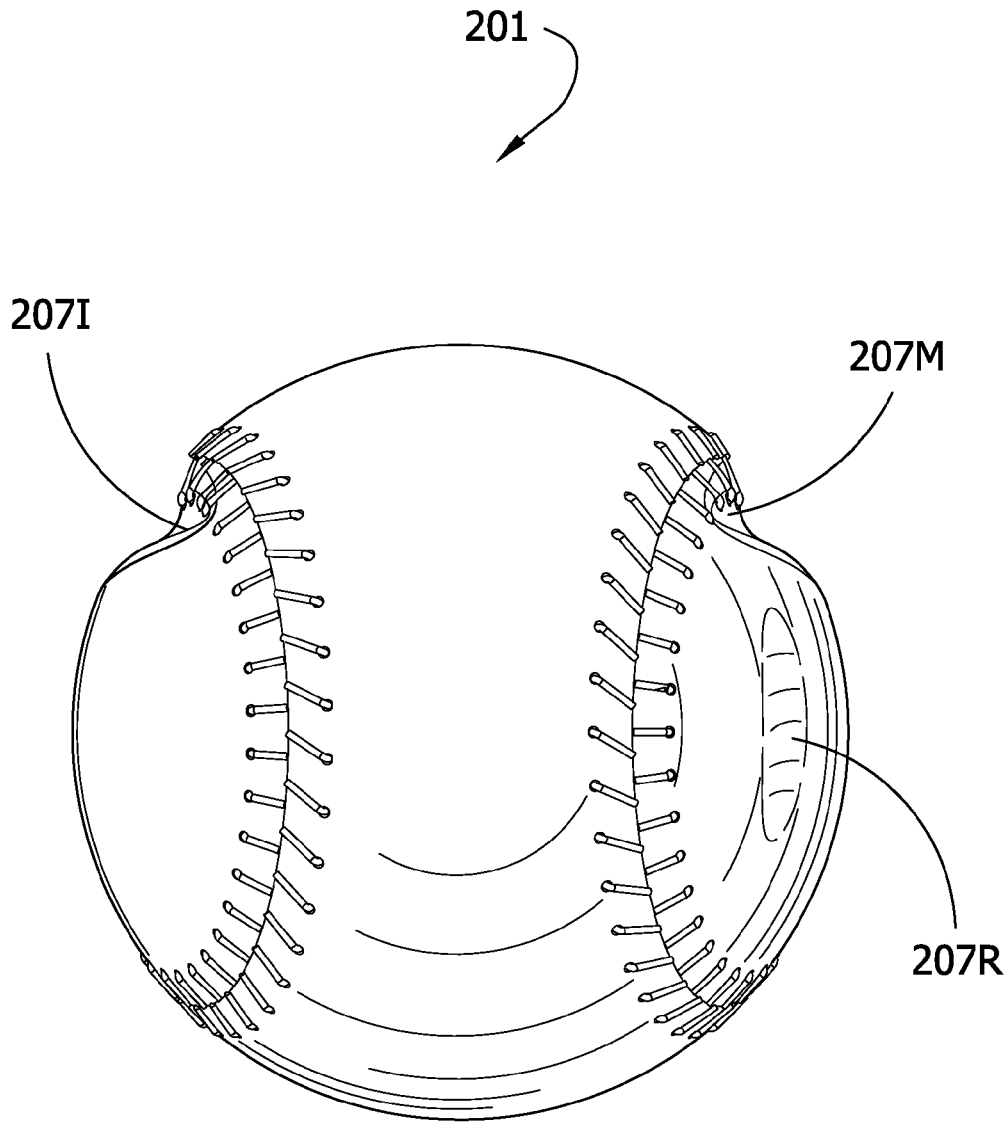
FIG. 10 is a rear elevation thereof.
Figure 11:
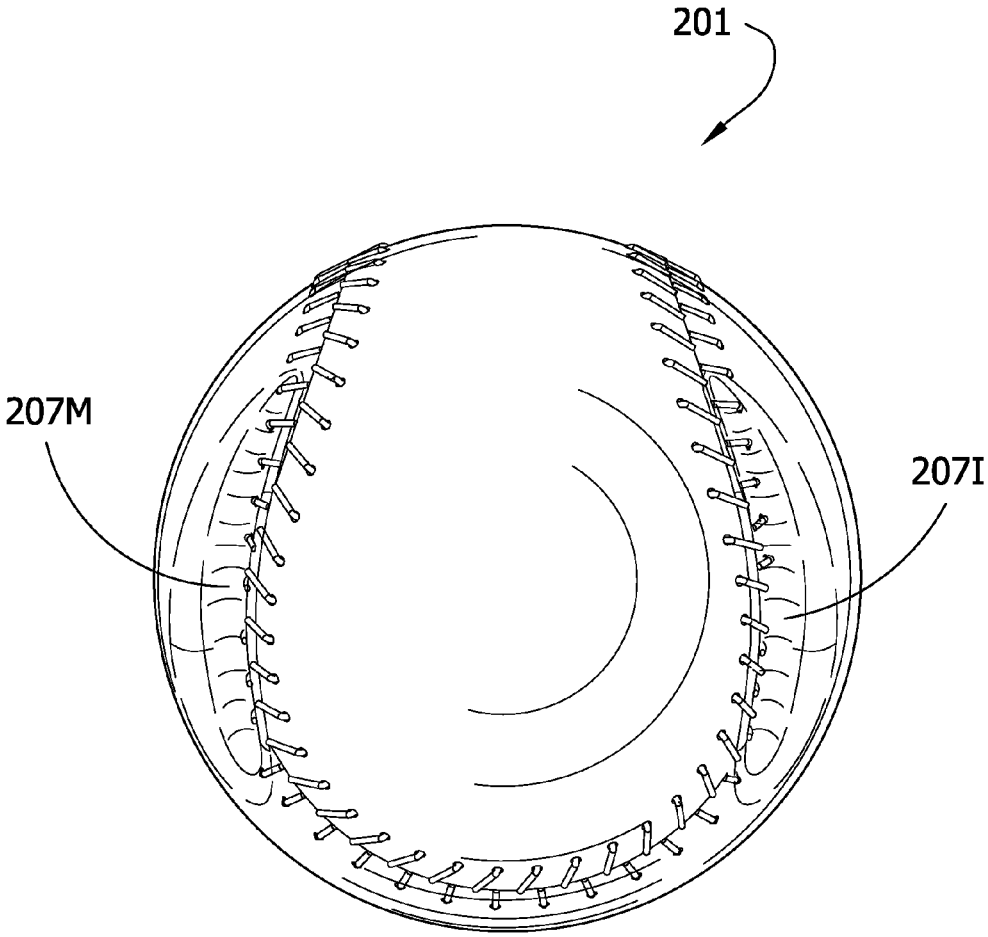
FIG. 11 is a top plan view thereof.
Figure 12:
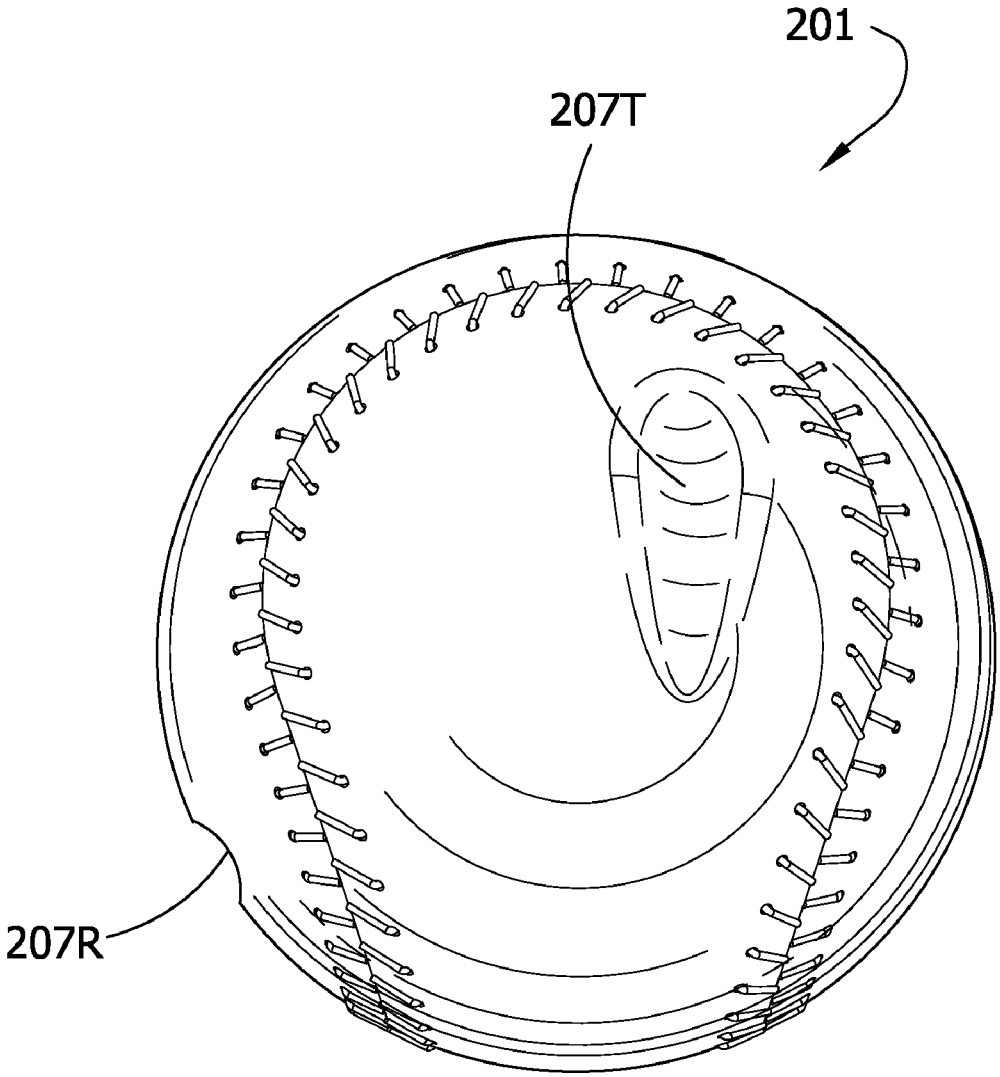
FIG. 12 is a bottom plan view thereof.
Figure 13:
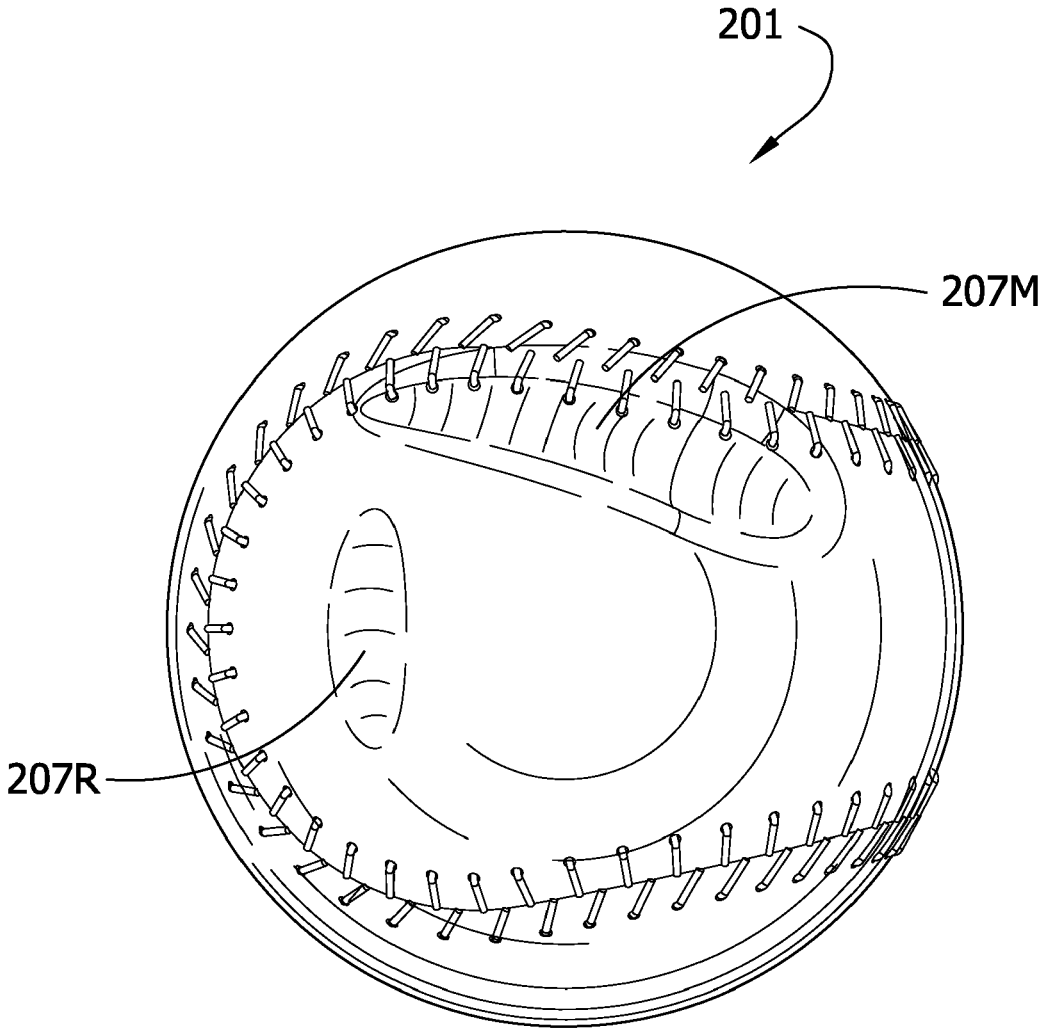
FIG. 13 is a left side elevation thereof.
Figure 14:
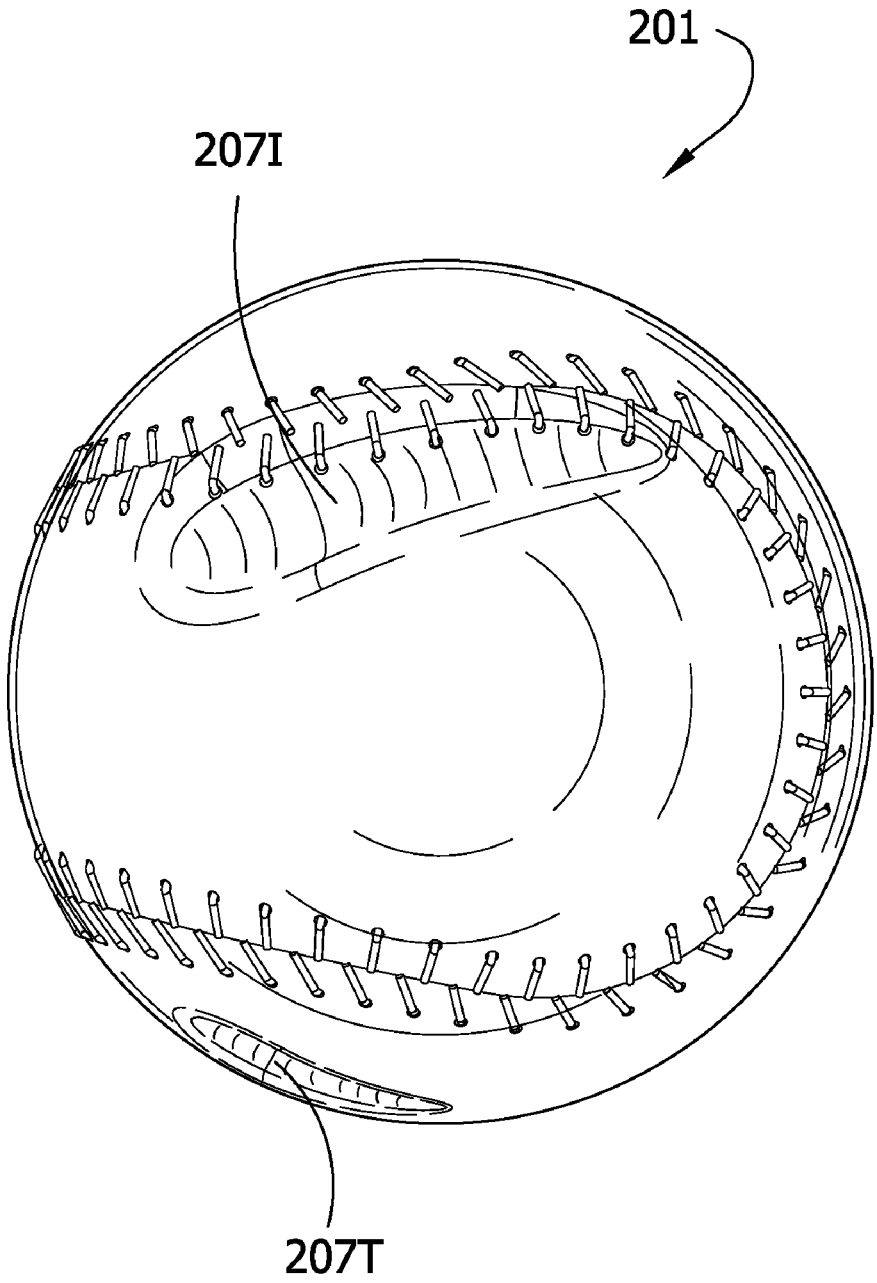
FIG. 14 is a right side elevation thereof.
Figure 15:
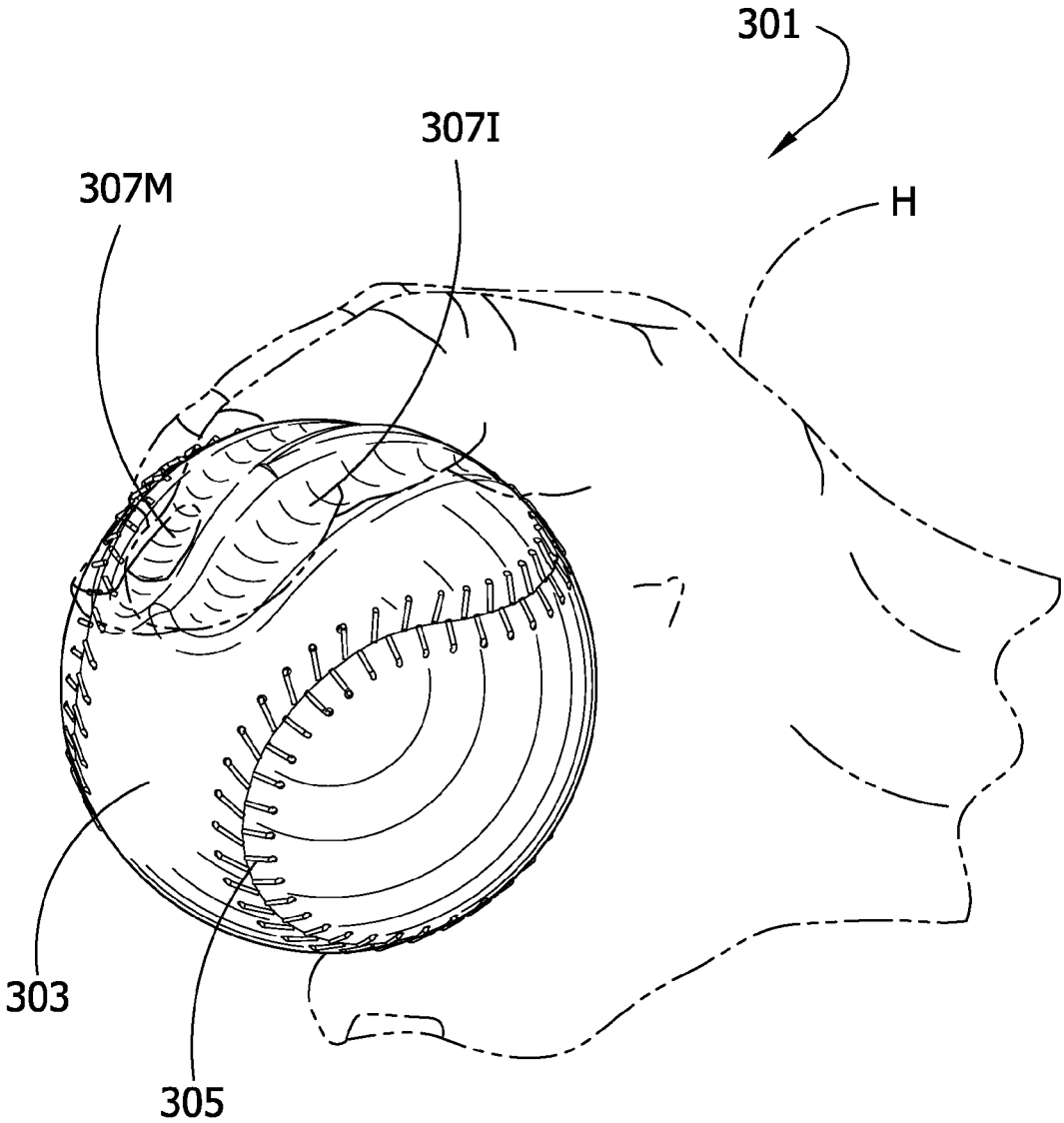
FIG. 15 is perspective from a front and right side vantage of a grip training device of a third embodiment for a slider grip and showing a hand gripping the device in phantom.
Figure 16:
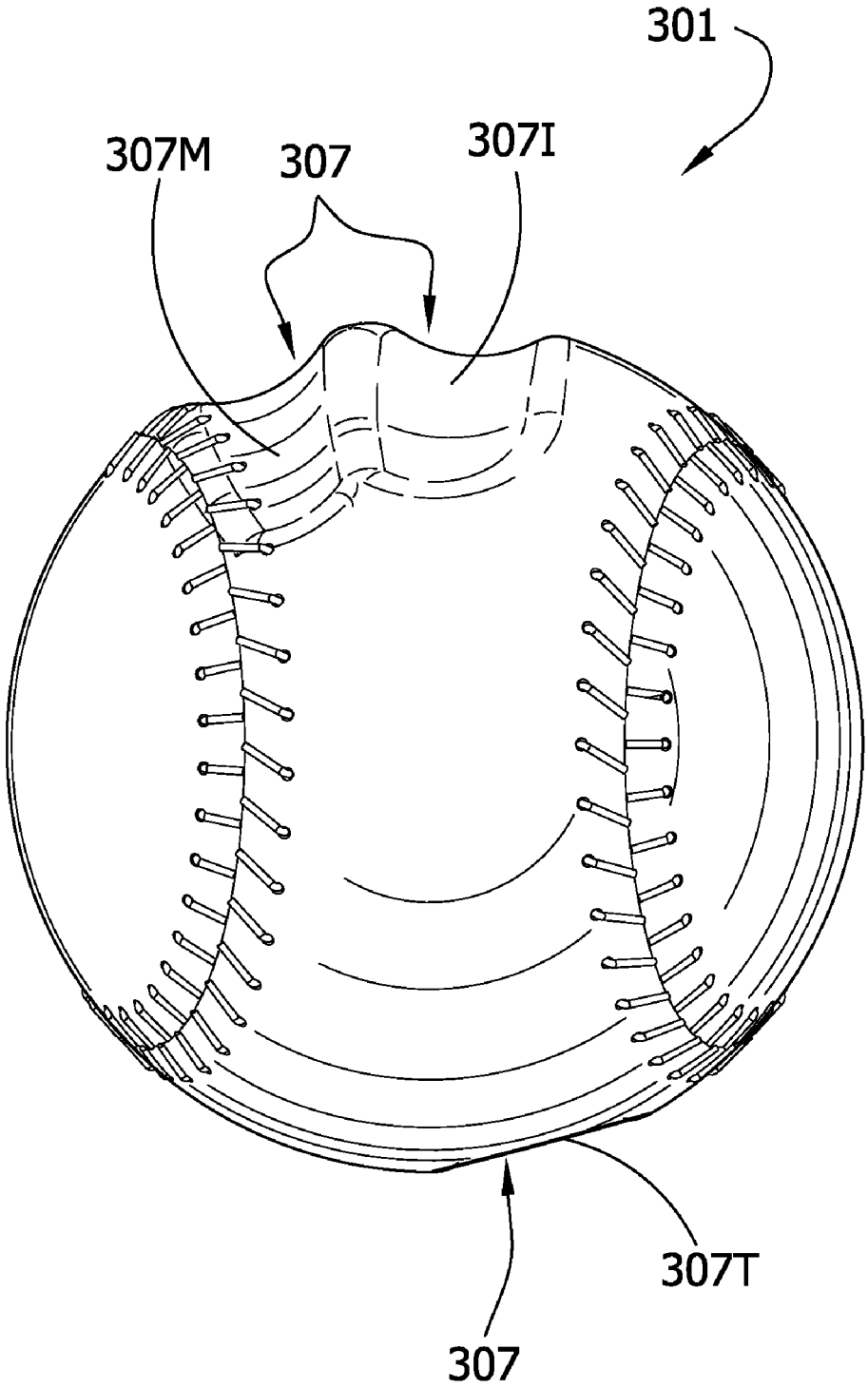
FIG. 16 is a front elevation of the grip training device of FIG. 15.
Figure 17:
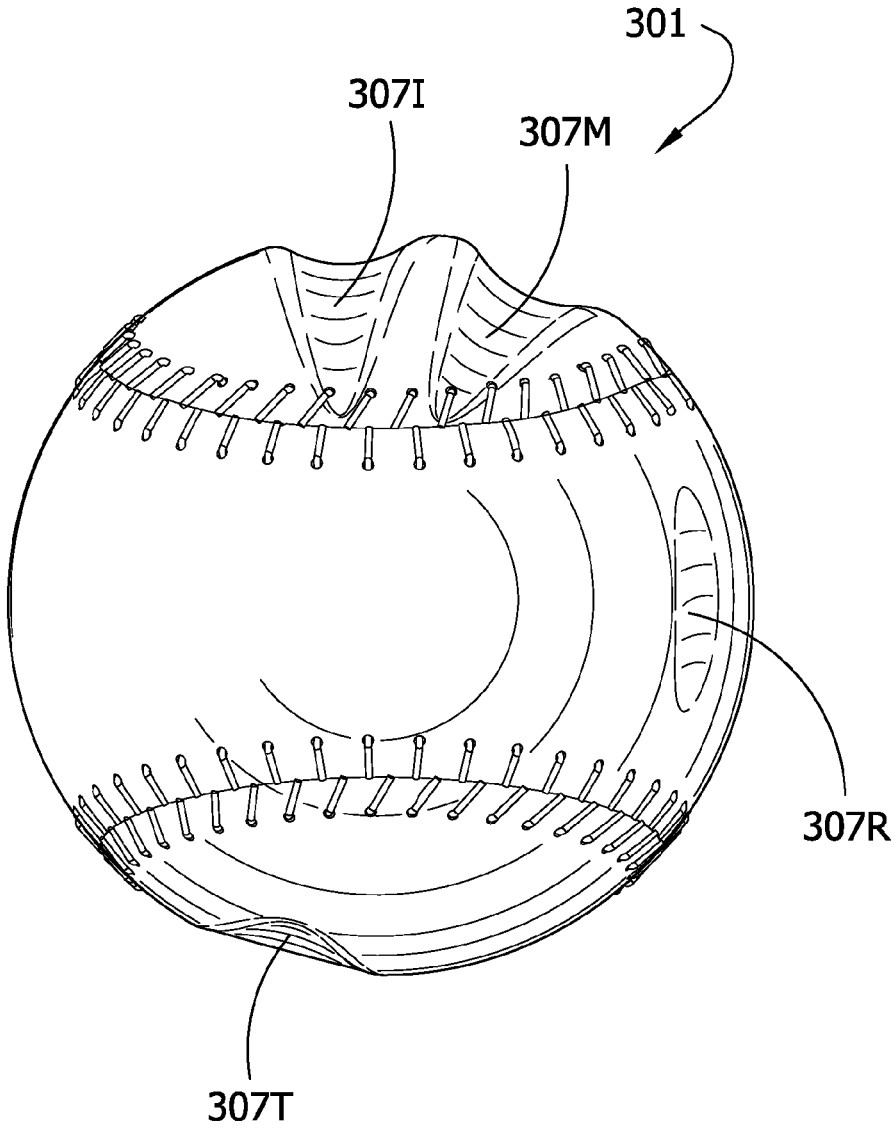
FIG. 17 is a rear elevation thereof.
Figure 18:
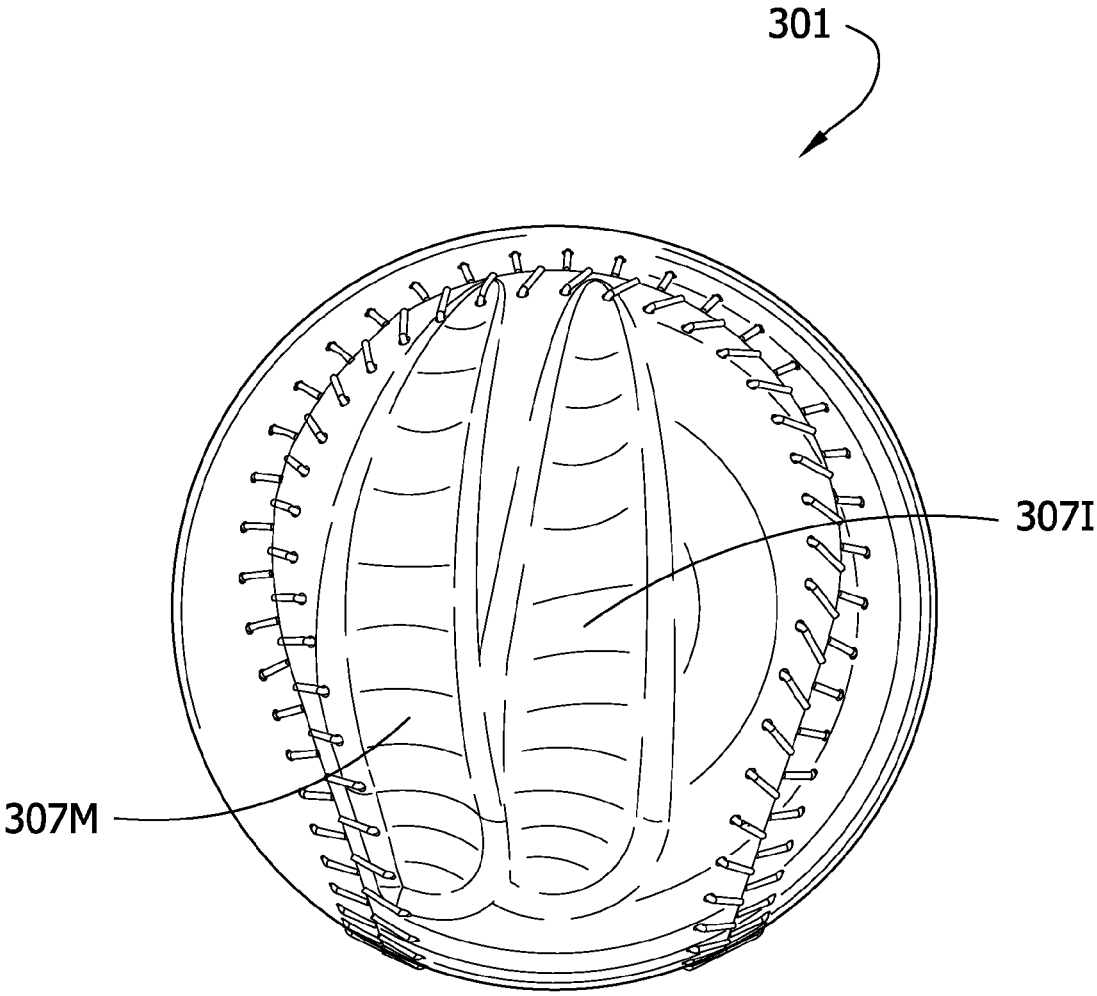
FIG. 18 is a top plan view thereof.
Figure 19:
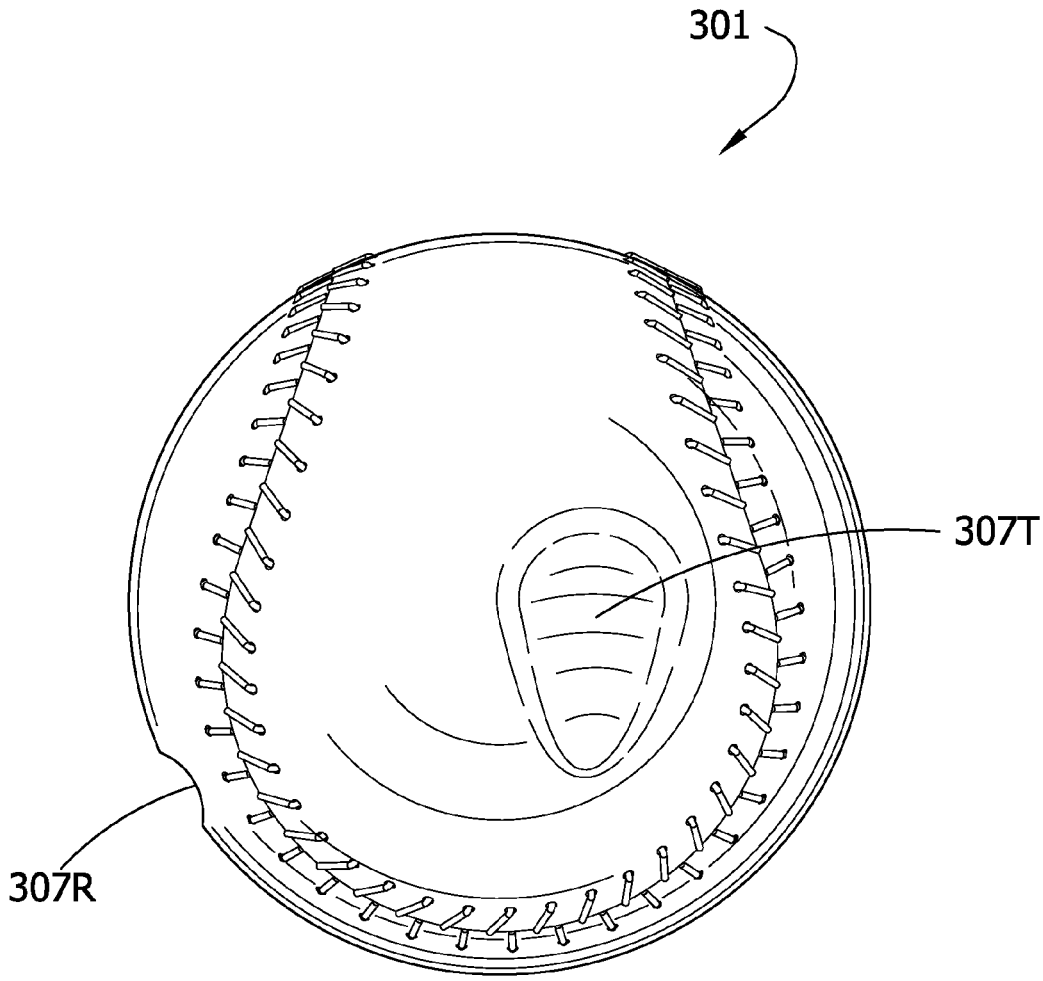
FIG. 19 is a bottom plan view thereof.
Figure 20:
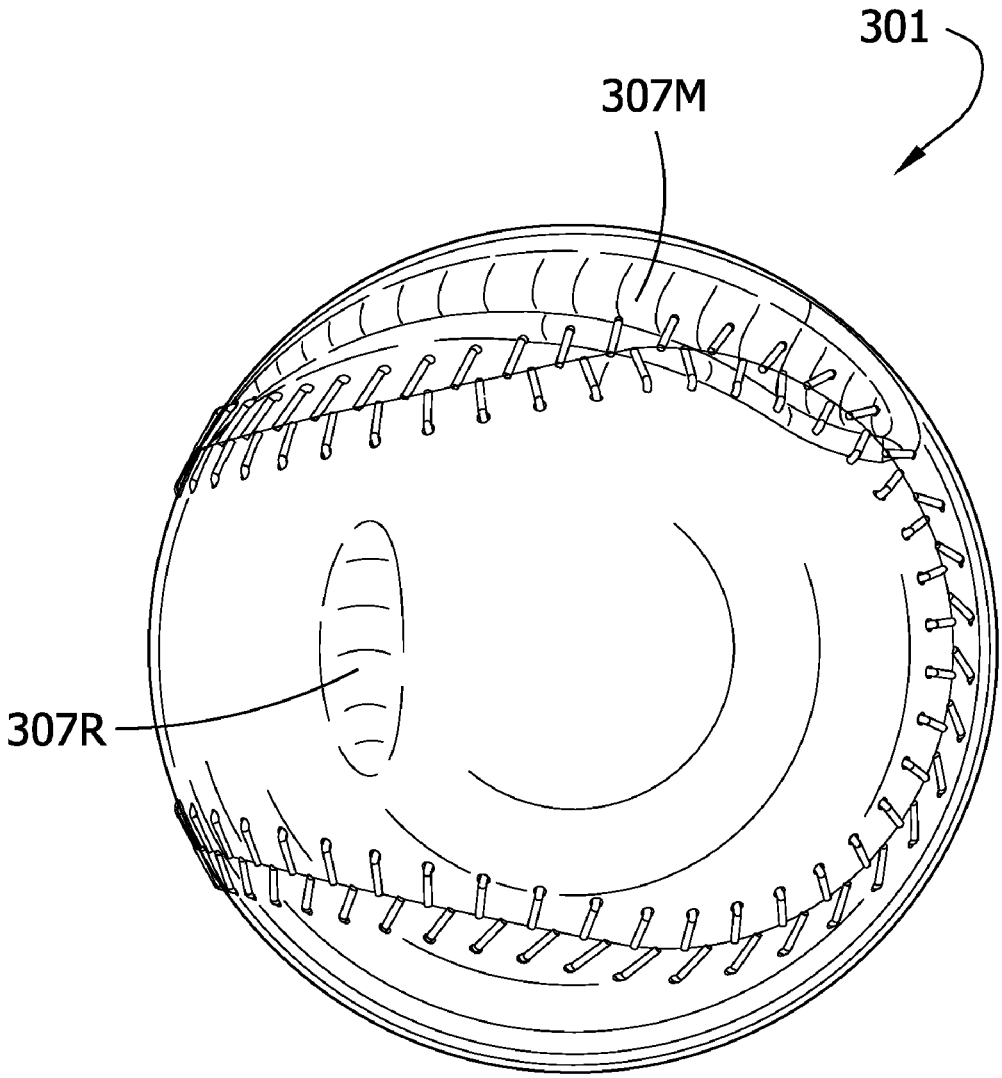
FIG. 20 is a left side elevation thereof.
Figure 21:
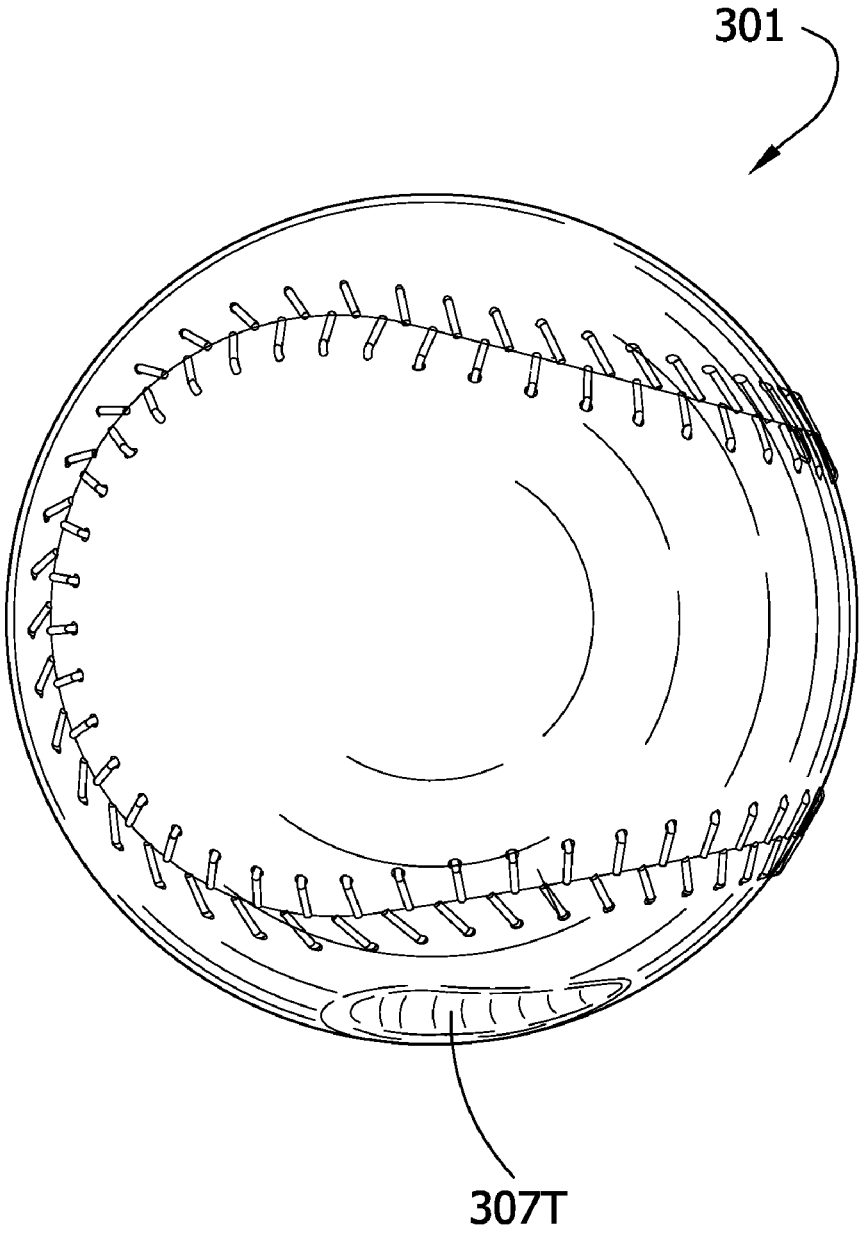
FIG. 21 is a right side elevation thereof.
Figure 22:
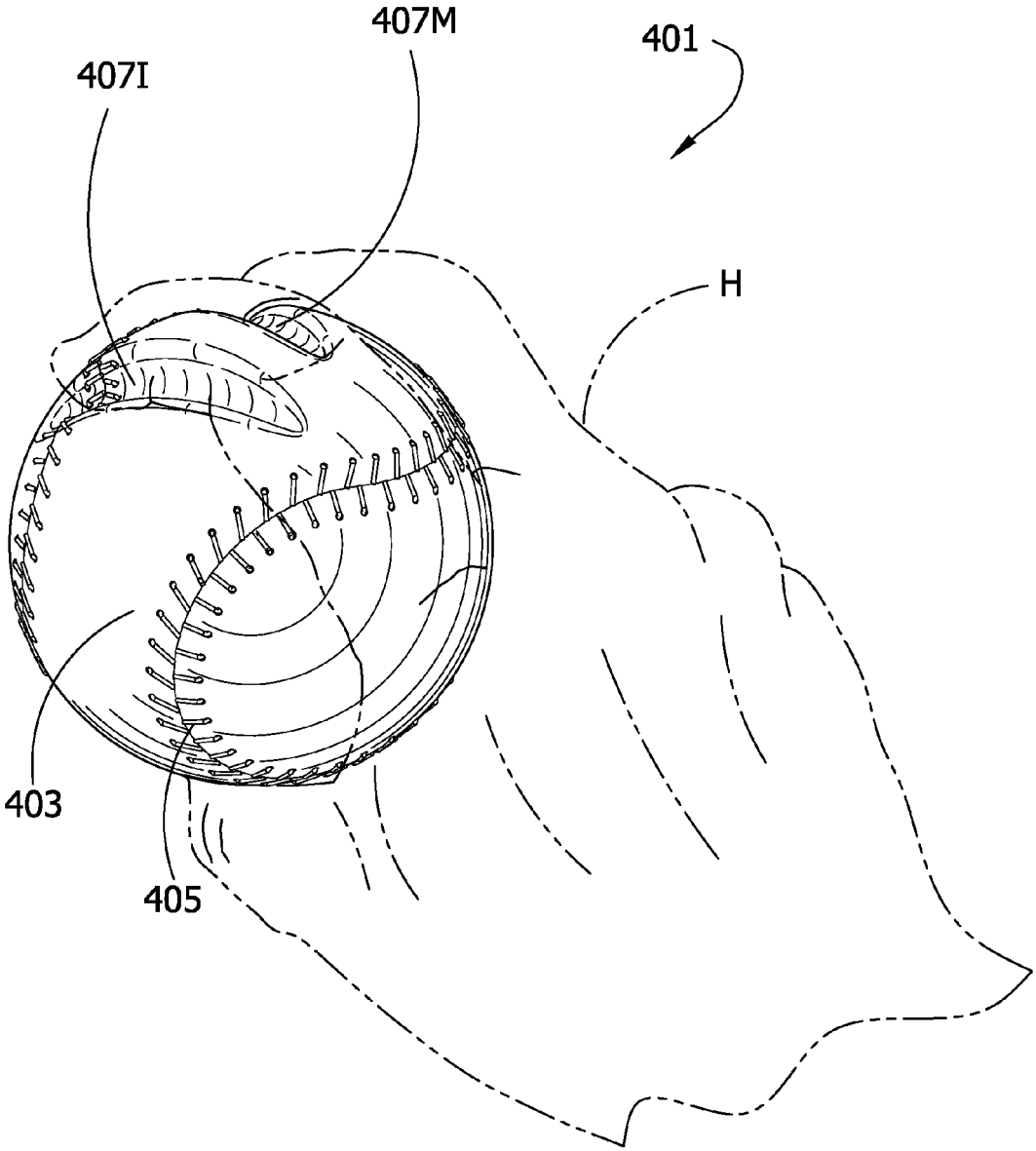
FIG. 22 is a perspective seen from the front and left side of a grip training device of a fourth embodiment for a four seam fastball grip and showing a hand gripping the device in phantom.
Figure 23:
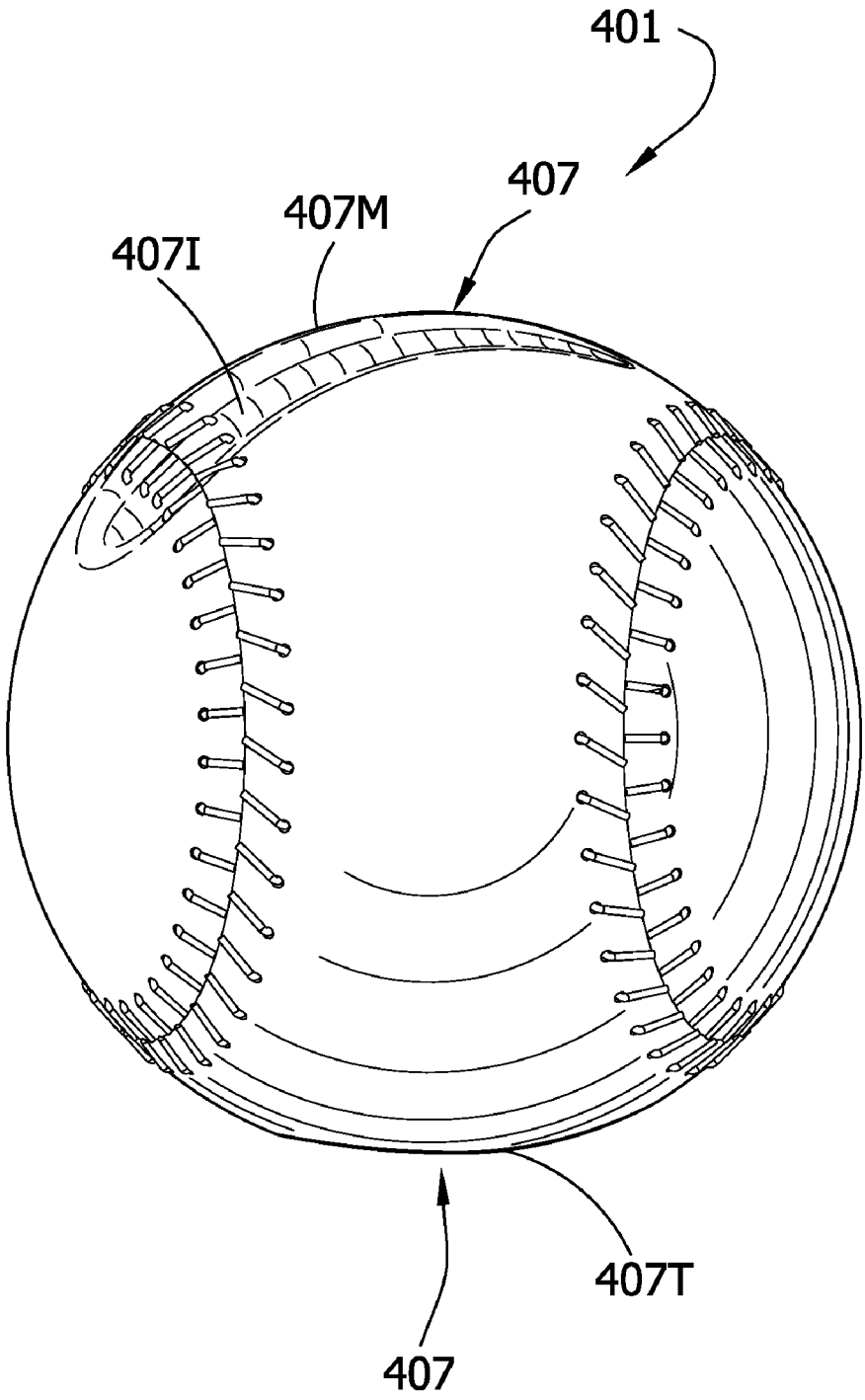
FIG. 23 is a right side elevation of the grip training device of FIG. 22.
Figure 24:
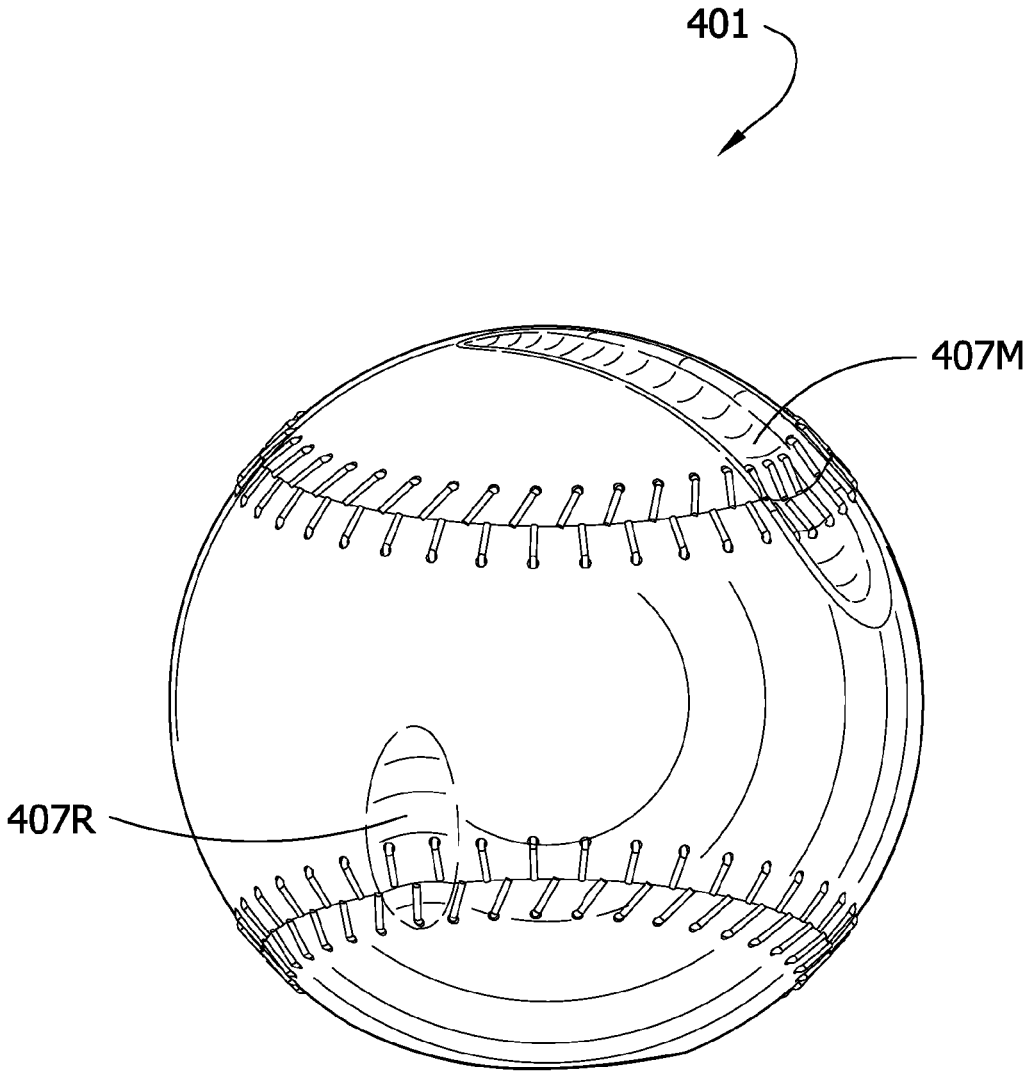
FIG. 24 is a left side elevation thereof.
Figure 25:
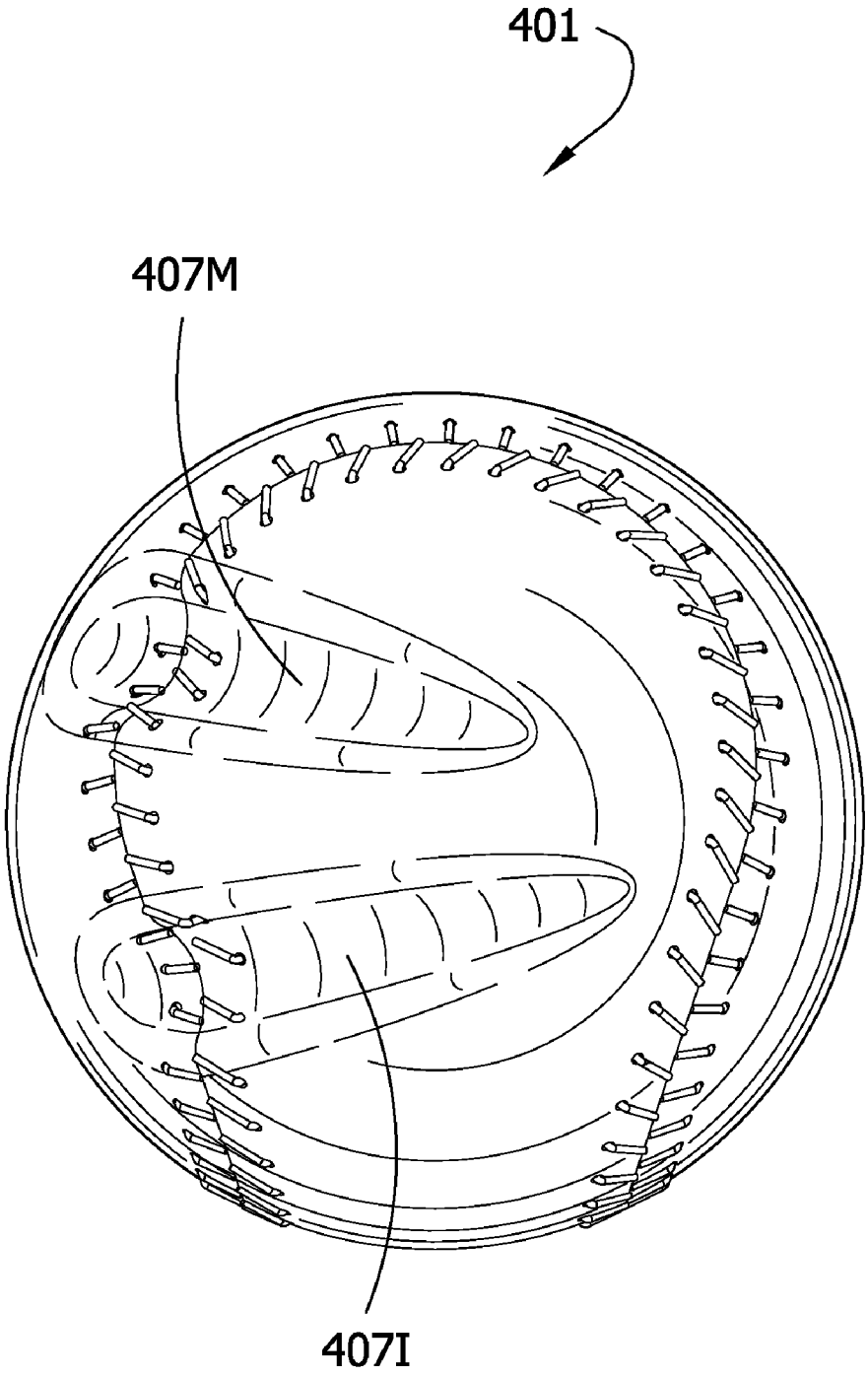
FIG. 25 is a top plan view thereof.
Figure 26:
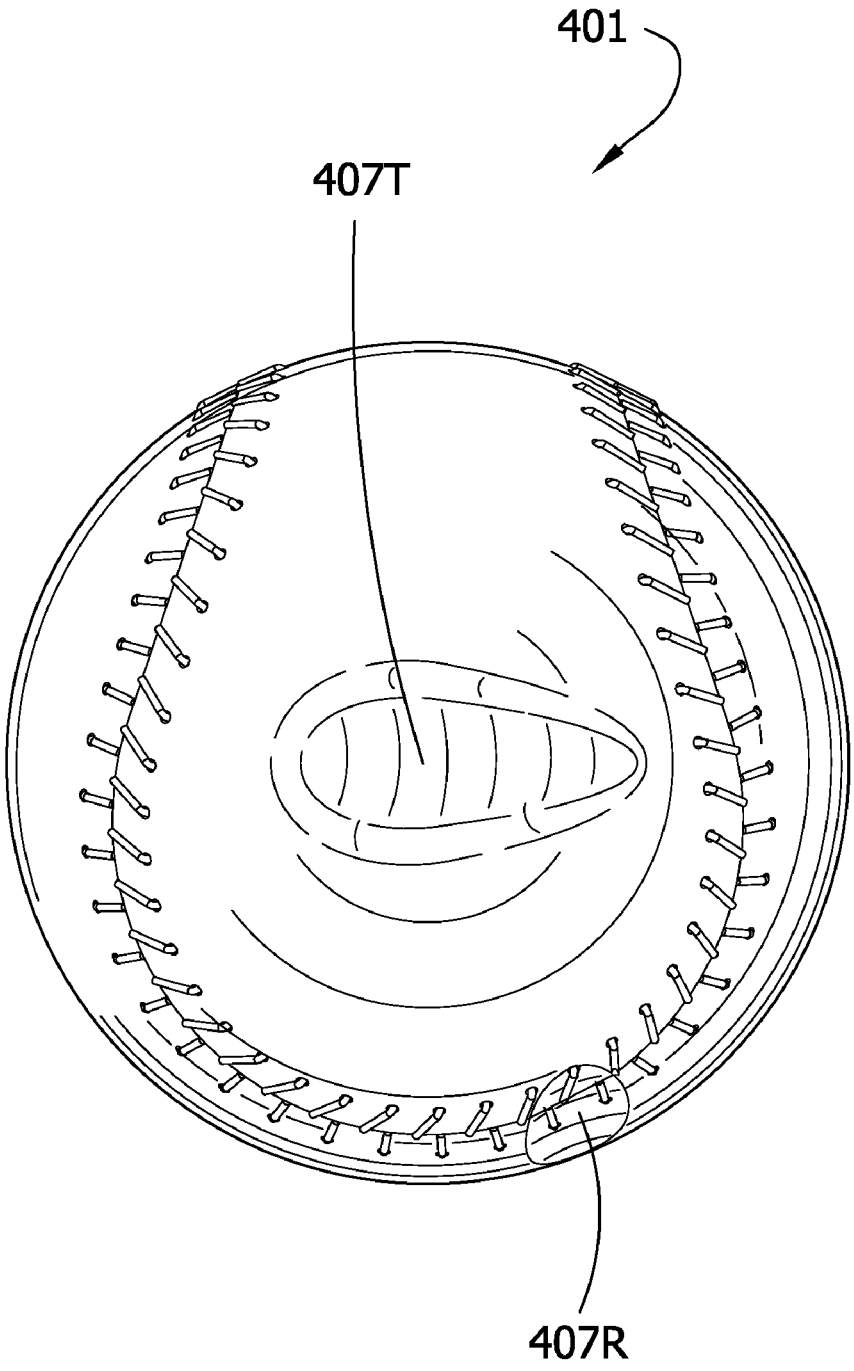
FIG. 26 is a bottom plan view thereof.
Figure 27:
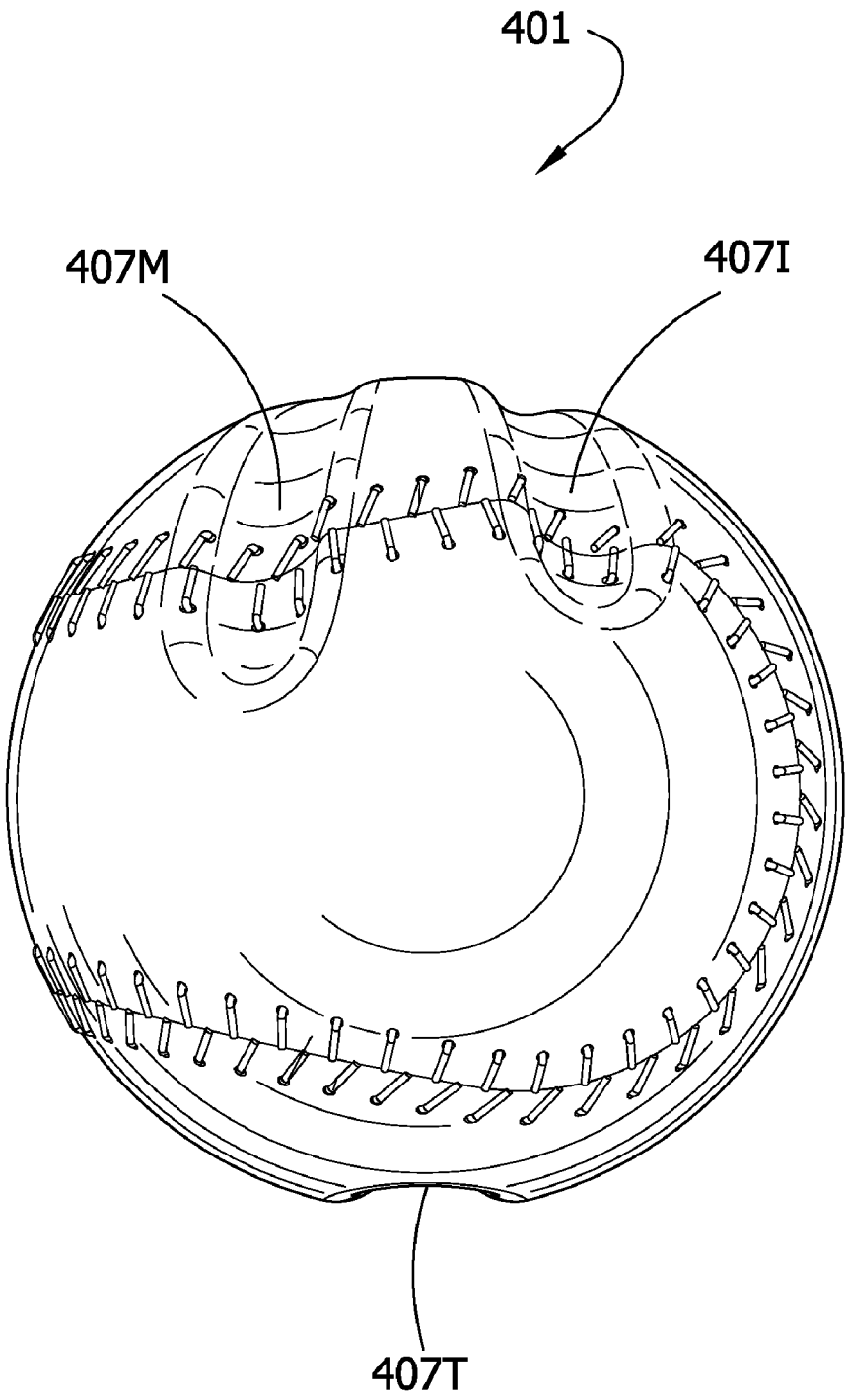
FIG. 27 is a front elevation thereof.
Figure 28:
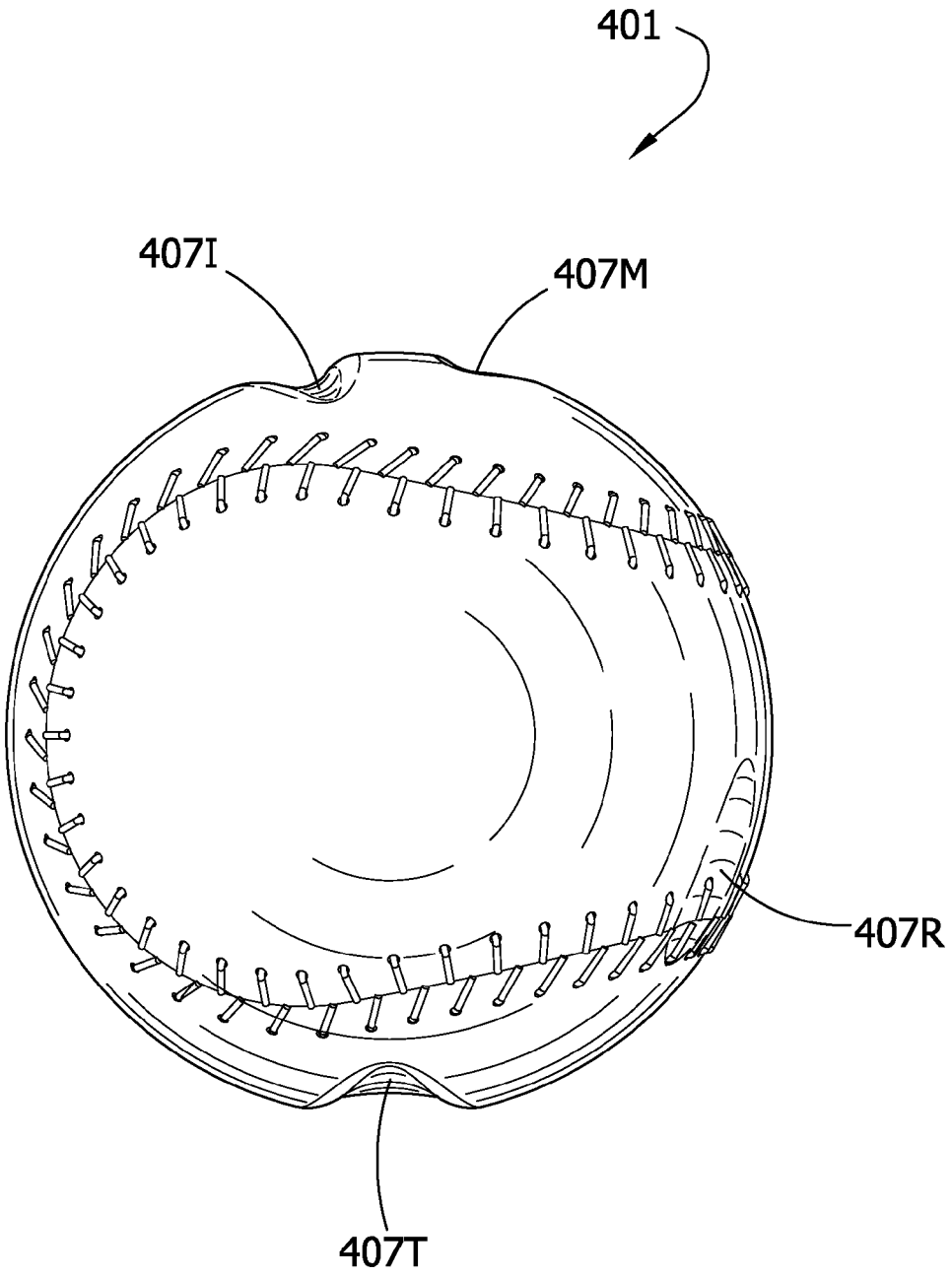
FIG. 28 is a rear elevation thereof.

Referring now to the drawings, and in particular to FIGS. 1-7, a grip training device is shown to comprise in a first embodiment a baseball, generally indicated at 101 (broadly, "a body"), having a cover portion 103 and a seam 105. The grip training device further comprises finger position indicia generally indicated at 107. The cover portion 103 and the seam portion 105 may be formed like a conventional baseball, but may be formed as a single piece of material with the baseball 101. The seam portion 105 may be, for example, a raised part of the baseball 101 made to simulate the appearance of sewn on seams. Seams (not shown) could be illustrated by printed markings on the surface of the ball that are not raised. Moreover, the seams could be entirely omitted within the scope of the present invention. The cover portion 103 is considered in the illustrated embodiment to be the outer surface of the baseball 101 away from the seam portion. It should also be noted that the balls and grip positions depicted herein and throughout the application are for a right-handed thrower. As would be readily understood by one skilled in the art, the exemplary embodiments of the present invention can be readily applied to left-handed throwers, such as by producing balls having a mirror image of the balls depicted herein.

The baseball 101 of the first embodiment is adapted for training a user to grip a baseball for properly throwing a two-seam fastball pitch. A hand H on the baseball 101 in the proper grip position using the finger position indicia 107. The grip for throwing a two-seam fastball requires that the user place his index and middle finger on respective baseball seams at the point where the seams are closest to one another, such as is depicted in FIG. 1. To aid the user in developing the proper grip, the baseball of the first exemplary embodiment includes the finger position indicia 107 specifically demonstrating where the user should place his fingers. In this example, the finger position indicia take the form of surface depressions of sufficient depth, width, and length to be easily felt and seen by the user. These depressions 107 are sized and shaped to receive and guide the fingers of the user to the correct position and orientation on the ball. In the exemplary first embodiment shown, surface depressions are included for the index finger 107I, the middle finger 107M, the thumb 107T, and the ring finger 107R (see FIG. 5) of the user. Generally, any portion of the hand that touches the baseball 101 as part of the grip, including any digit and any portion of the palm of the hand touching the ball, may be included as a feature on the surface of the ball. The corresponding parts of all embodiments of the grip training device will be given the same base reference numerals for all of the embodiments illustrated herein, but will be increased by "100" for each successive embodiment.

The depth, width, and length of the depressions 107 may be varied to compensate for the size of the user's hands. For example, different baseballs for users with small, medium, or large hands may be provided without departing from the scope of embodiments of the present invention. Moreover, as a user becomes more skilled in selecting the correct grip, the relative prominence of the surface features may be lessened, whereby the user is encouraged to rely upon his own knowledge of the grip, rather than the features included on the ball. For example, a grip training device for a beginner may include deep, channel-like depressions for receiving substantial portions of the fingers, while a grip training device for a more advanced user may include shallow, minimal depressions that serve only as a gentle reminder of the proper finger positioning for the given grip.

Other surface features may be used alone or in combination with such depressions to demonstrate where the user should place his fingers. For example, the surface of the ball may include finger outlines depicting visually where each finger should lie upon the surface of the ball. The user can readily place his fingers on the ball within the finger outlines to establish a proper grip. Additional surface features may include labels noting the location of each finger with appropriate text for instructing the user regarding finger placement. Other surface features may include color-coding, such as each finger position indicated by a particular color (e.g., thumb blue, index finger yellow, middle finger green, etc.). Varying surface textures may also be included to demonstrate finger position. For example, the surface of the ball may be substantially rough, having smooth portions for placement of the fingers, or vice-versa. As noted above, each of these surface features may be used alone or in combination with other features to further demonstrate finger location on the ball. Other surface features not listed here are also contemplated as within the scope of embodiments of the invention.

As would be readily understood by one skilled in the art, the grip training devices described herein may be utilized to learn grip in two manners. First, the devices may be gripped by the user, without throwing the device, in order to learn the grip. Gripping the device without throwing provides a useful memory aid to the user. Second, the user may also grip and throw the devices as with a regular ball, thereby using the grip training during throwing. Gripping the device while throwing provides a useful throwing training tool to the user.

Referring now to FIGS. 8-14, a baseball 201 of a second exemplary embodiment is depicted. The baseball 201 of the second embodiment is adapted for training a user to grip a baseball for properly throwing a fork ball, or split finger pitch. Again, to aid the user in developing the proper grip, the baseball 201 of the second exemplary embodiment includes surface features specifically demonstrating where the user should place his fingers. Such features can include one or more of surface depressions, finger outlines, descriptive labels, color-coding, and surface textures, among others. In the exemplary second embodiment shown, surface depressions 207 are included for the index finger (207I), the middle finger (207M), the thumb (207T), and the ring finger (207R) of the user.

Referring now to FIGS. 15-21, a baseball 301 of a third exemplary embodiment is depicted. The baseball 301 of the third embodiment is adapted for training a user to grip a baseball for properly throwing a slider. Again, to aid the user in developing the proper grip, the baseball 301 of the third exemplary embodiment includes finger position indicia 307 specifically demonstrating where the user should place his fingers. The indicia can include one or more of surface depressions, finger outlines, descriptive labels, color-coding, and surface textures, among others. In the exemplary third embodiment shown, the finger position indicia comprise surface depressions 307 are included for the index finger 307I, the middle finger 307M, the thumb 307T, and the ring finger 307R of the user.

Referring now to FIGS. 22-28, a baseball 401 of a fourth exemplary embodiment is depicted. The baseball 401 of the fourth embodiment is adapted for training a user to grip a baseball for properly throwing a four-seam fastball. Again, to aid the user in developing the proper grip, the baseball 401 includes finger position indicia 407 specifically demonstrating where the user should place his fingers. The finger position indicia may include one or more of surface depressions, finger outlines, descriptive labels, color-coding, and surface textures, among others. In the exemplary fourth embodiment shown, the finger position indicia 407 take the form of surface depressions are included for the index finger 407I, the middle finger 407M, the thumb 407T, and the ring finger 407R of the user.

Figure 29:
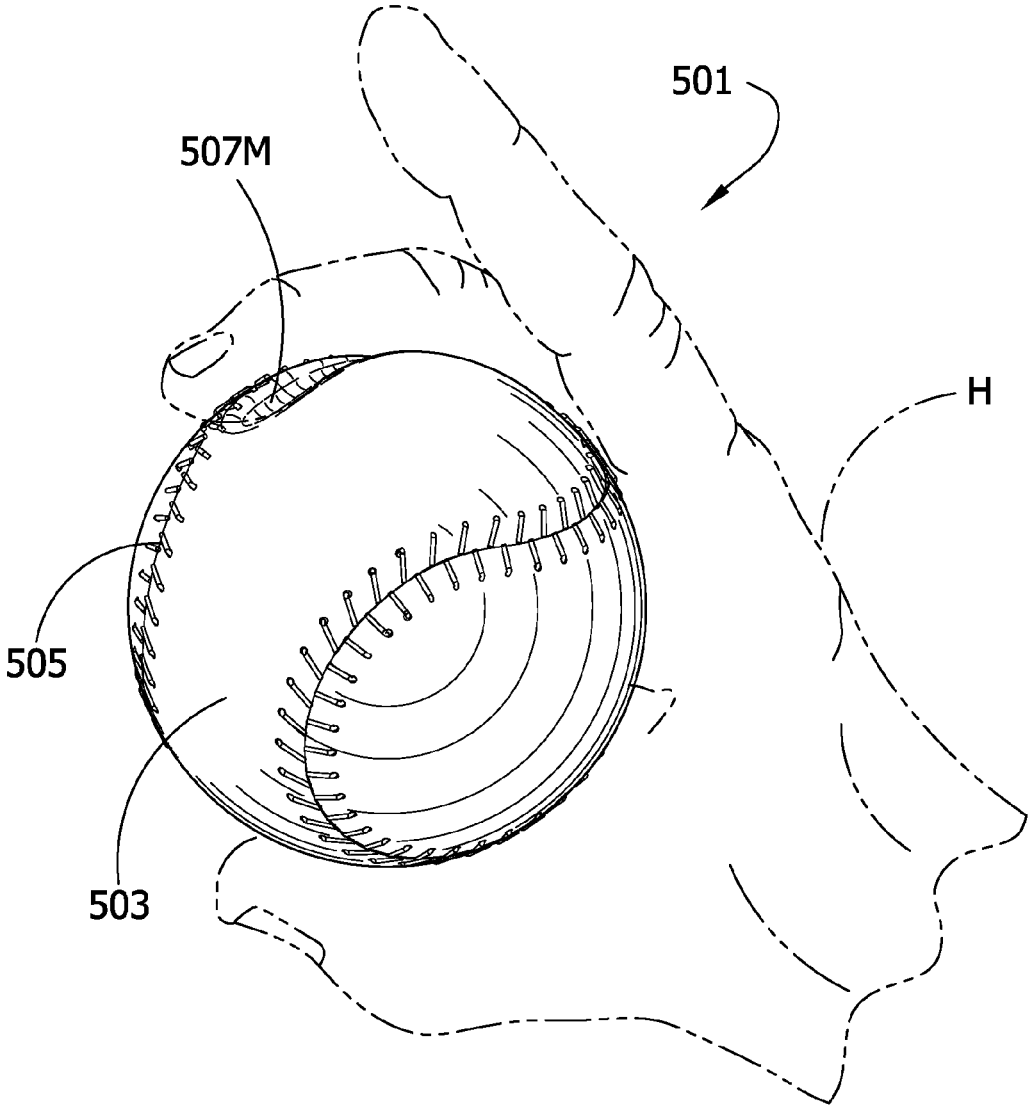
FIG. 29 is a perspective seen from the front and right side of a grip training device of a fifth embodiment for a beginner's curveball grip and showing a hand gripping the device in phantom.
Figure 30:
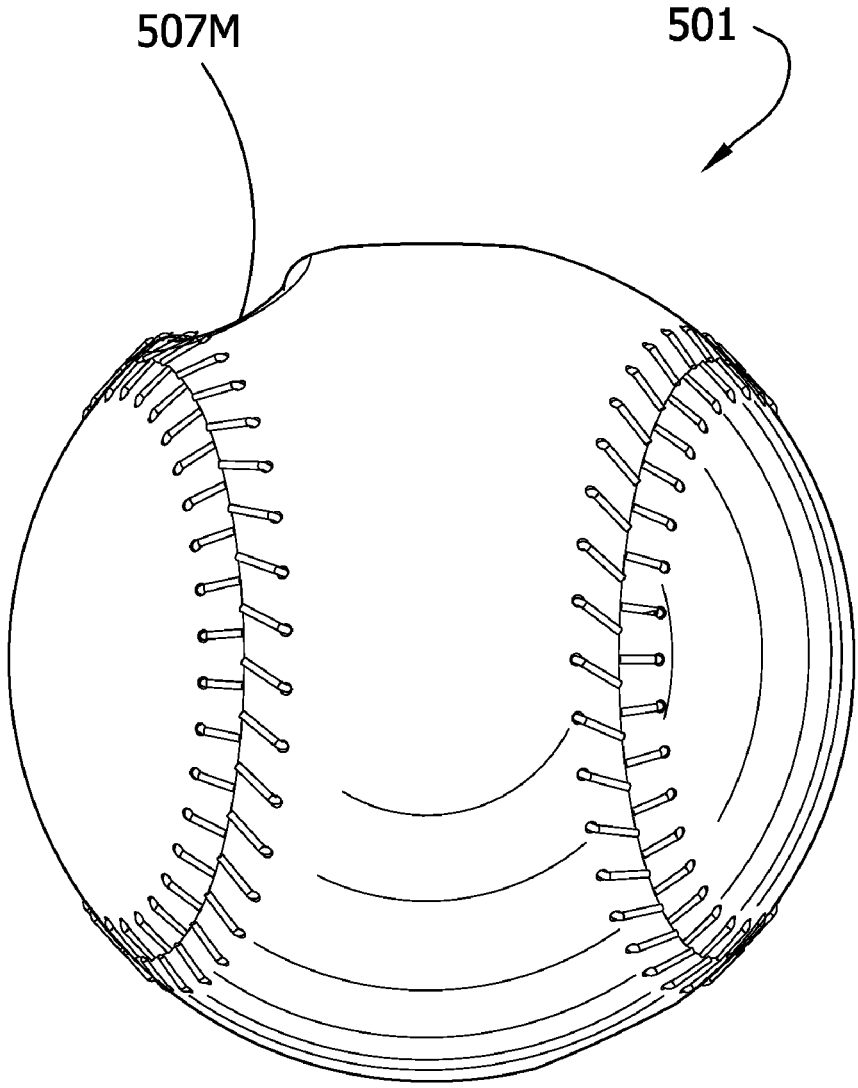
FIG. 30 is a front elevation of the grip training device of FIG. 29.
Figure 31:
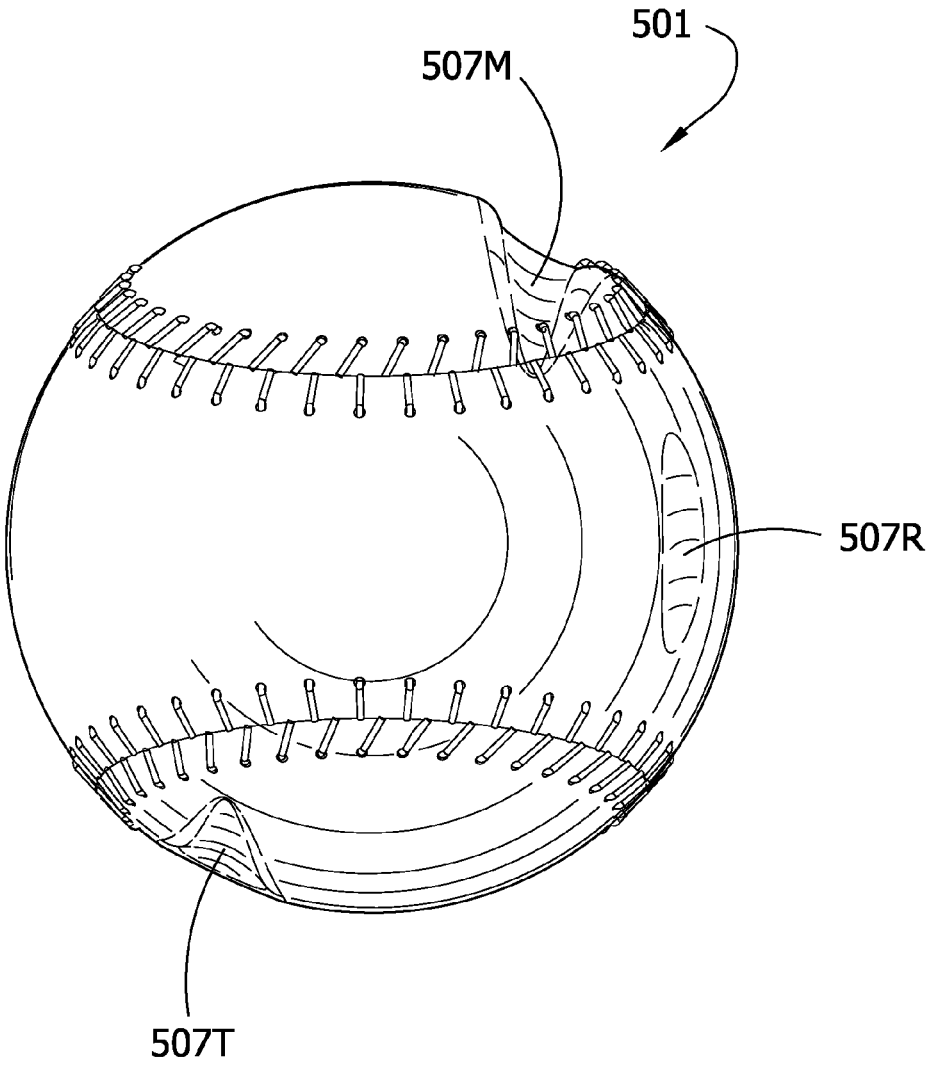
FIG. 31 is a rear elevation thereof.
Figure 32:
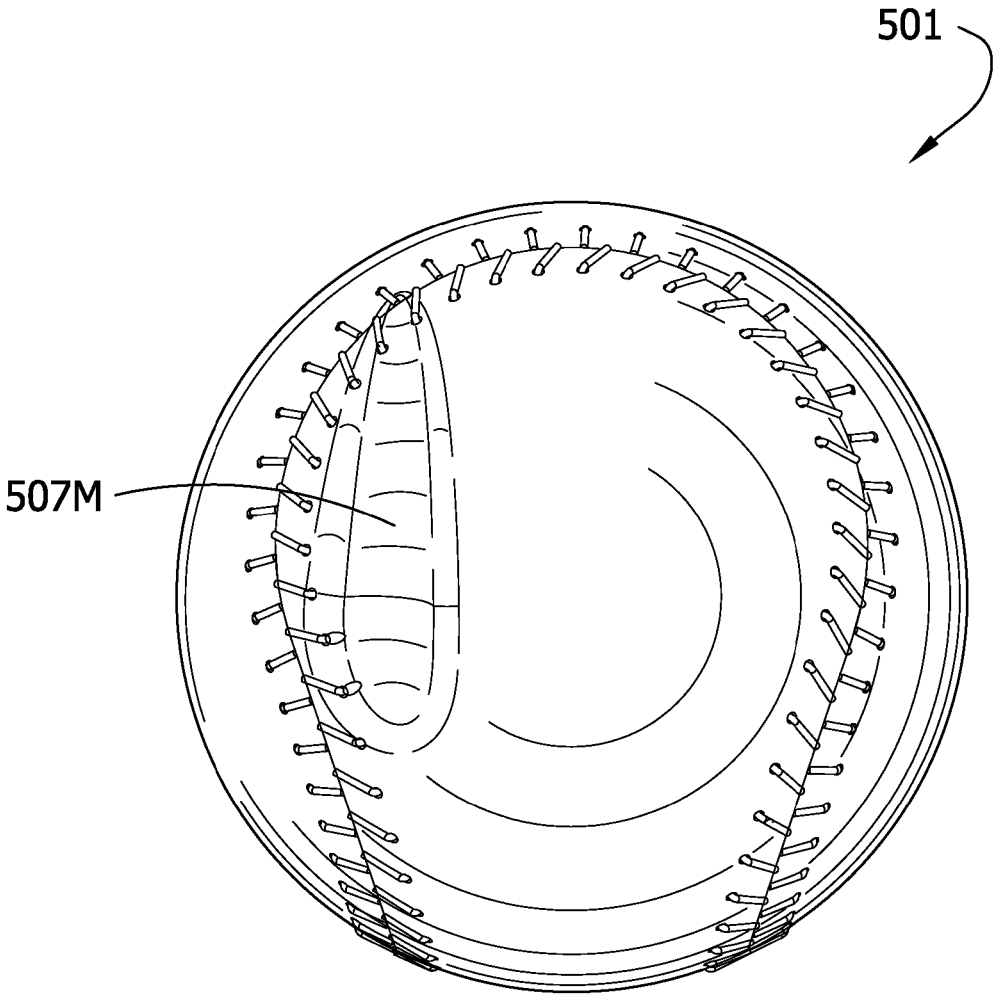
FIG. 32 is a top plan view thereof.
Figure 33:
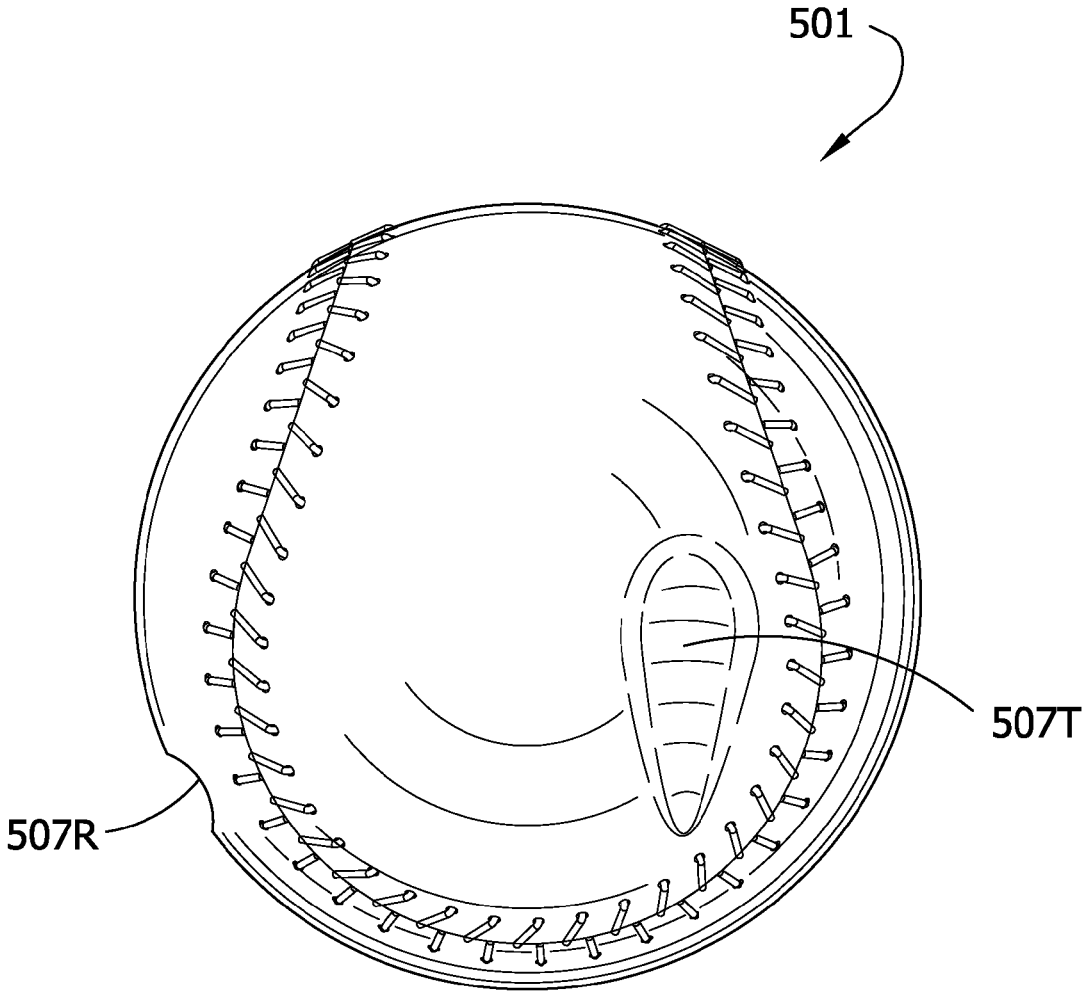
FIG. 33 is a bottom plan view thereof.
Figure 34:
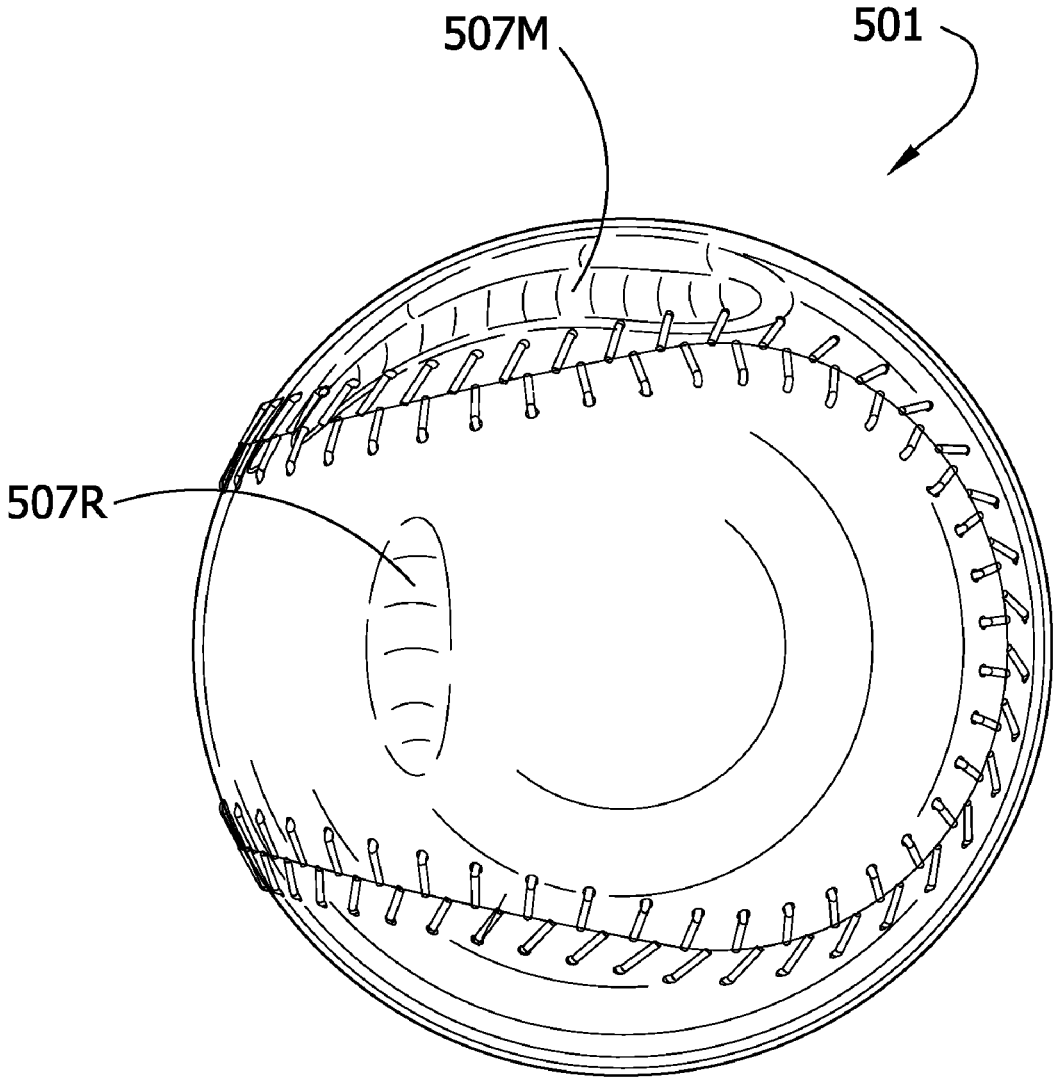
FIG. 34 is a left side elevation thereof.
Figure 35:
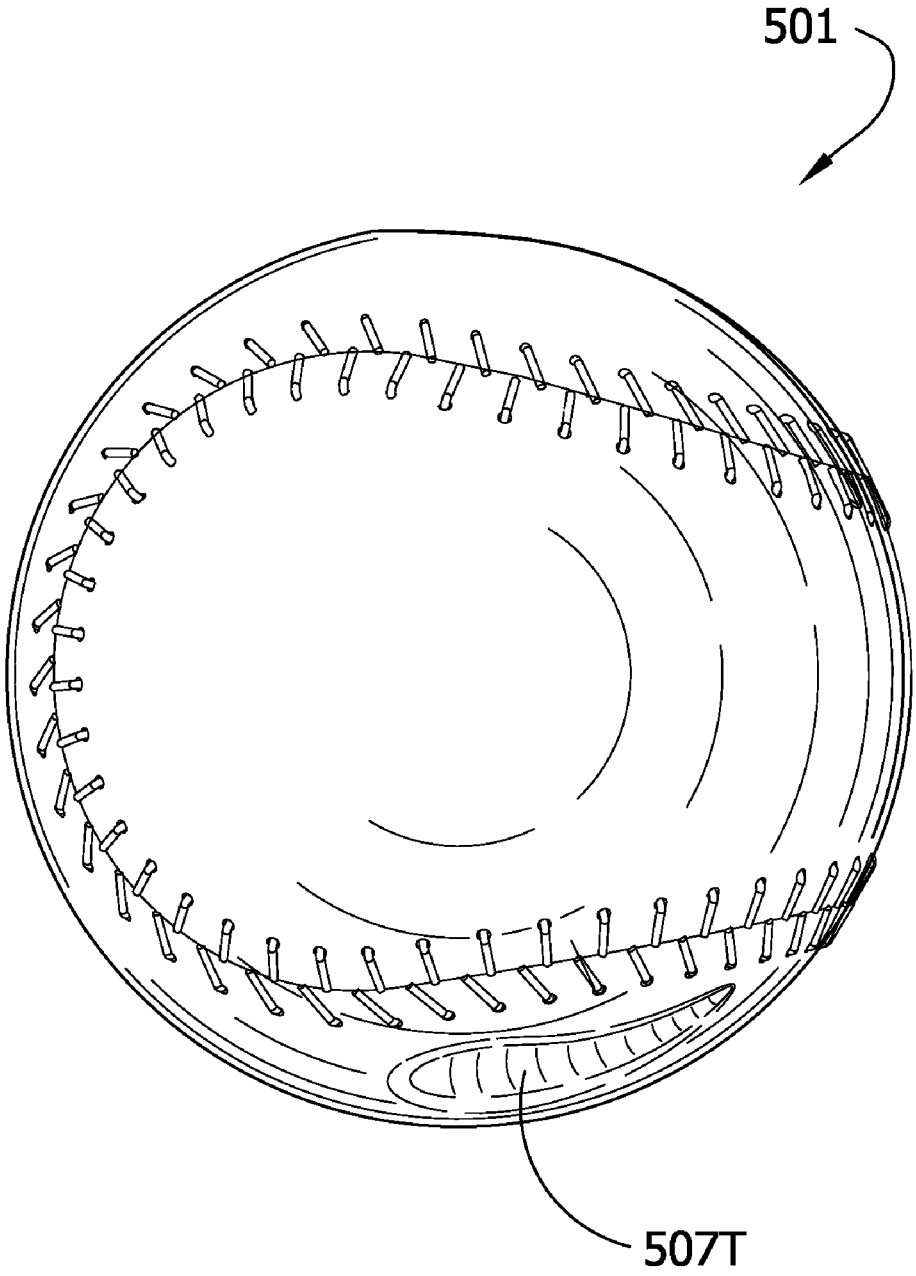
FIG. 35 is a right side elevation thereof.
Figure 36:
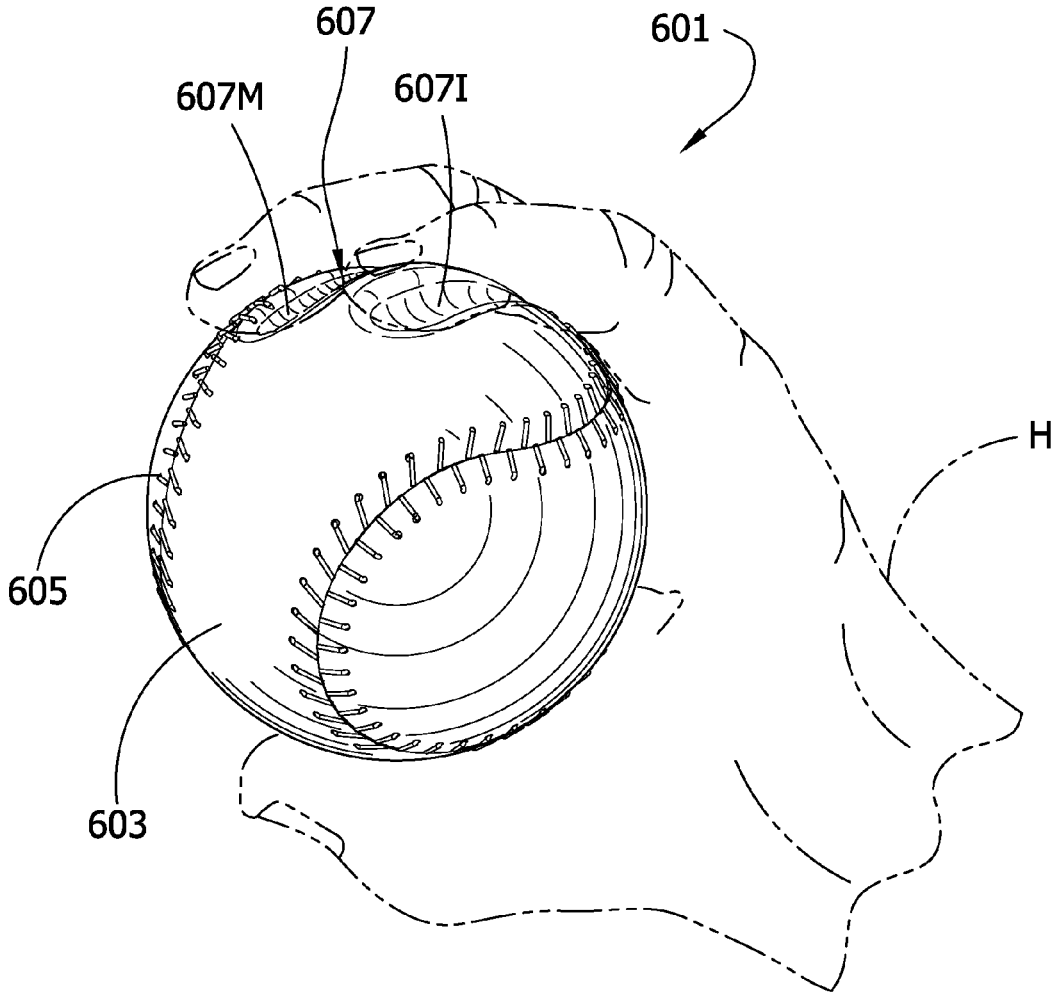
FIG. 36 is a perspective seen from the front and right side of a grip training device of a sixth embodiment for a standard curveball grip and showing a hand gripping the device in phantom.
Figure 37:
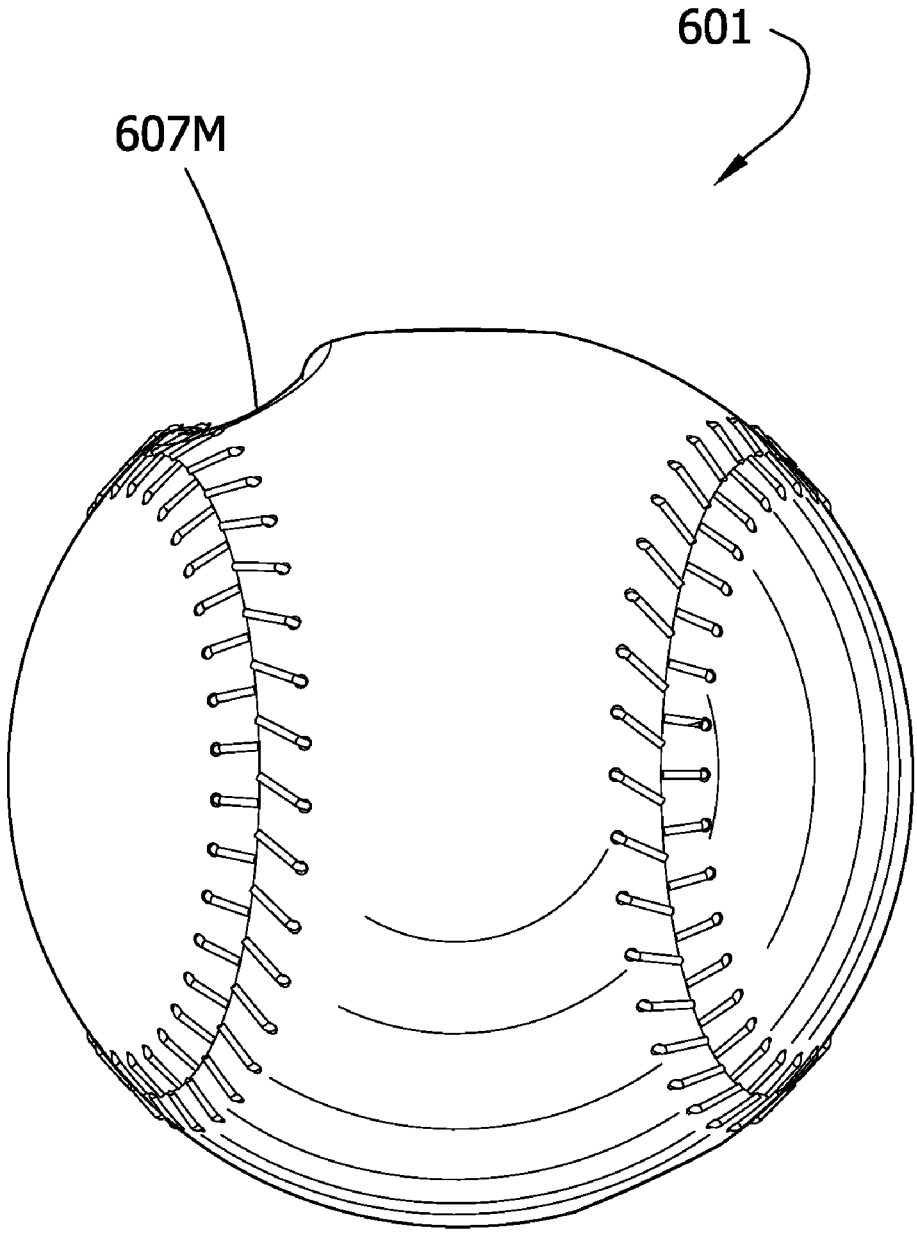
FIG. 37 is a front elevation of the grip training device of FIG. 36.
Figure 38:
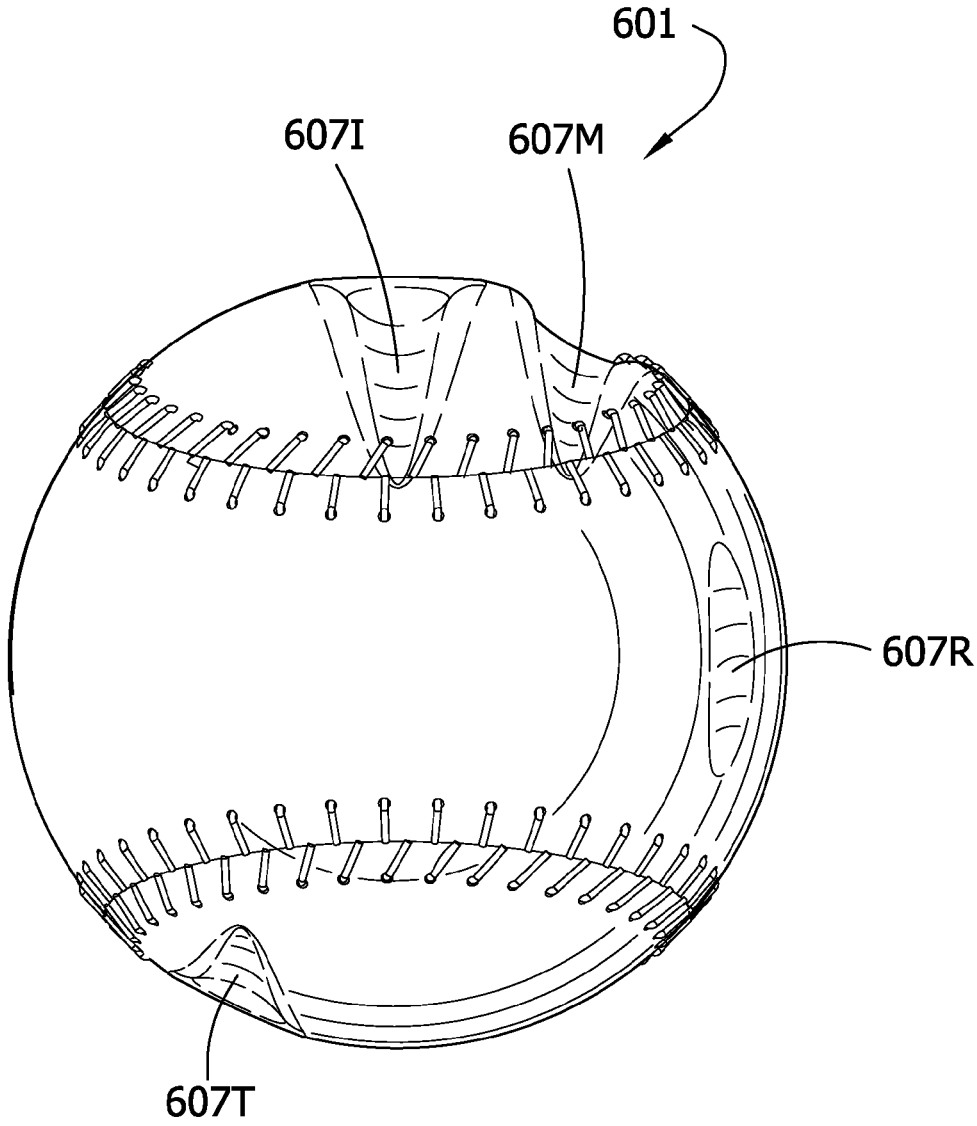
FIG. 38 is a rear elevation thereof.
Figure 39:
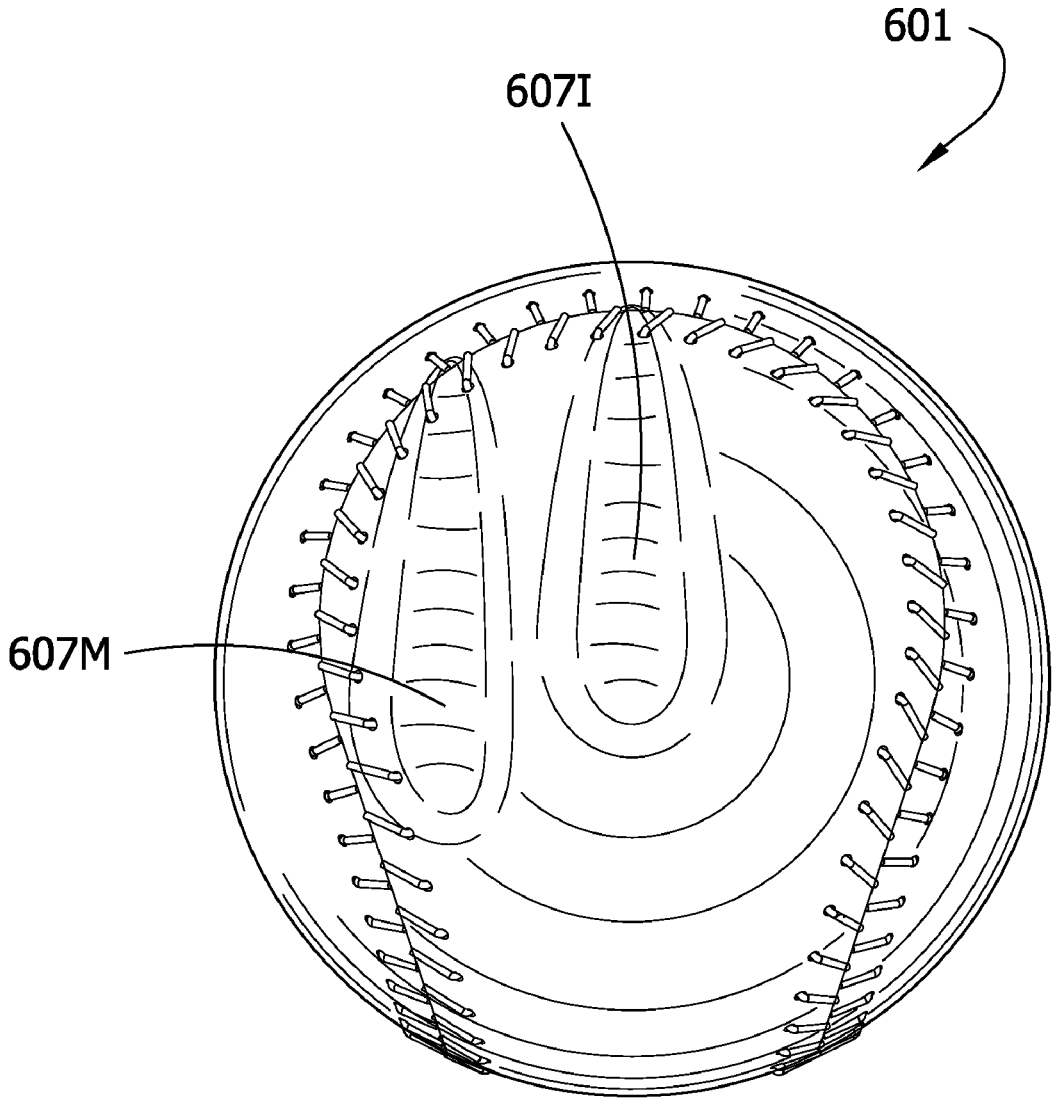
FIG. 39 is a top plan view thereof.
Figure 40:
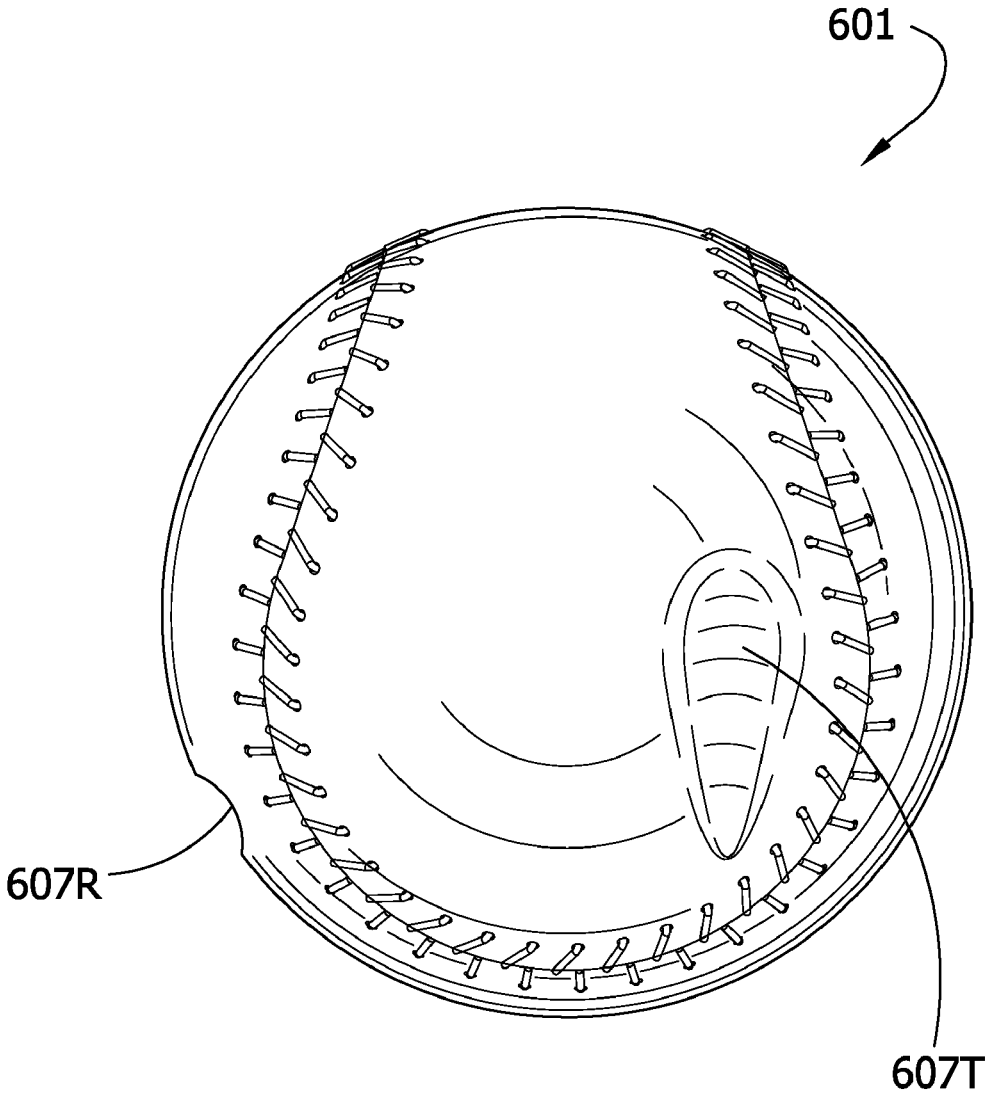
FIG. 40 is a bottom plan view thereof.
Figure 41:
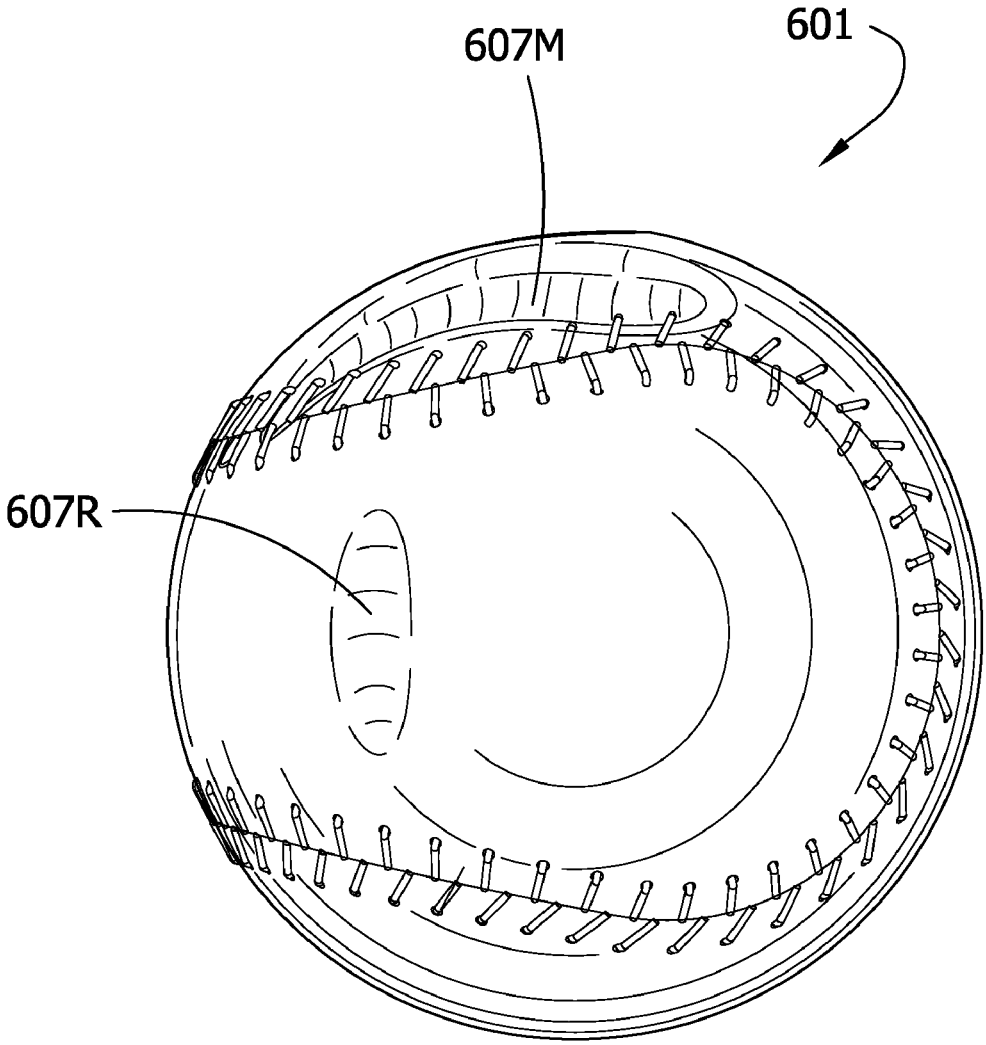
FIG. 41 is a left side elevation thereof.
Figure 42:
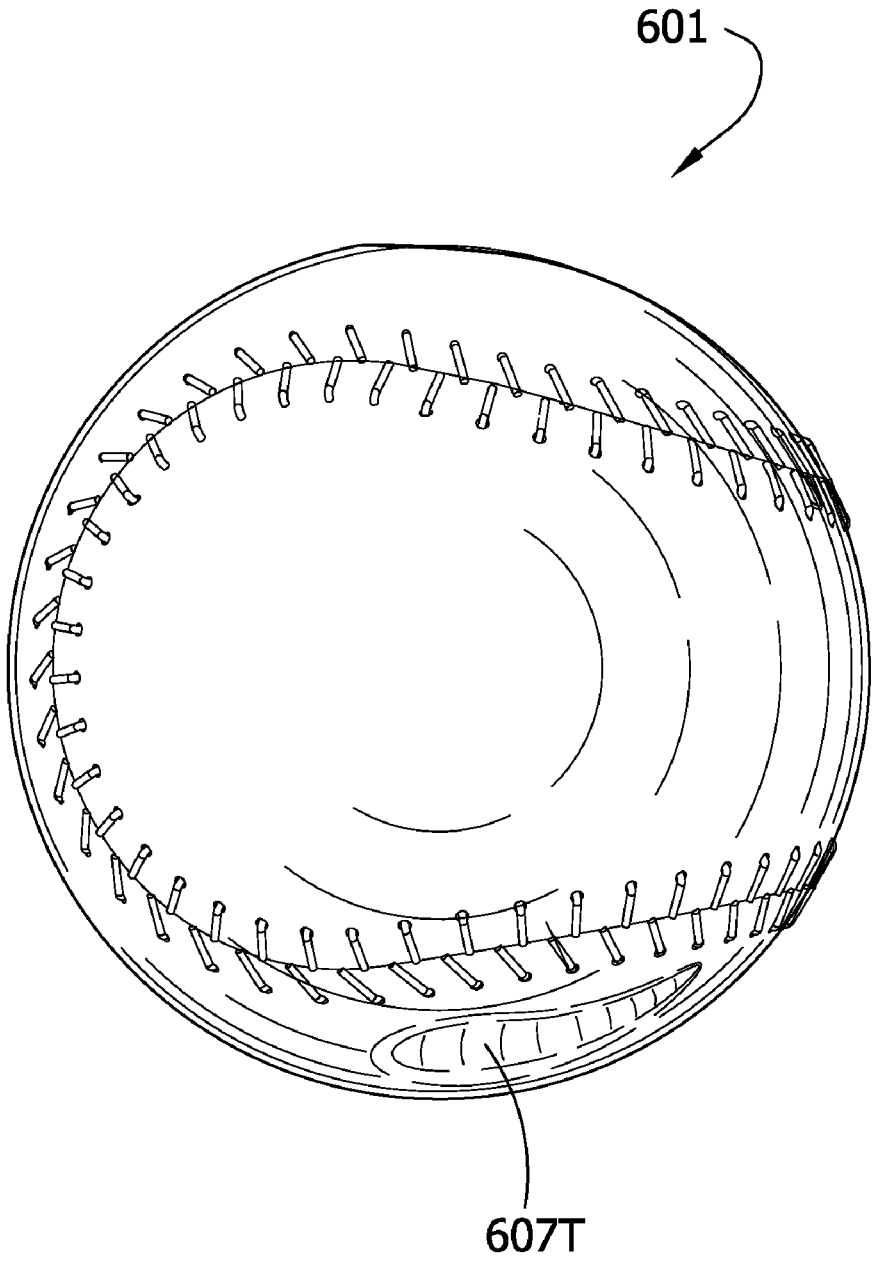
FIG. 42 is a right side elevation thereof.
Figure 43:
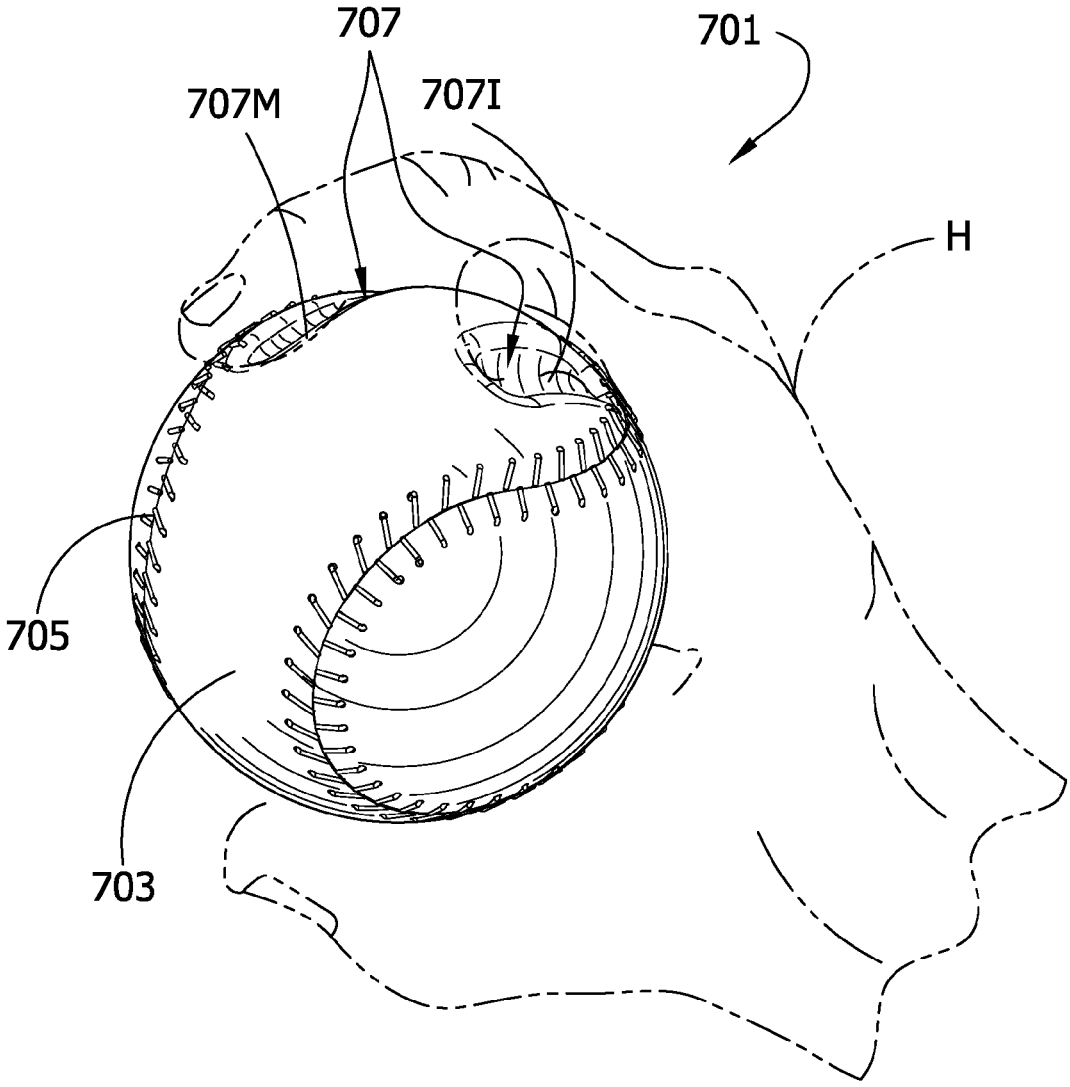
FIG. 43 is a perspective seen from the front and right side of a grip training device of a seventh embodiment for a four knuckle curveball grip and showing a hand gripping the device in phantom.
Figure 44:
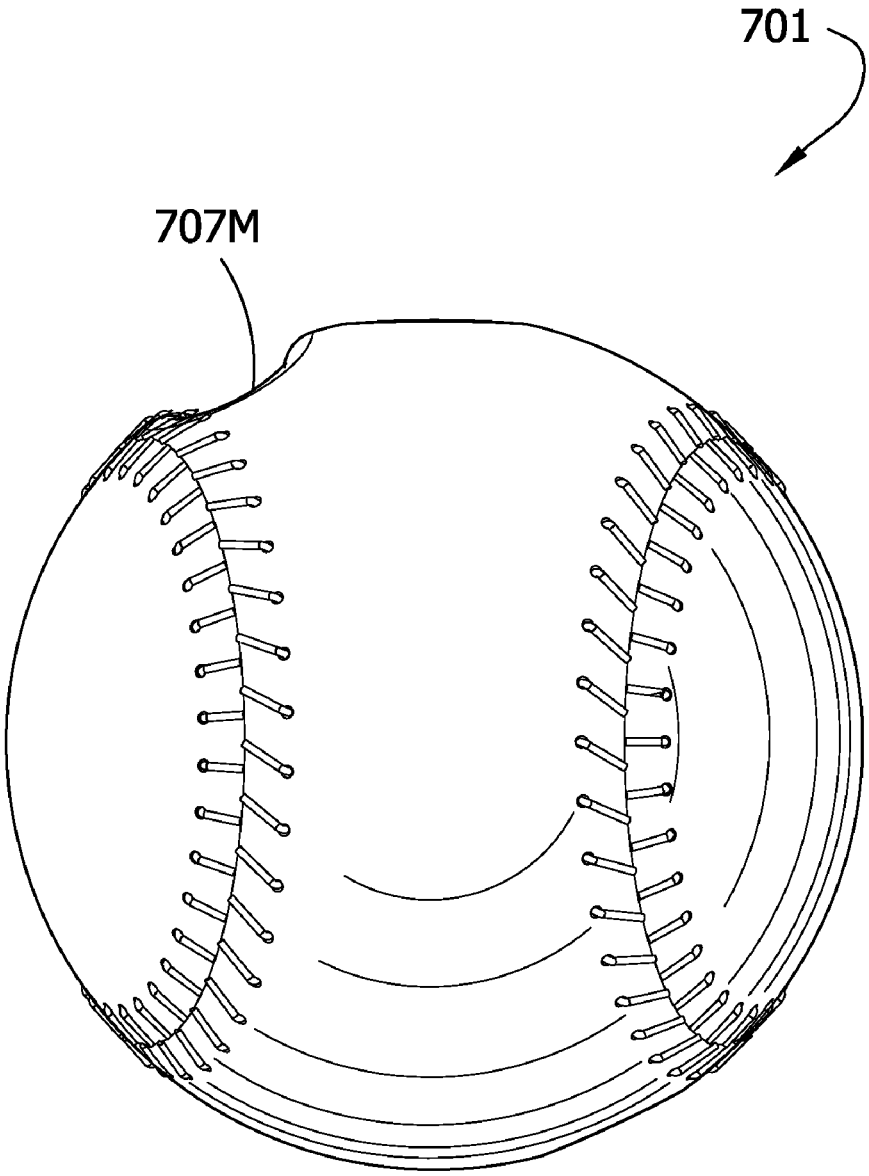
FIG. 44 is front elevation of the grip training device of FIG. 43.
Figure 45:
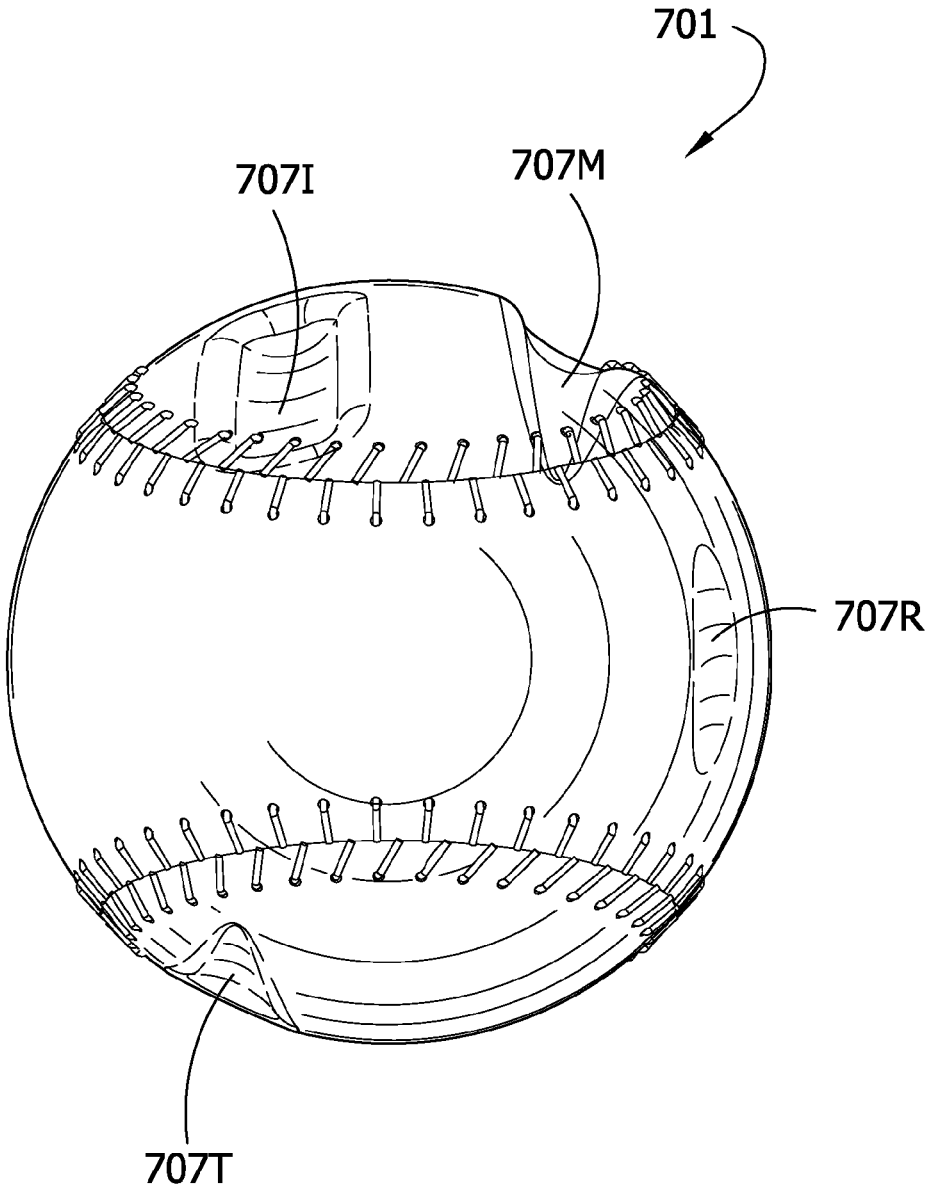
FIG. 45 is a rear elevation thereof.
Figure 46:
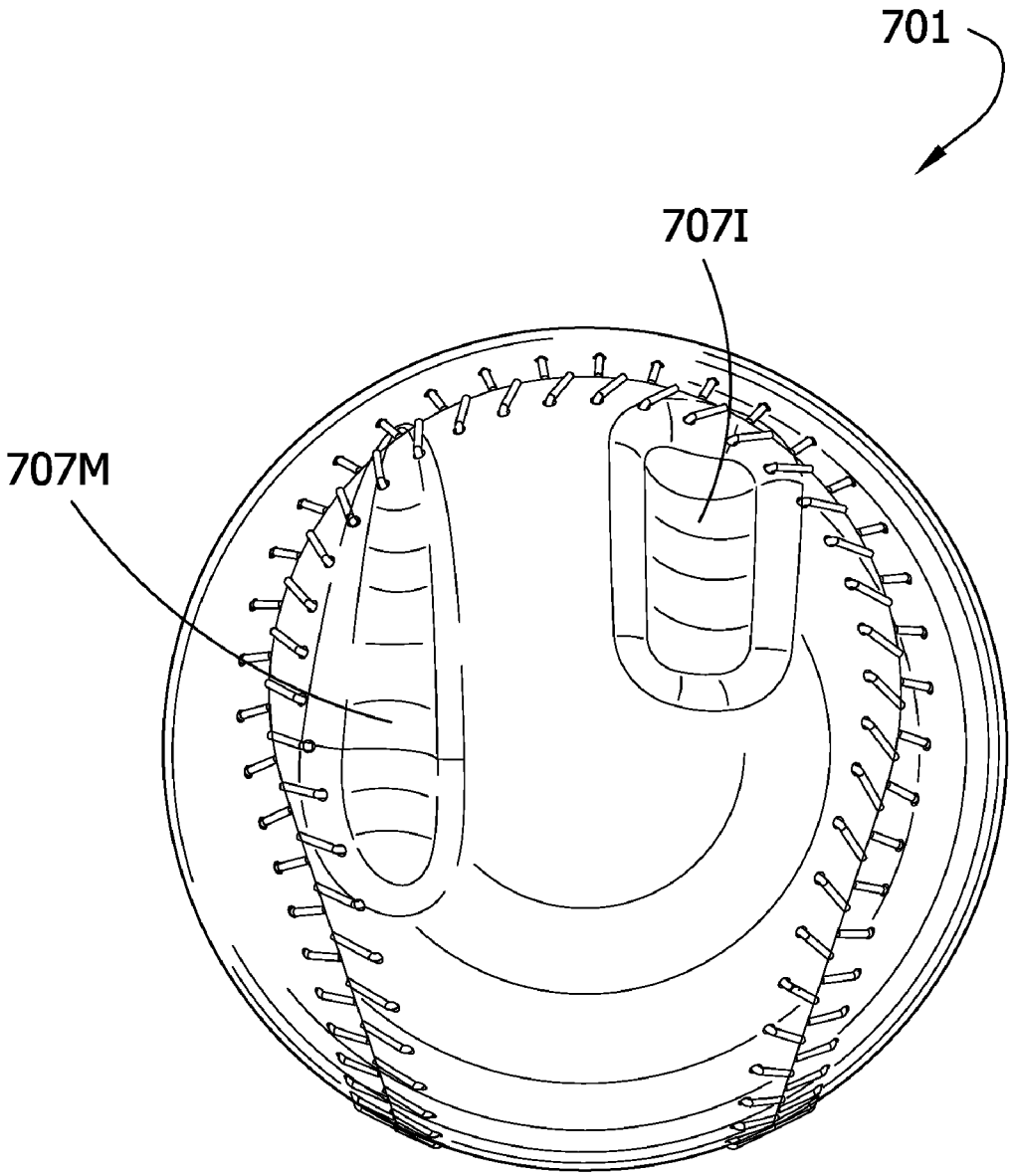
FIG. 46 is a top plan view thereof.
Figure 47:
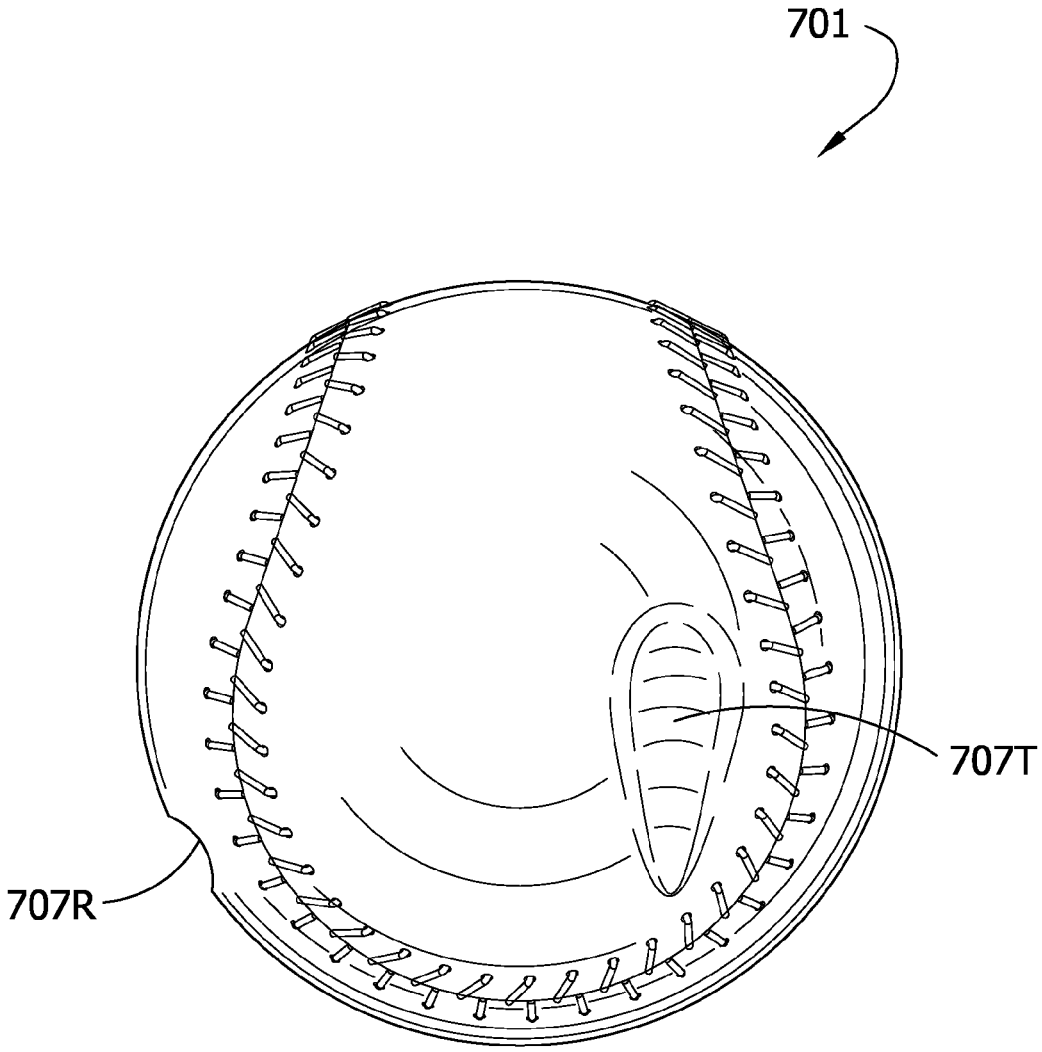
FIG. 47 is a bottom plan view thereof.
Figure 48:
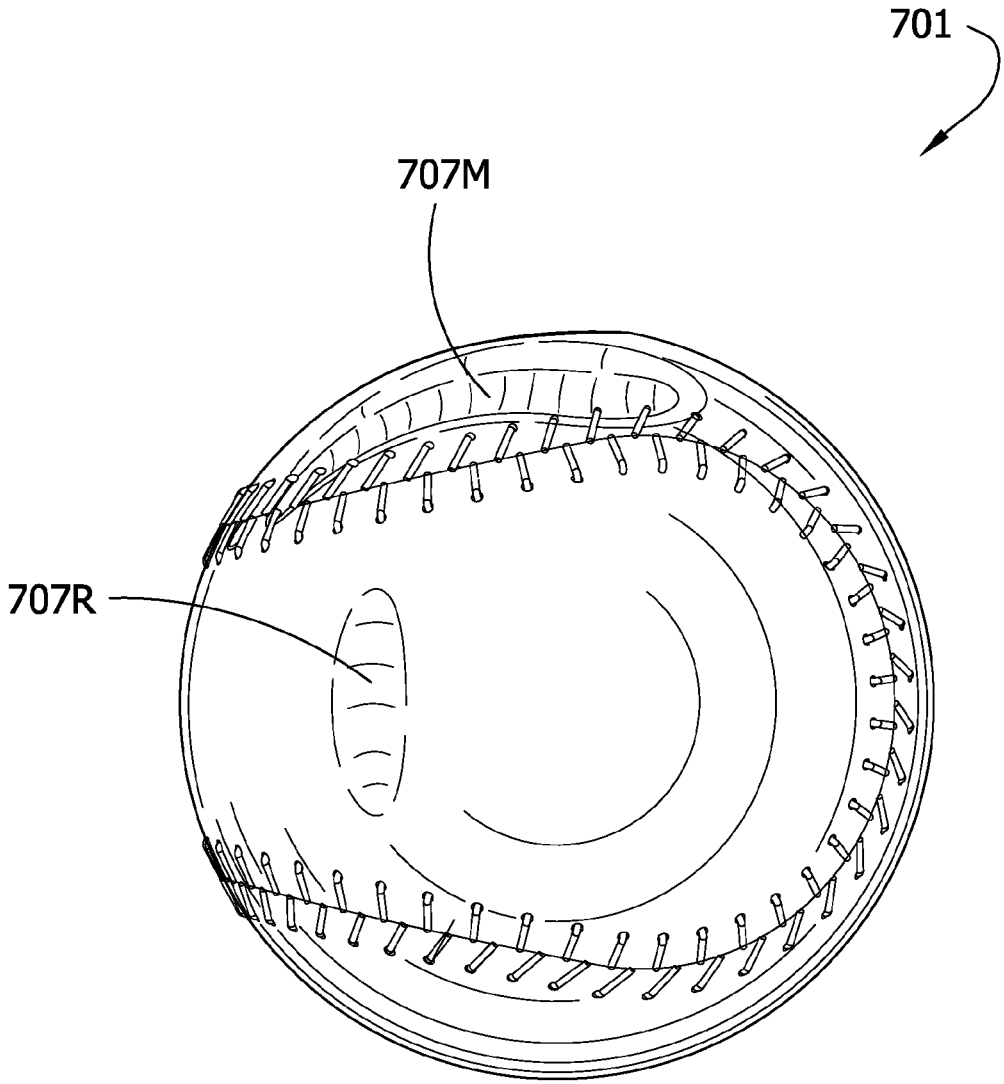
FIG. 48 is a left side elevation thereof.
Figure 49:
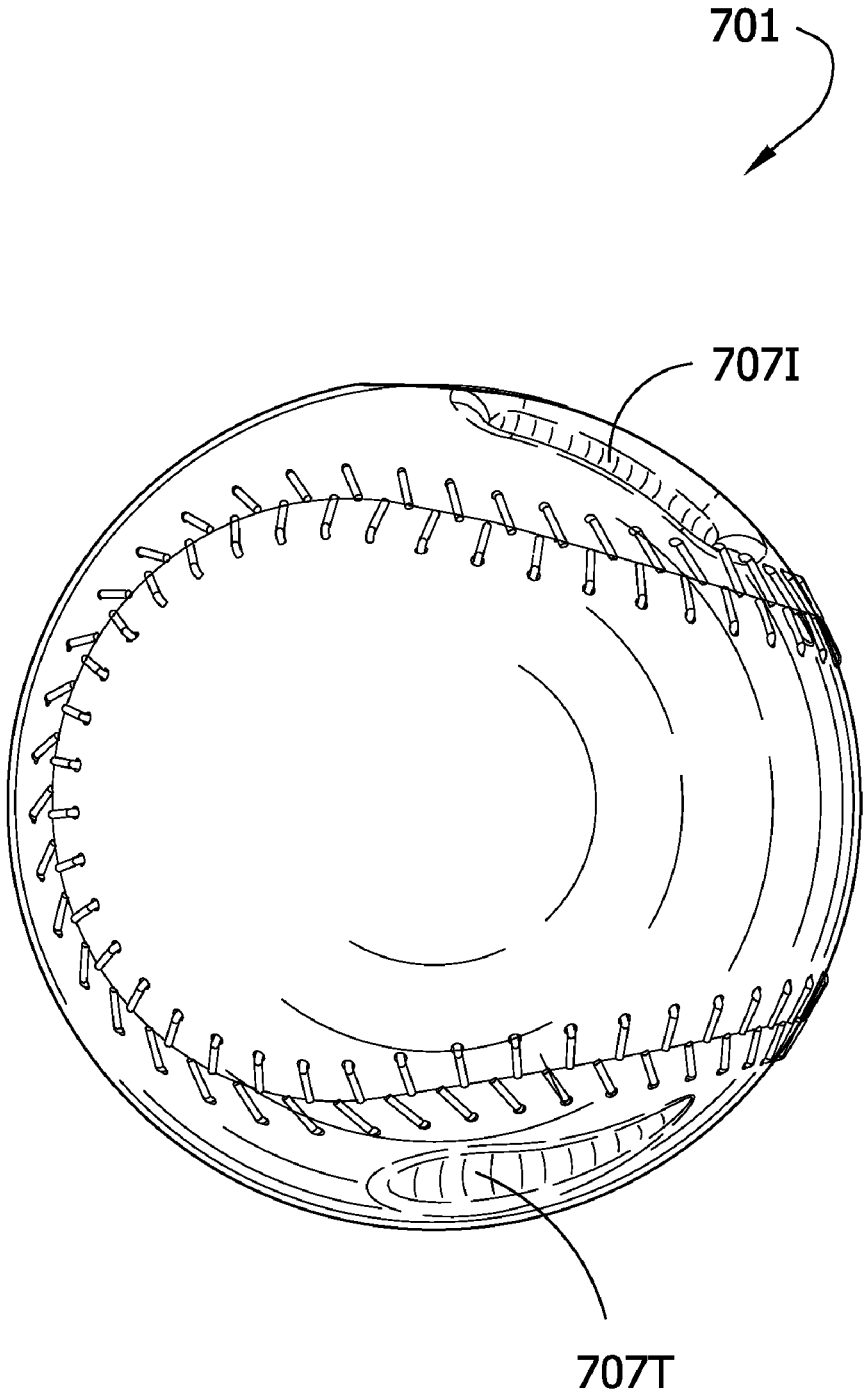
FIG. 49 is a right side elevation thereof.
Figure 50:
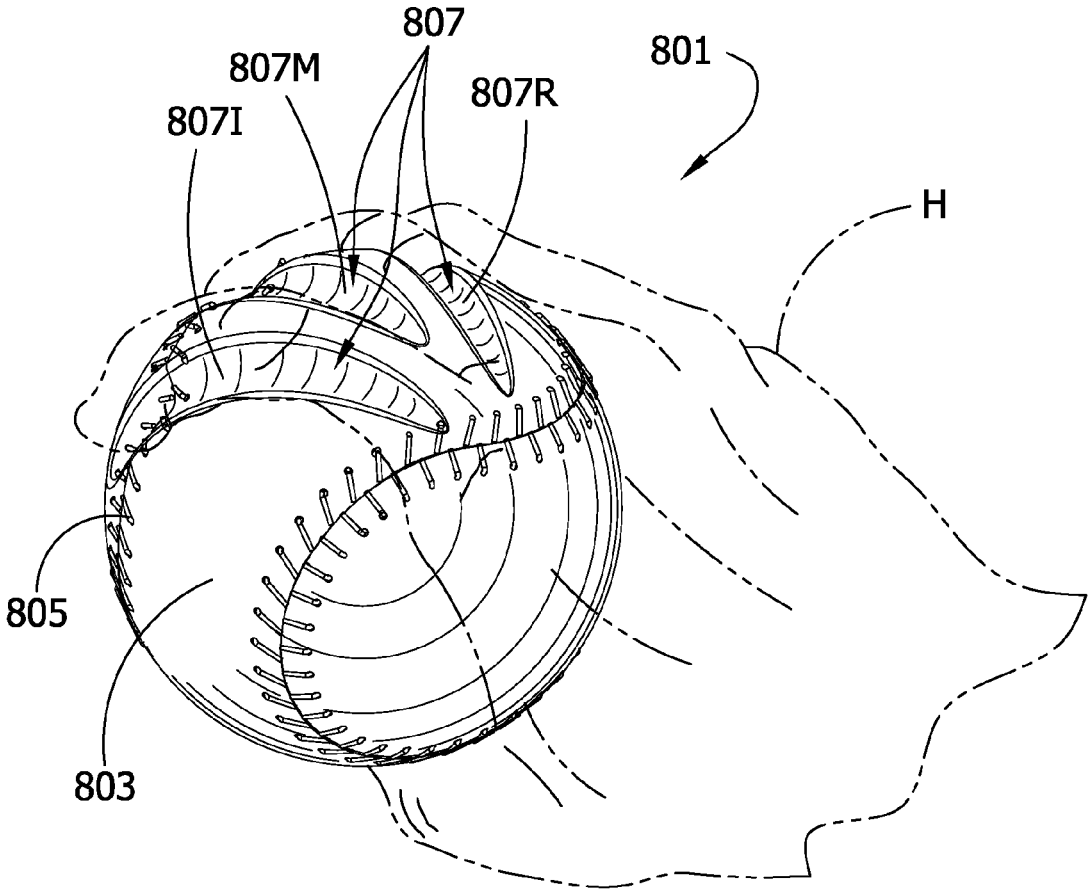
FIG. 50 is a perspective seen from the rear and right side of a grip training device of a eighth embodiment for a three finger changeup grip and showing a hand gripping the device in phantom.
Figure 51:
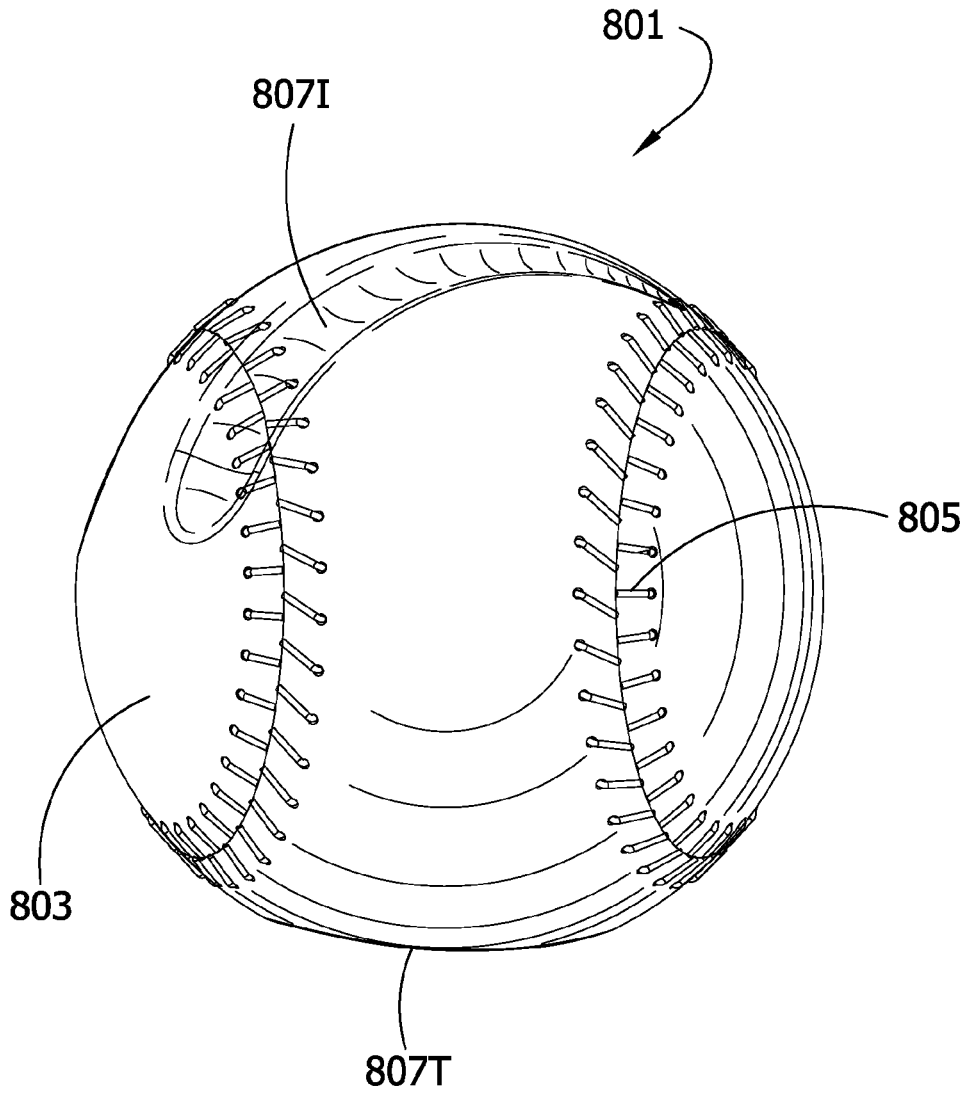
FIG. 51 is right side elevation of the grip training device of FIG. 50.
Figure 52:
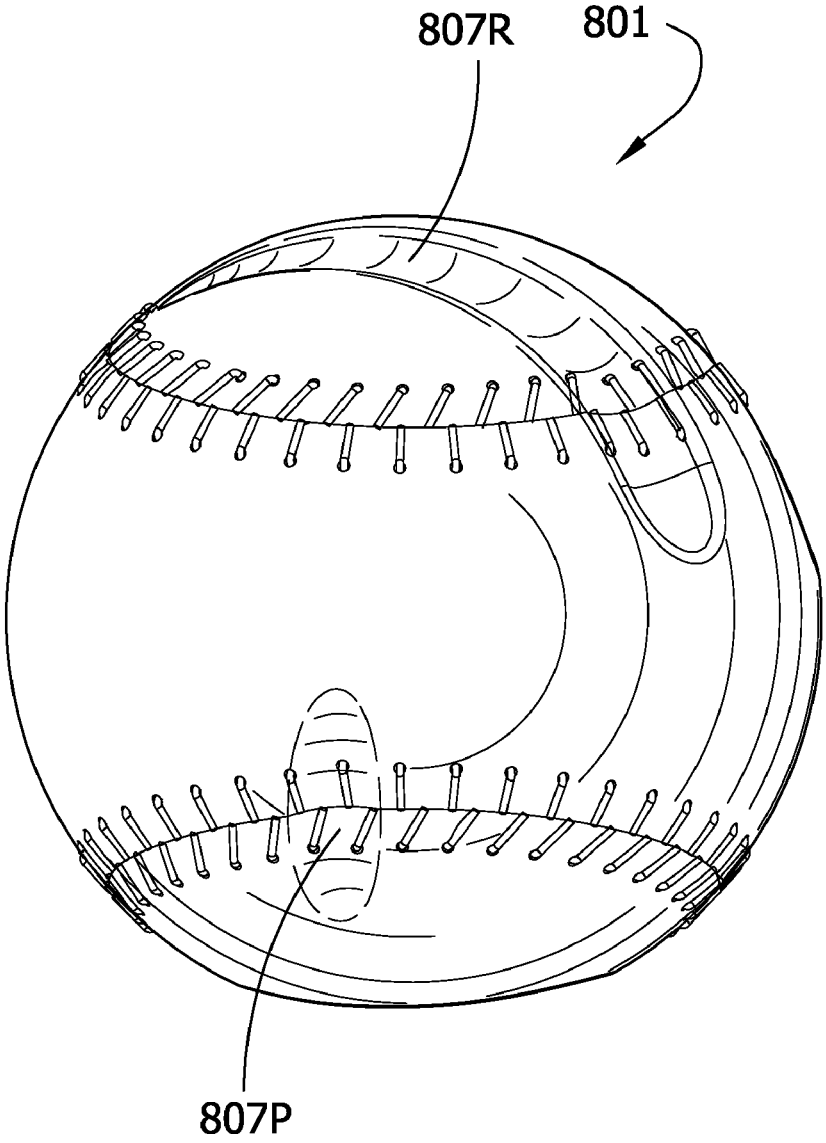
FIG. 52 is a left side elevation thereof.
Figure 53:
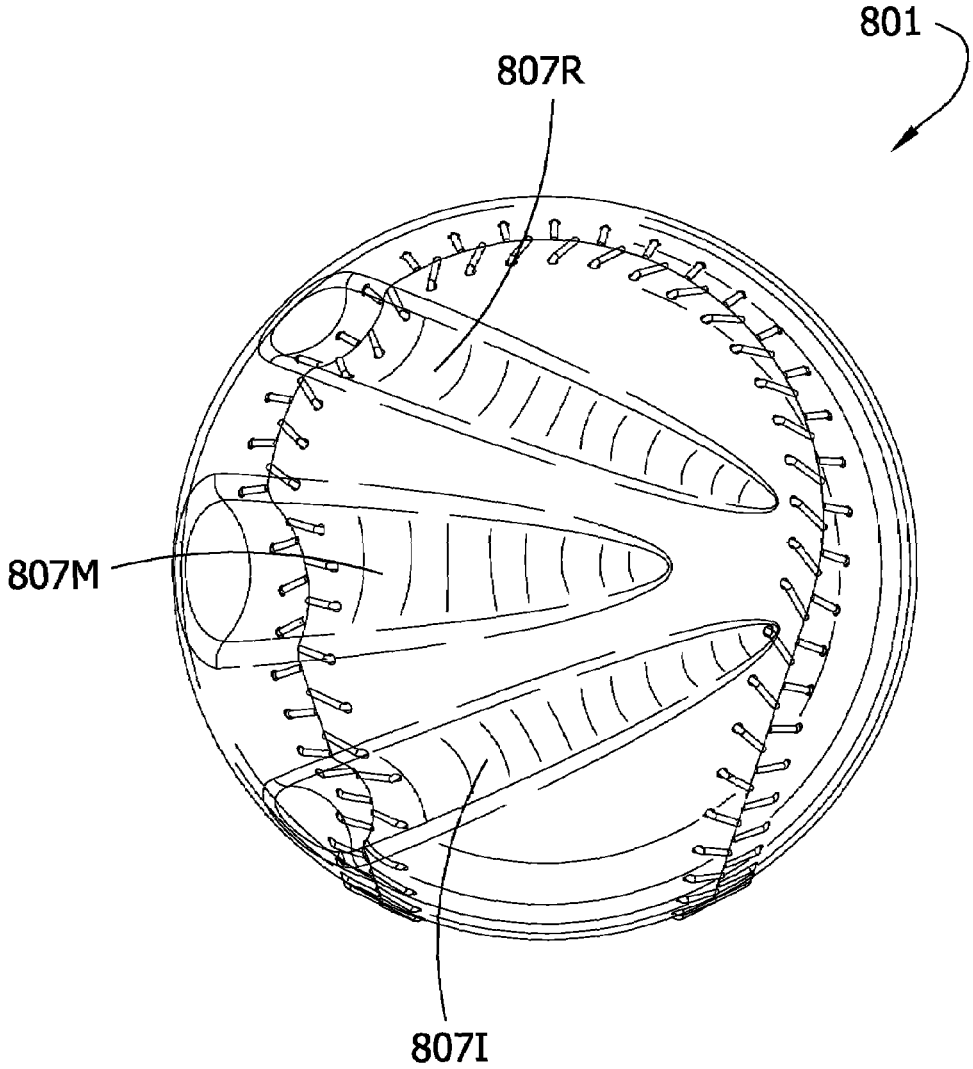
FIG. 53 is a top plan view thereof.
Figure 54:
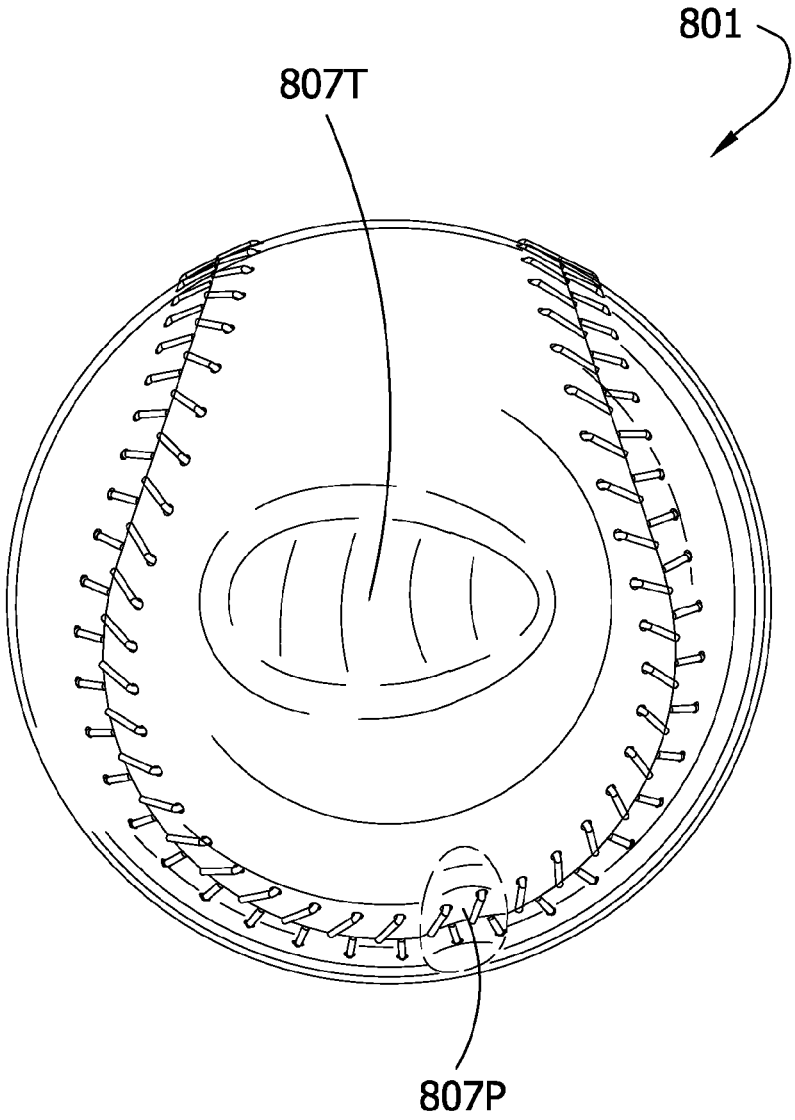
FIG. 54 is a bottom plan view thereof.
Figure 55:
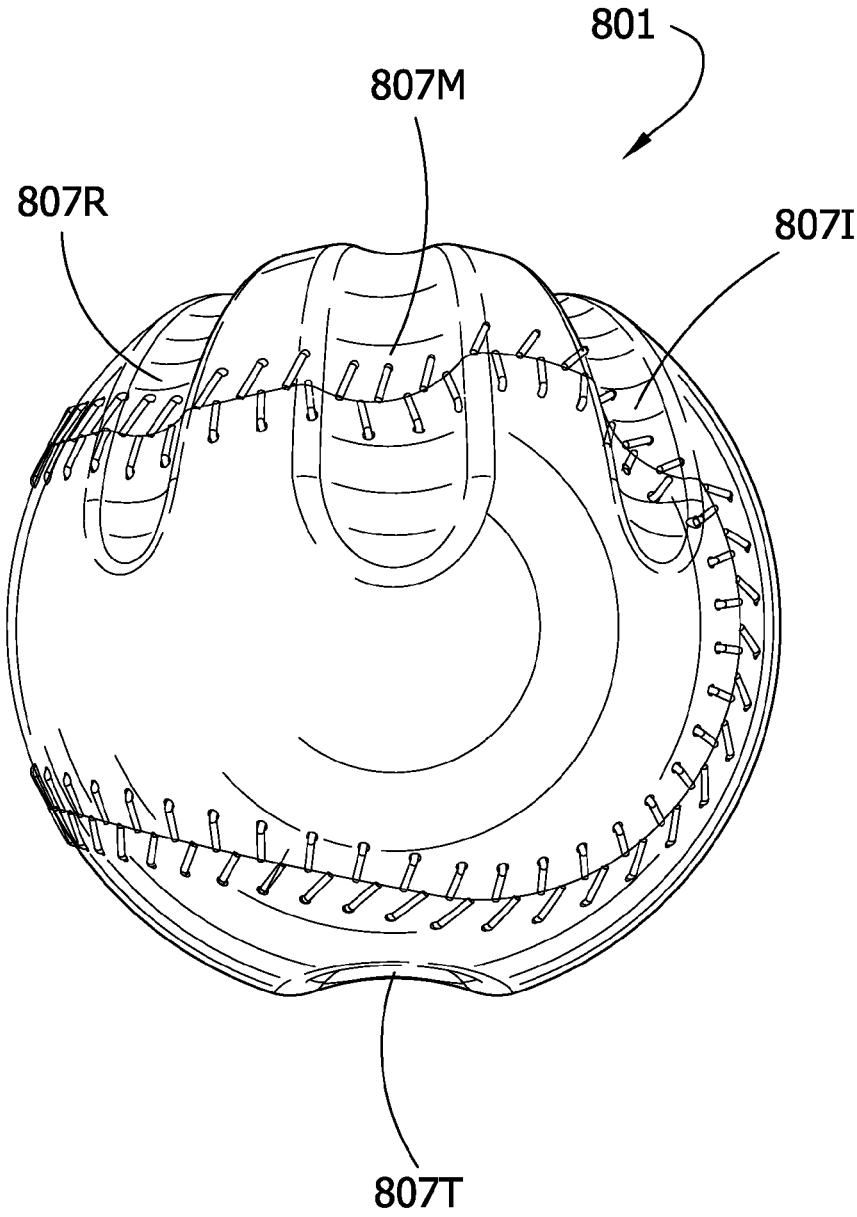
FIG. 55 is a front elevation thereof.
Figure 56:
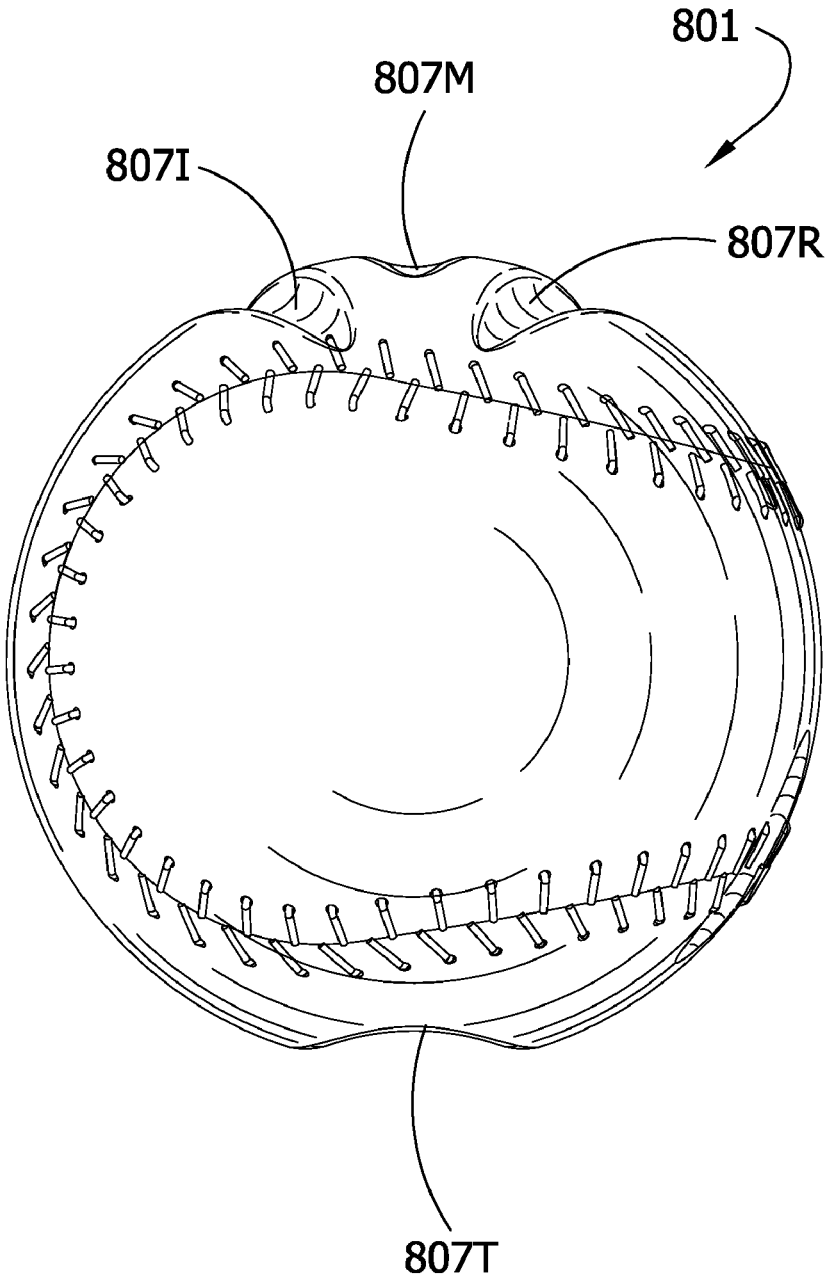
FIG. 56 is a rear elevation thereof.
Figure 57:
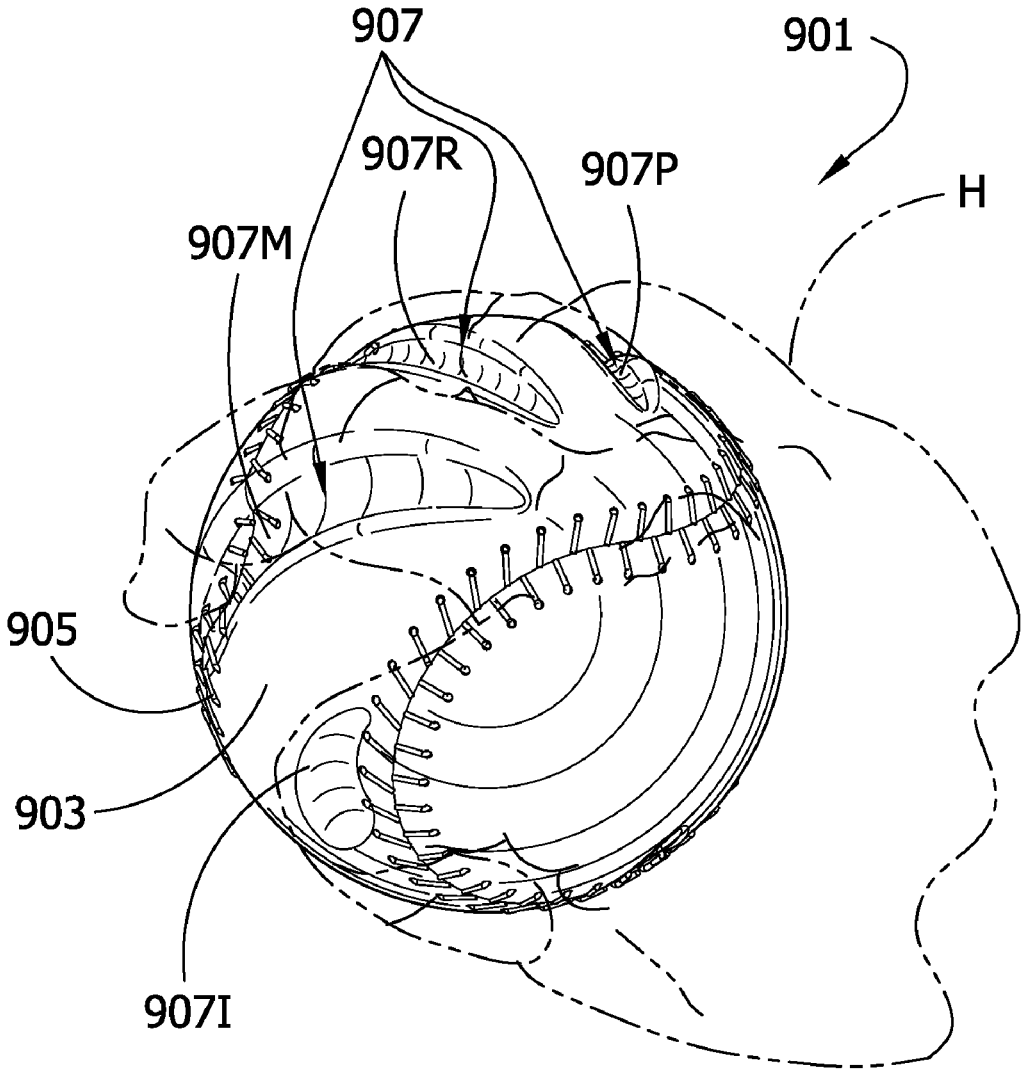
FIG. 57 is a perspective seen from the rear and right side of a grip training device of a ninth embodiment for a circle changeup grip and showing a hand gripping the device in phantom.
Figure 58:
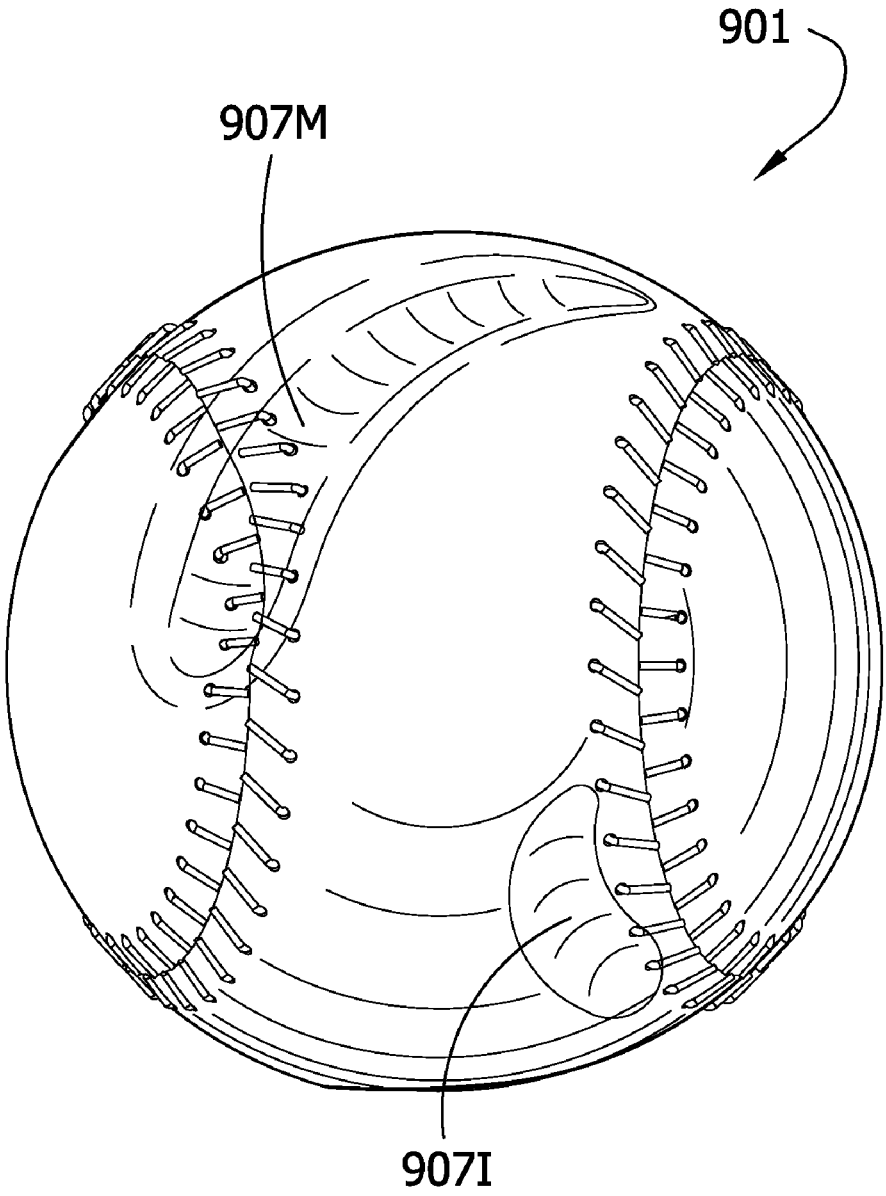
FIG. 58 is right side elevation of the grip training device of FIG. 57.
Figure 59:
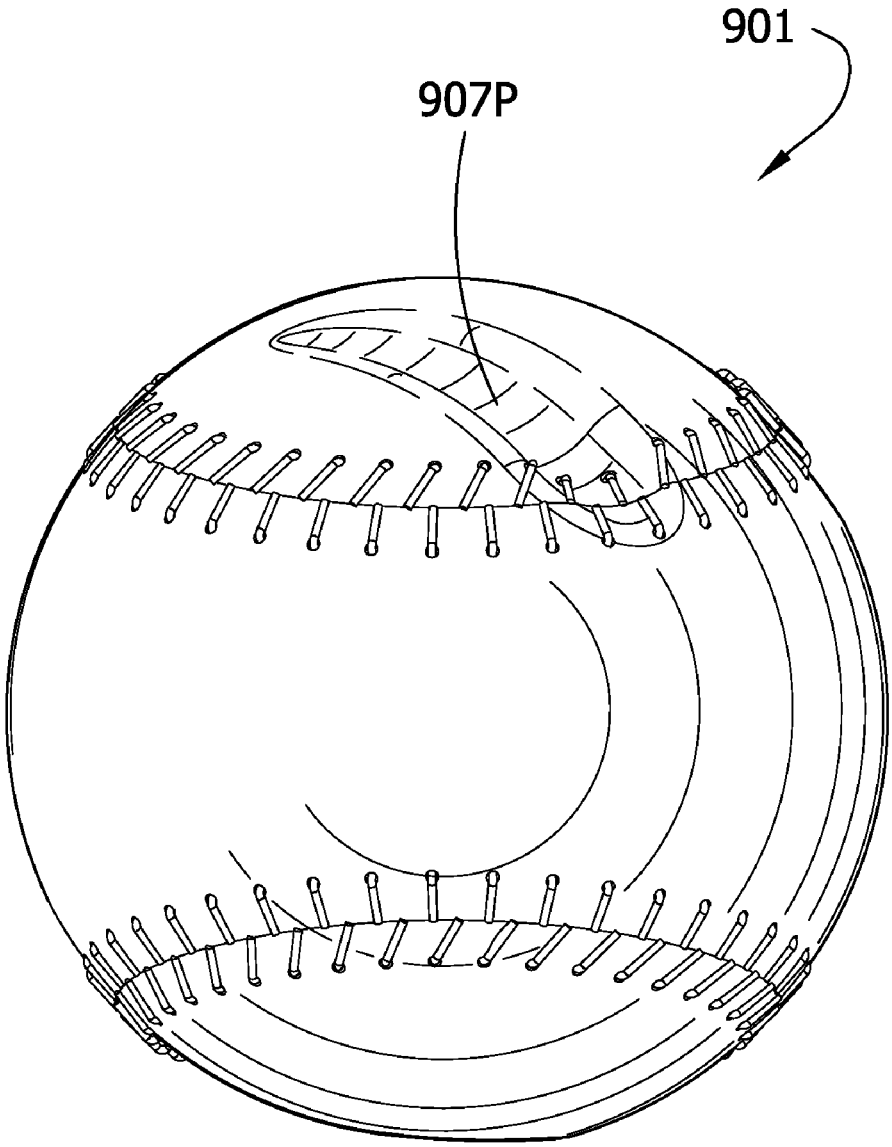
FIG. 59 is a left side elevation thereof.
Figure 60:
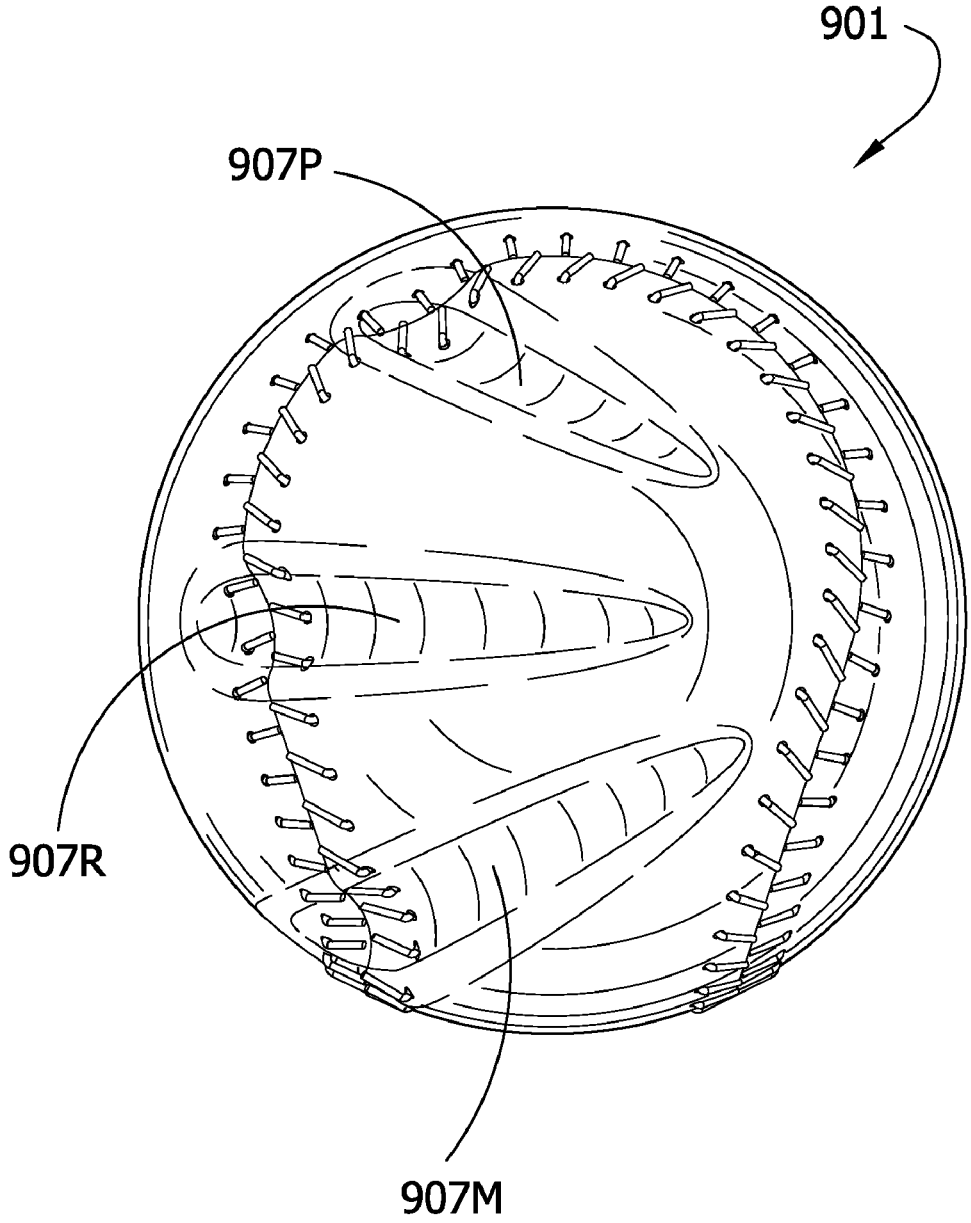
FIG. 60 is a top plan view thereof.
Figure 61:
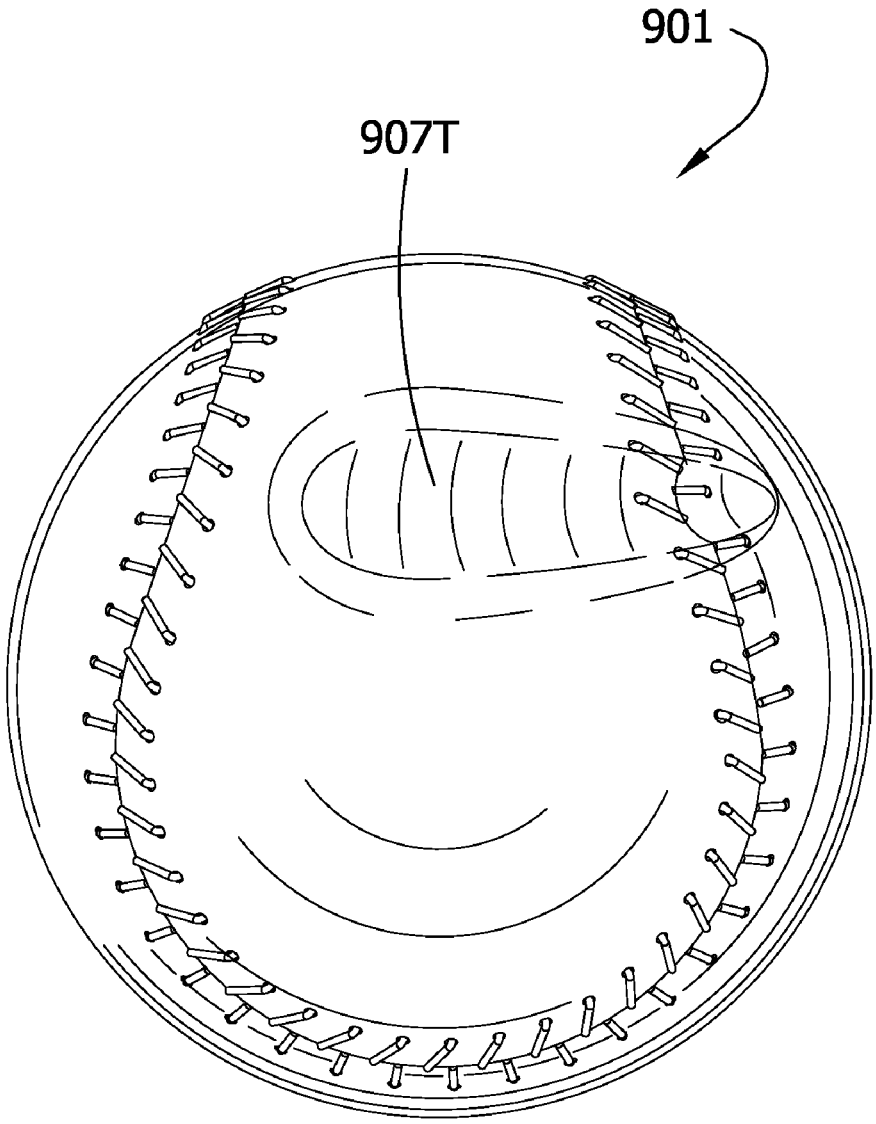
FIG. 61 is a bottom plan view thereof.
Figure 62:
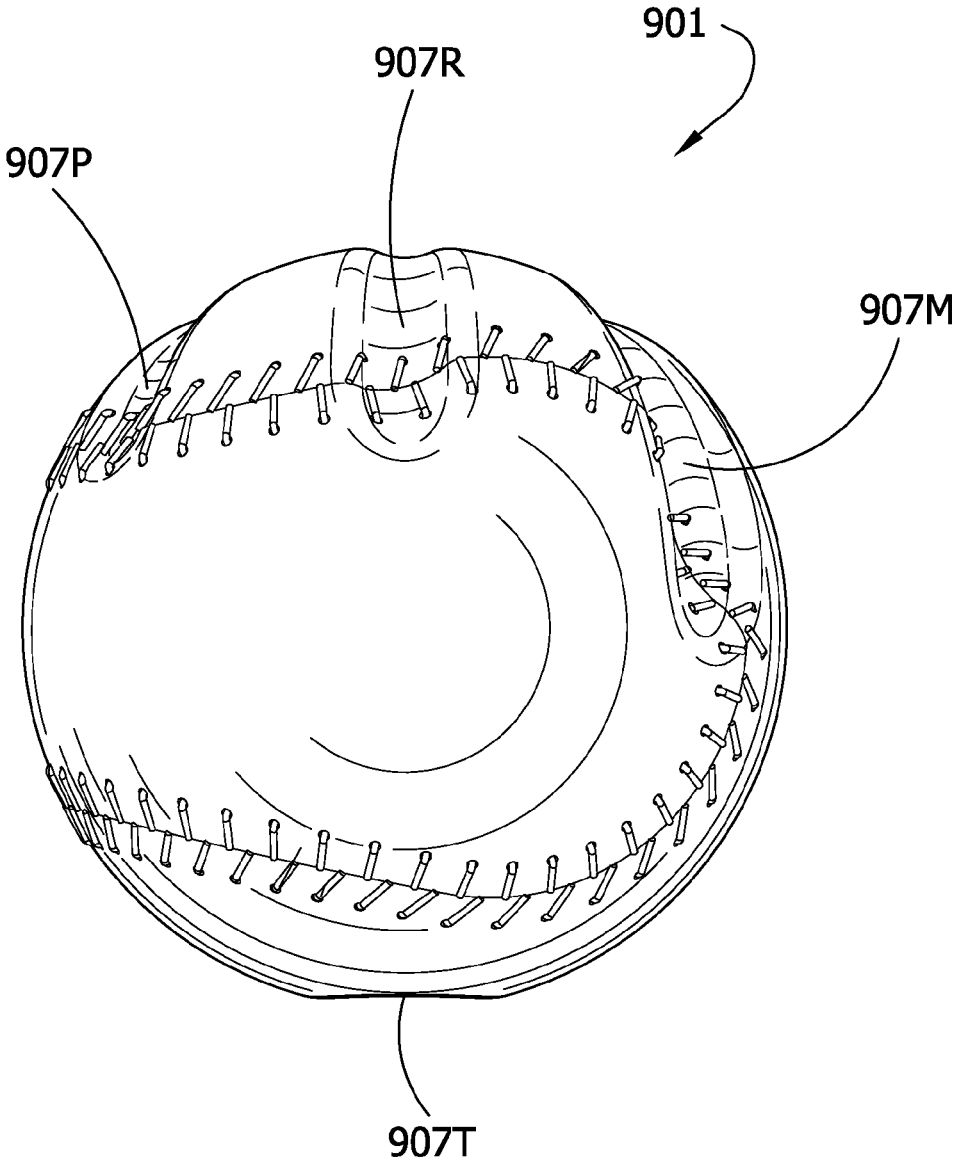
FIG. 62 is a front elevation thereof.
Figure 63:
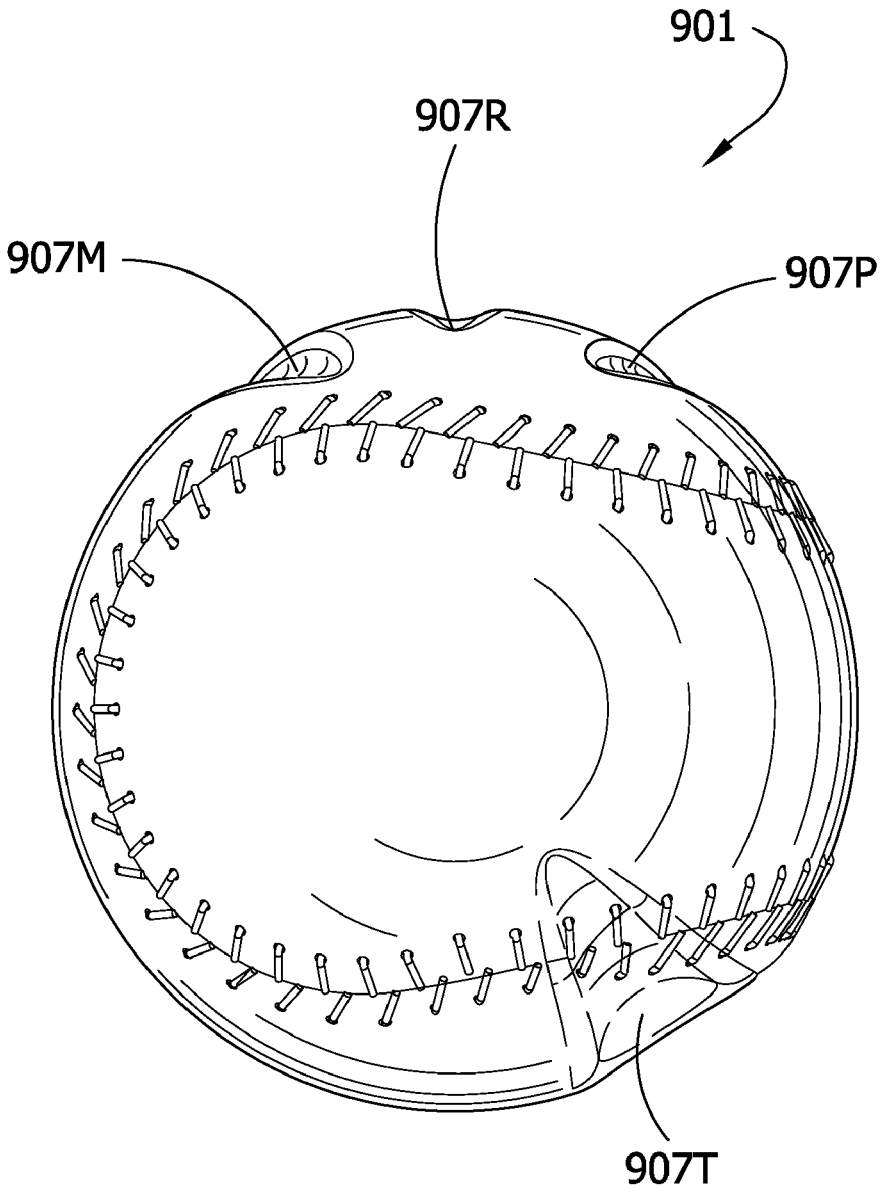
FIG. 63 is a rear elevation thereof.

Referring now to FIGS. 29-35, a baseball 501 of a fifth exemplary embodiment is depicted. The baseball 501 of the fifth embodiment is adapted for training a user to grip a baseball for properly throwing a beginner's curveball. Again, to aid the user in developing the proper grip, the baseball 501 includes finger position indicia 507 specifically demonstrating where the user should place his fingers. The finger position indicia may include one or more of surface depressions, finger outlines, descriptive labels, color-coding, and surface textures, among others. In the exemplary fifth embodiment shown, the finger position indicia 507 take the form of surface depressions are included for the middle finger 507M, the thumb 507T, and the ring finger 507R of the user. The beginner's curveball does not have a surface depression for the index finger, showing that the index finger should be left off of the ball as illustrated in FIG. 29.

Referring now to FIGS. 36-42, a baseball 601 of a sixth exemplary embodiment is depicted. The baseball 601 of the sixth embodiment is adapted for training a user to grip a baseball for properly throwing a standard curveball. Again, to aid the user in developing the proper grip, the baseball 601 includes finger position indicia 607 specifically demonstrating where the user should place his fingers. The finger position indicia may include one or more of surface depressions, finger outlines, descriptive labels, color-coding, and surface textures, among others. In the exemplary sixth embodiment shown, the finger position indicia 607 take the form of surface depressions are included for the index finger 607I, middle finger 607M, the thumb 607T, and the ring finger 607R of the user. The difference from the baseball 501 of the fifth embodiment is that a surface depression 607I for the index finger is provided in the baseball 601.

Referring now to FIGS. 43-49, a baseball 701 of a seventh exemplary embodiment is depicted. The baseball 701 is adapted for training a user to grip a baseball for properly throwing a knuckle curveball. Again, to aid the user in developing the proper grip, the baseball 701 includes finger position indicia 707 specifically demonstrating where the user should place his fingers. The finger position indicia may include one or more of surface depressions, finger outlines, descriptive labels, color-coding, and surface textures, among others. In the exemplary seventh embodiment shown, the finger position indicia 707 take the form of surface depressions are included for the index finger 707I, middle finger 707M, the thumb 707T, and the ring finger 707R of the user. The depression 707I for the index finger is preferably shortened and deepened to demonstrate a bending of the index finger at the knuckle characteristic of this pitch.

Referring now to FIGS. 50-56, a baseball 801 of a eighth exemplary embodiment is depicted. The baseball 801 is adapted for training a user to grip a baseball for properly throwing a three finger changeup. Again, to aid the user in developing the proper grip, the baseball 801 includes finger position indicia 807 specifically demonstrating where the user should place his fingers. The finger position indicia may include one or more of surface depressions, finger outlines, descriptive labels, color-coding, and surface textures, among others. In the exemplary eighth embodiment shown, the finger position indicia 807 take the form of surface depressions are included for the index finger 807I, middle finger 807M, the thumb 807T, and the ring finger 807R of the user. In addition, a depression 807P for the pinky finger is provided for the three finger changeup.

Referring now to FIGS. 57-63, a baseball 901 of a ninth exemplary embodiment is depicted. The baseball 901 is adapted for training a user to grip a baseball for properly throwing a circle changeup. Again, to aid the user in developing the proper grip, the baseball 901 includes finger position indicia 907 specifically demonstrating where the user should place his fingers. The finger position indicia may include one or more of surface depressions, finger outlines, descriptive labels, color-coding, and surface textures, among others. In the exemplary ninth embodiment shown, the finger position indicia 907 take the form of surface depressions are included for the index finger 907I, middle finger 907M, the thumb 907T, and the ring finger 907R of the user. In addition (and like the three finger changeup baseball 801), a depression 907P for the pinky finger is provided.

Referring now to FIGS. 64-72, a baseball 1001 of a tenth exemplary embodiment is depicted. The baseball 1001 is adapted for training a user to grip a baseball for properly throwing a palmball. Again, to aid the user in developing the proper grip, the baseball 1001 includes finger position indicia 1007 specifically demonstrating where the user should place his fingers. The finger position indicia may include one or more of surface depressions, finger outlines, descriptive labels, color-coding, and surface textures, among others. In the exemplary tenth embodiment shown, the finger position indicia 1007 take the form of surface depressions are included for the index finger 1007I, middle finger 1007M, the thumb 1007T, and the ring finger 1007R of the user. In addition, a depression 1007P for the pinky finger is provided for the palmball.

Figure 71:
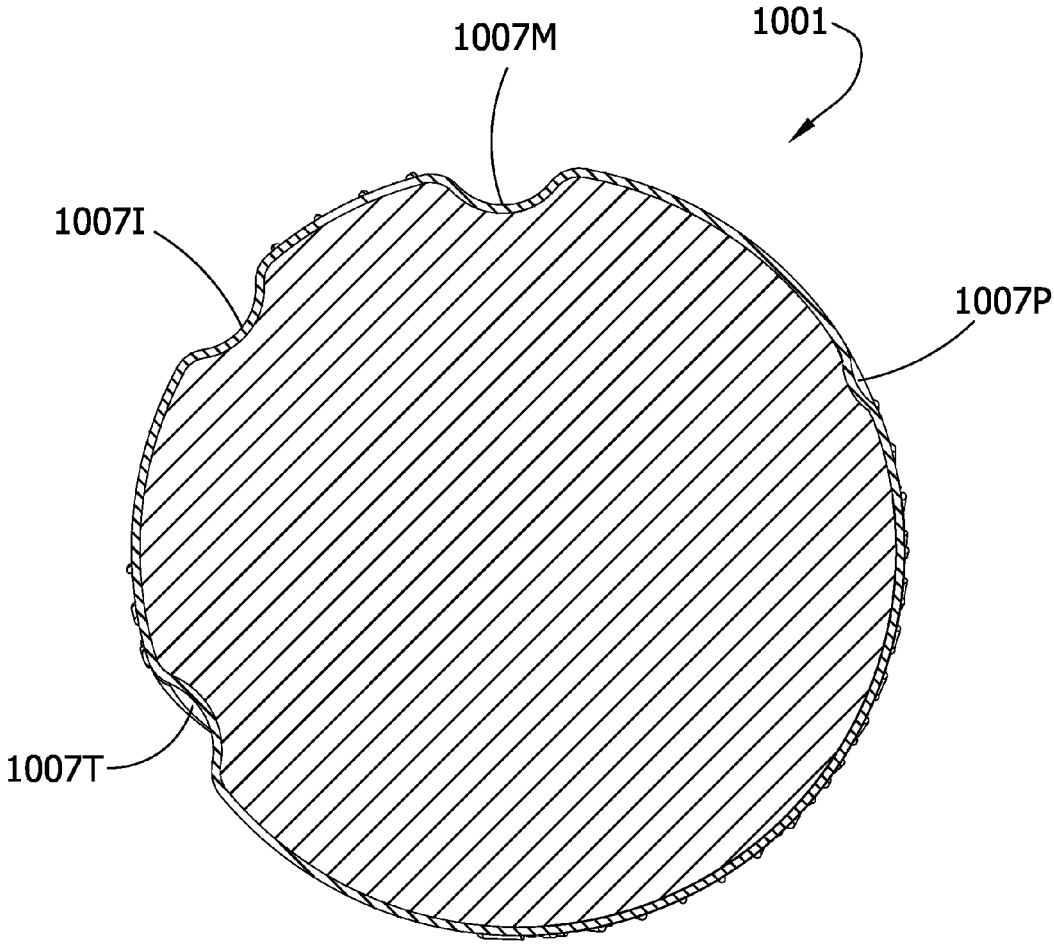
FIG. 71 is a section taken in the plane including line 71-71 of FIG. 65.
Figure 72:
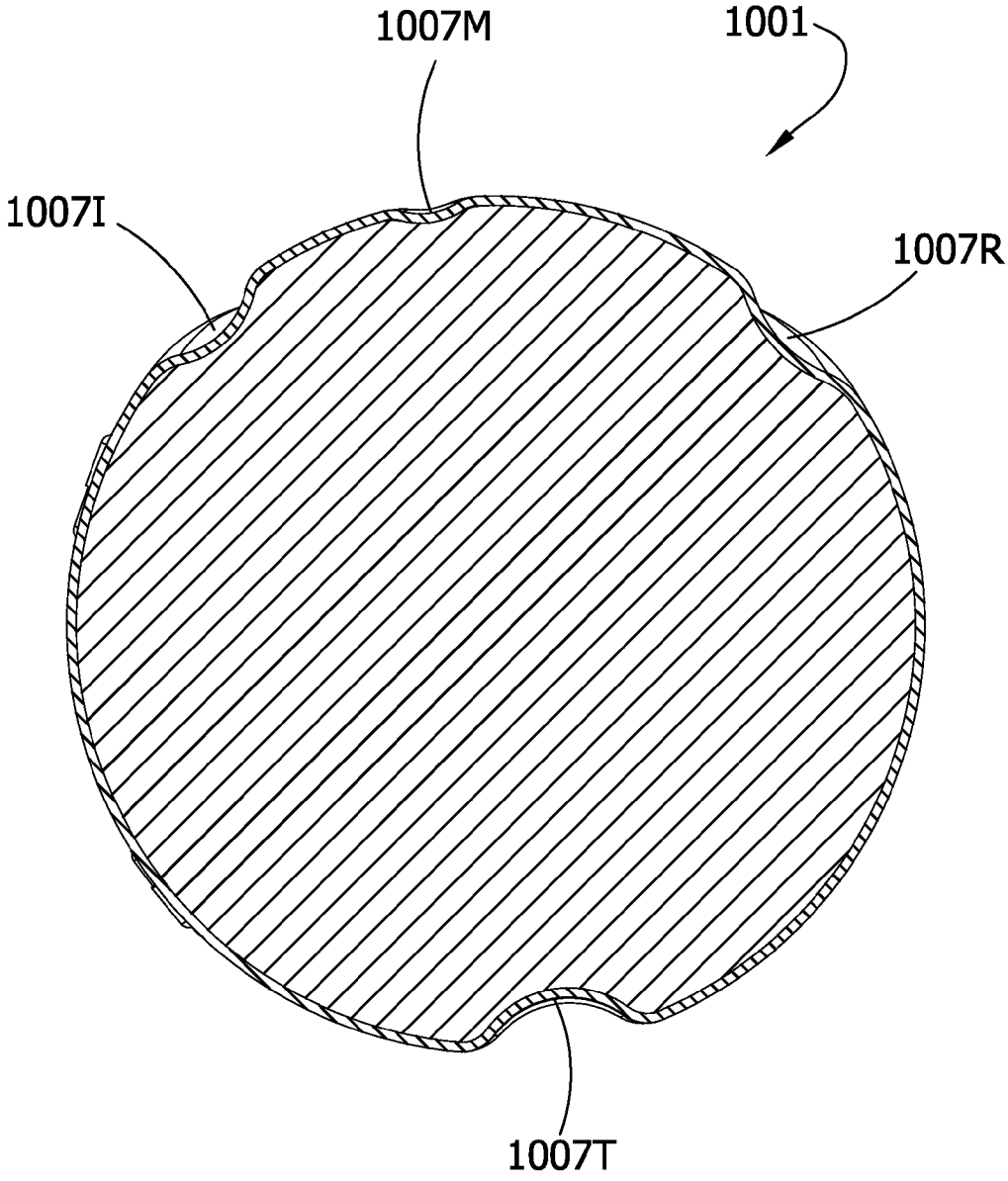
FIG. 72 is a section taken in the plane including line 72-72 of FIG. 65.

FIGS. 71 and 72 are sections of the palmball 1001 to show the general shape of a portion of surface depressions on the palmball. The surface depressions would be similar in shape as for other pitches illustrated herein.

Figure 64:
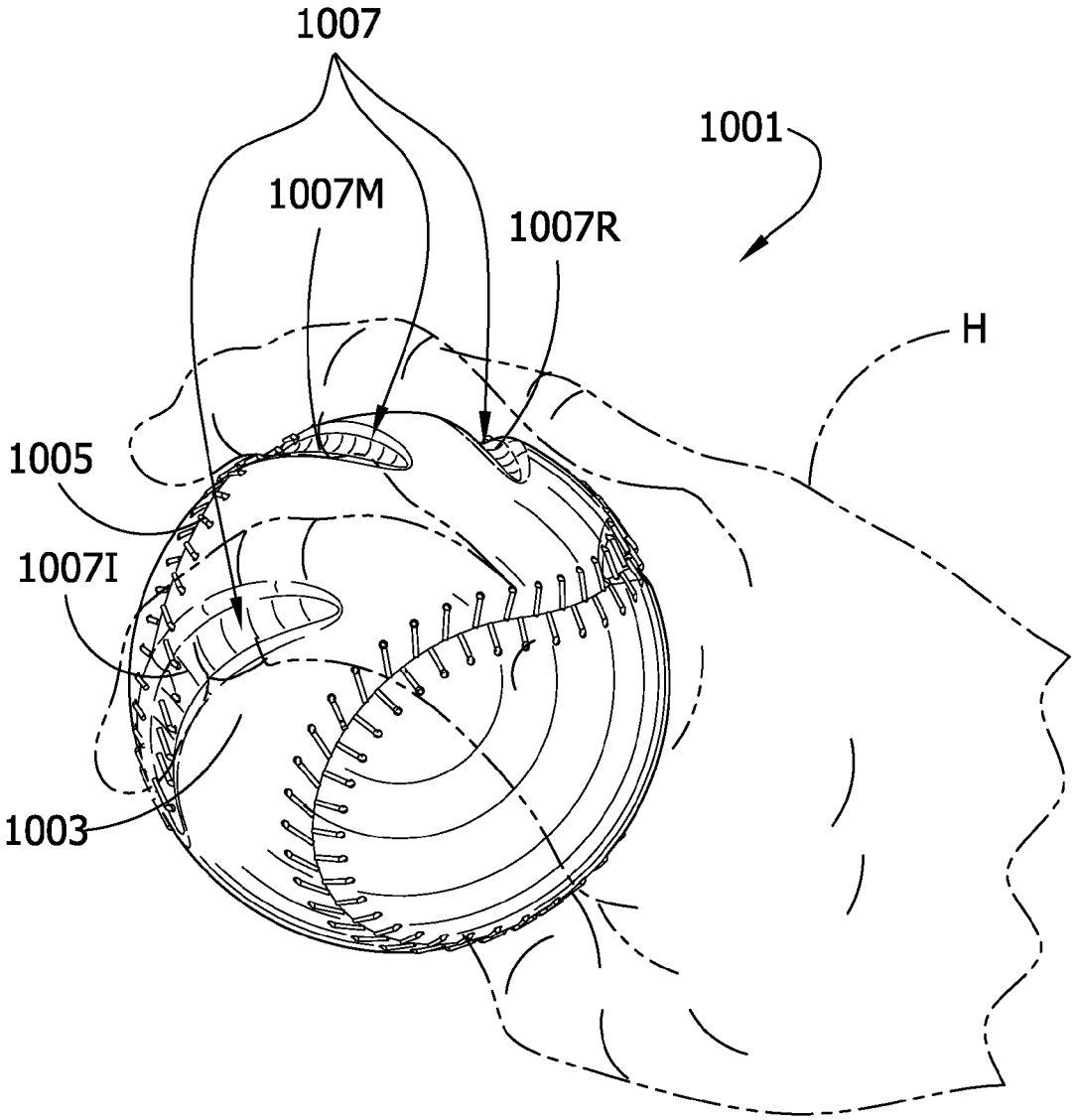
FIG. 64 is a perspective seen from the rear and right side of a grip training device of a tenth embodiment for a palmball grip and showing a hand gripping the device in phantom.
Figure 65:
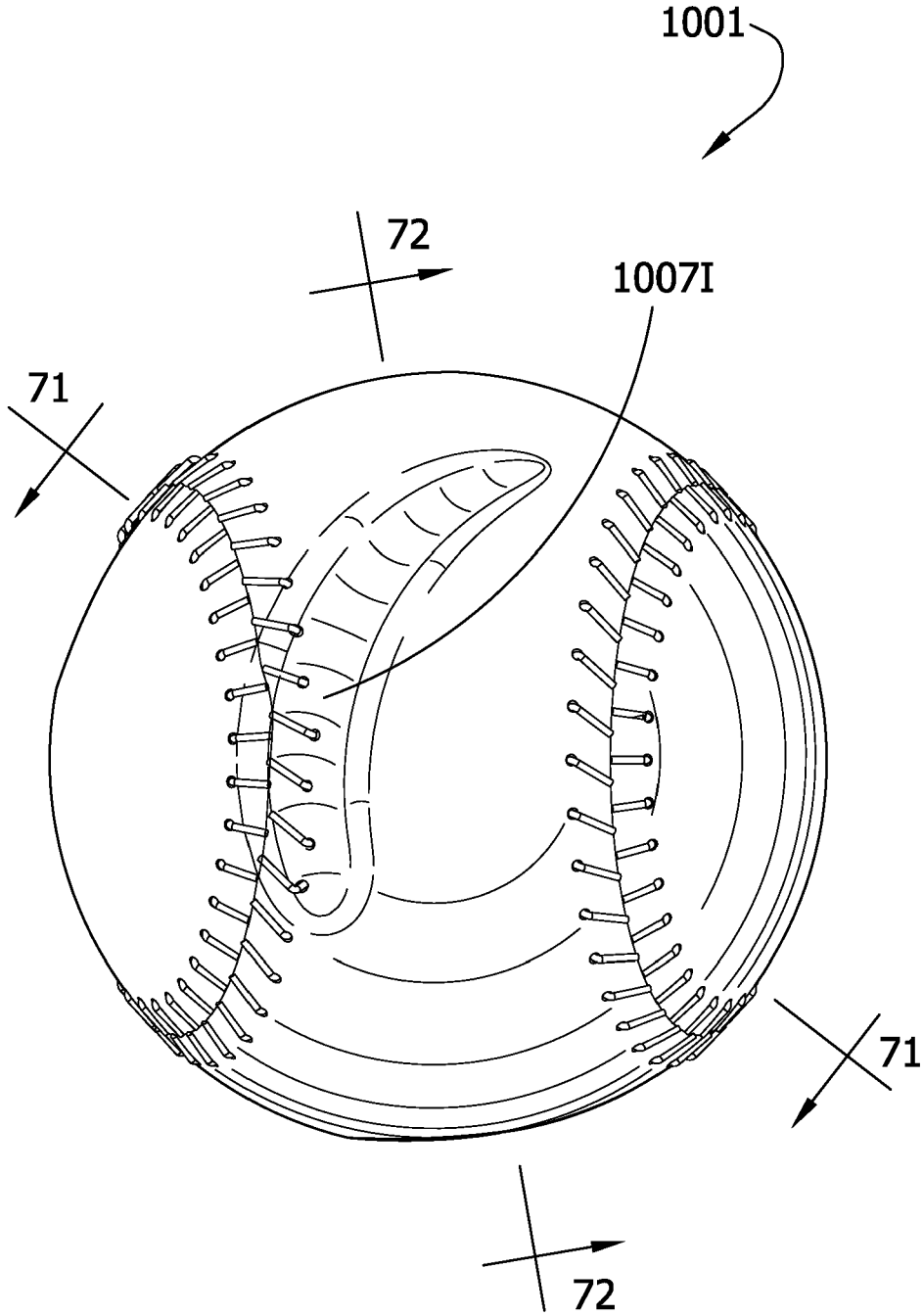
FIG. 65 is right side elevation of the grip training device of FIG. 64.
Figure 66:
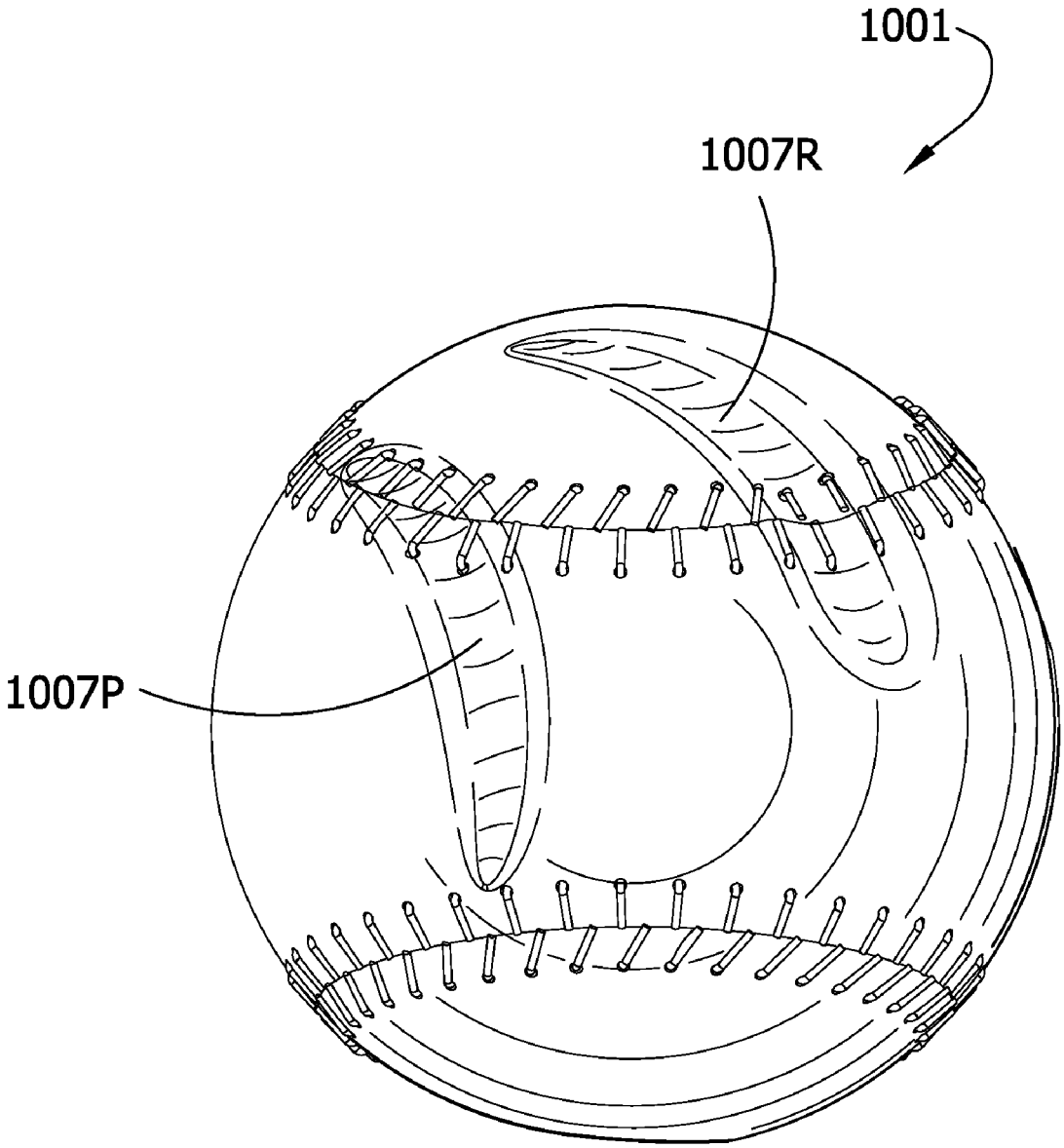
FIG. 66 is a left side elevation thereof.
Figure 67:
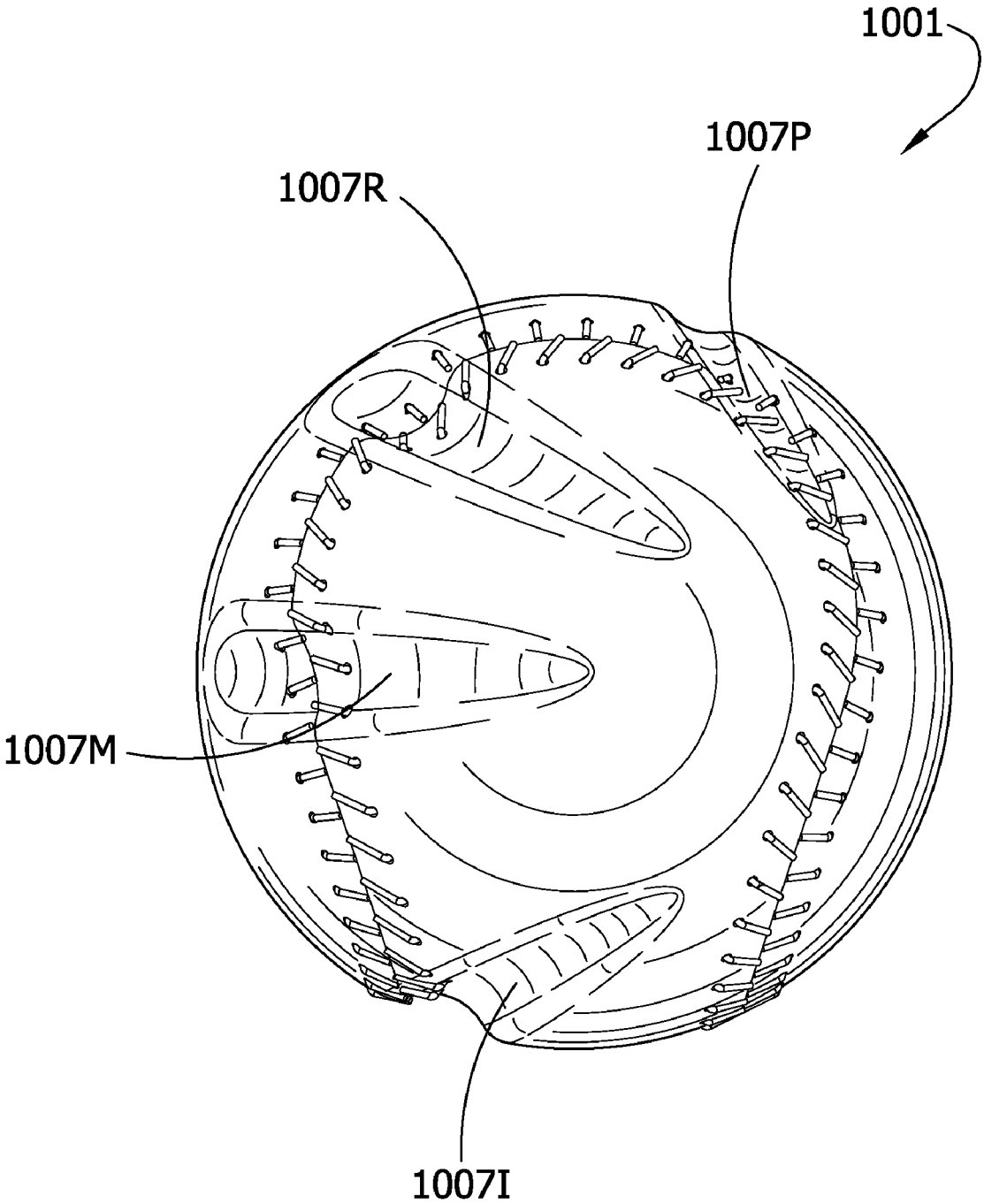
FIG. 67 is a top plan view thereof.
Figure 68:
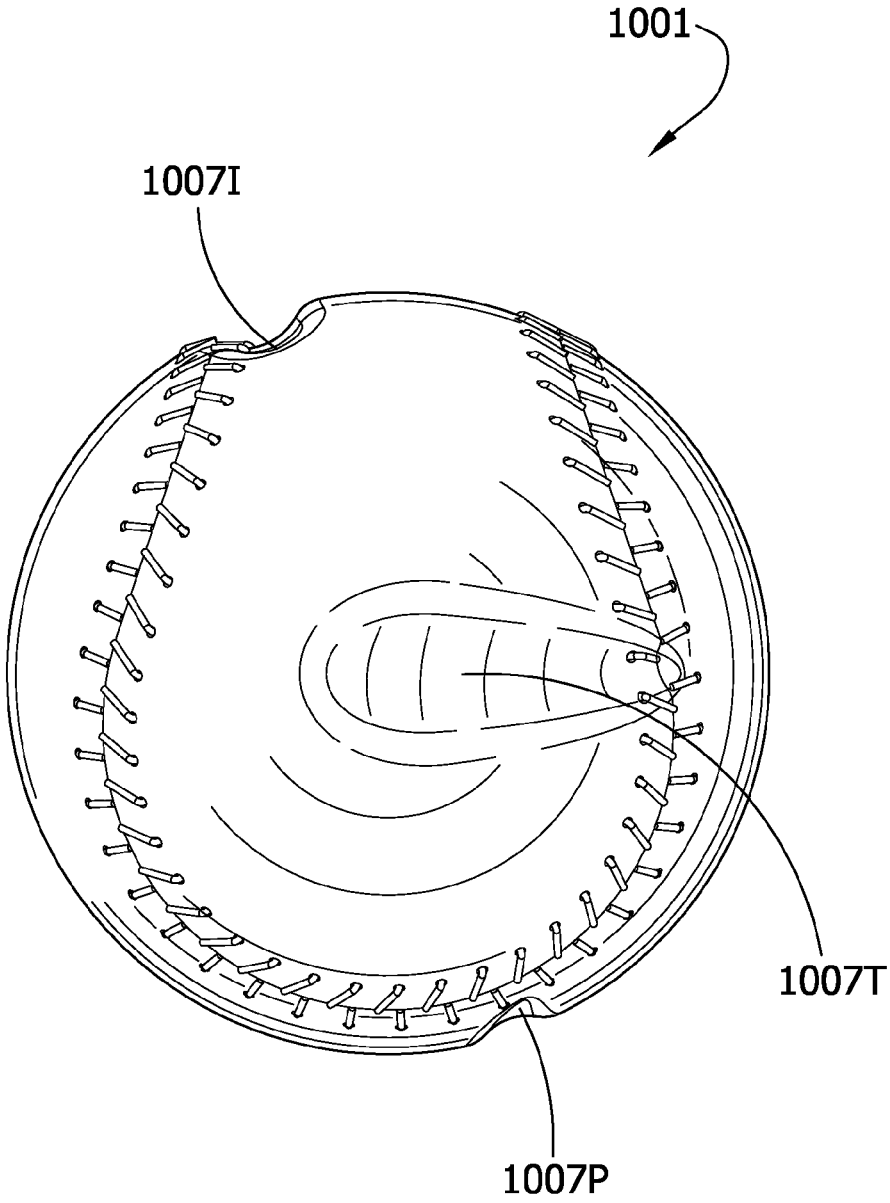
FIG. 68 is a bottom plan view thereof.
Figure 69:
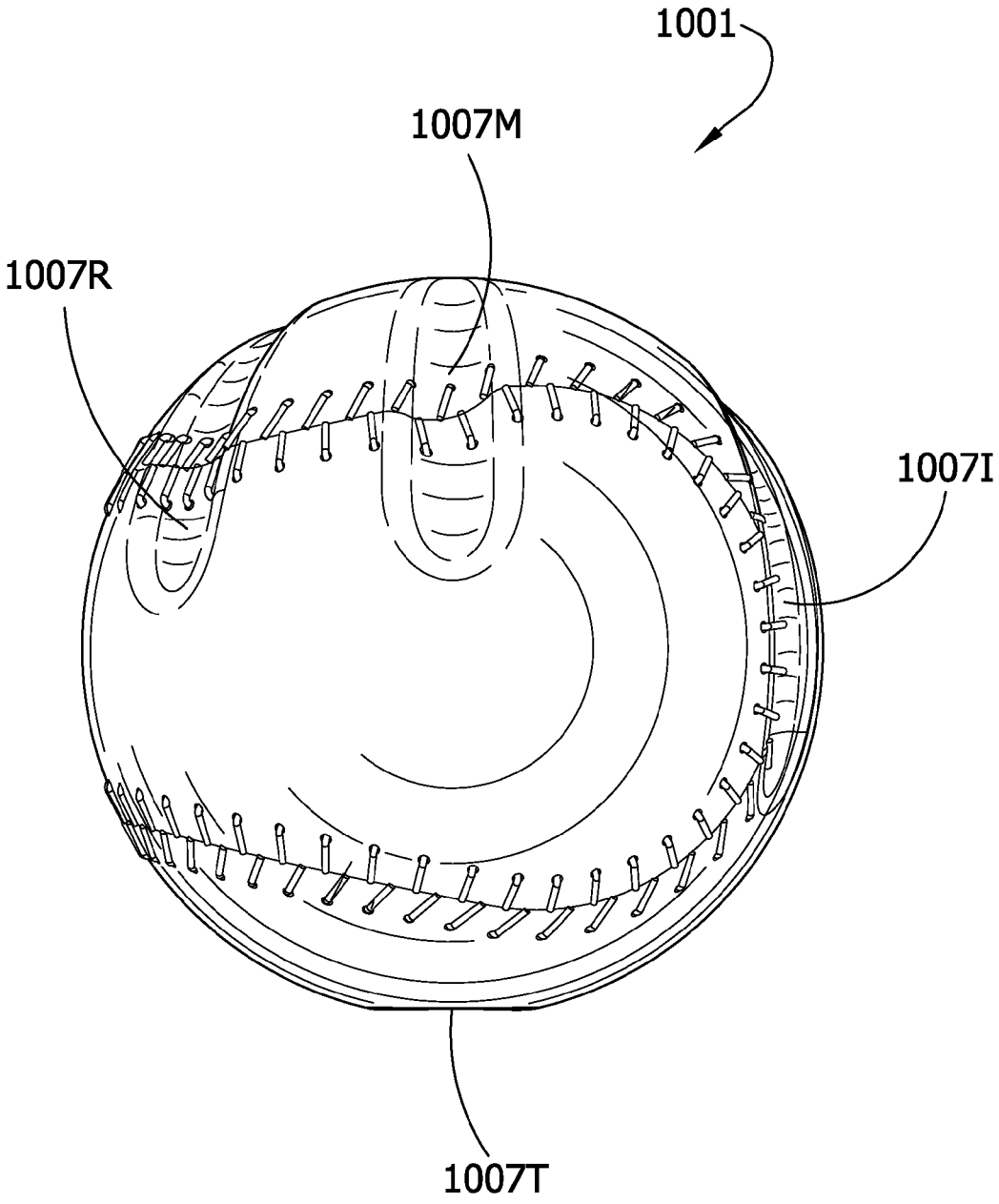
FIG. 69 is a front elevation thereof.
Figure 70:
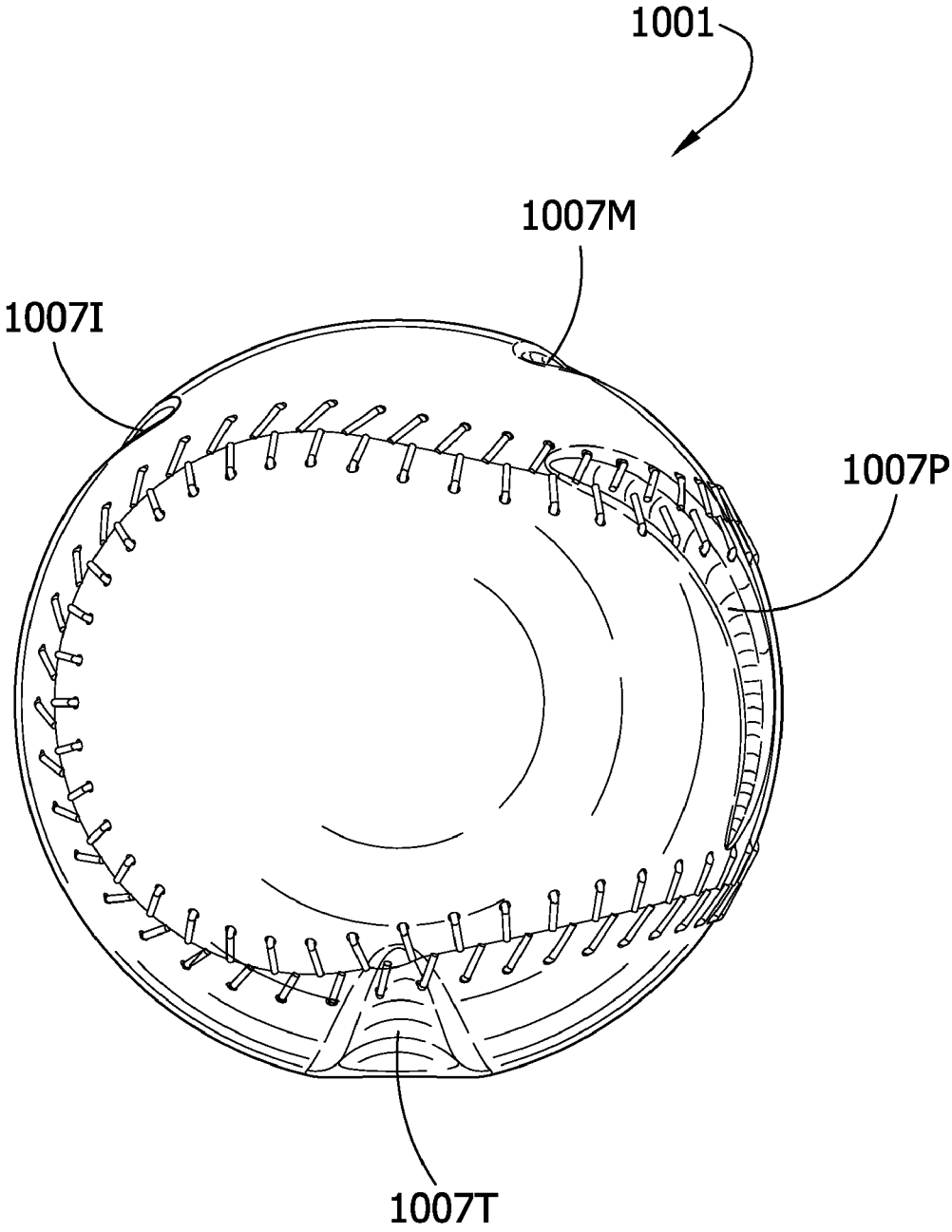
FIG. 70 is a rear elevation thereof.
Figure 73:
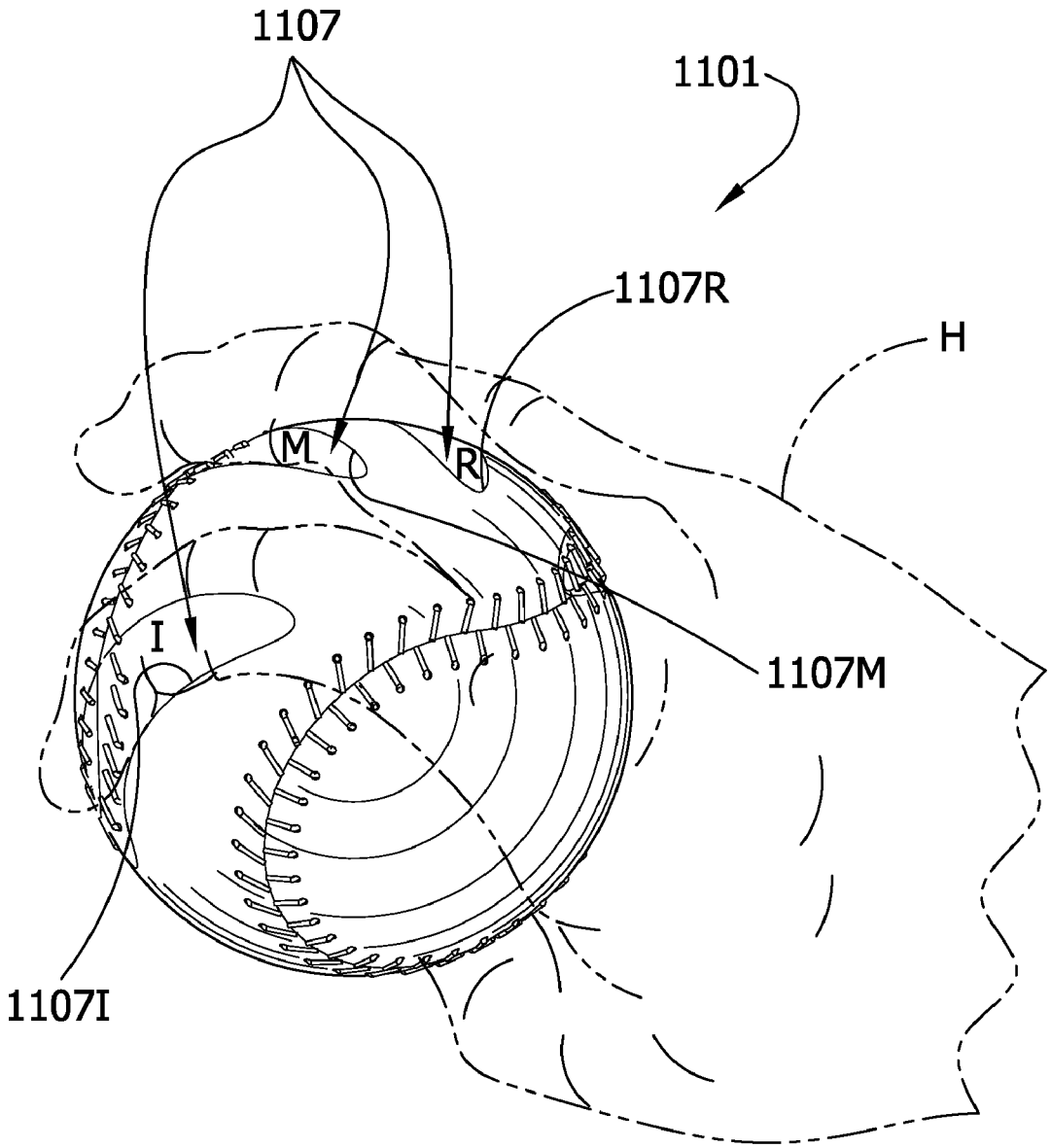
FIG. 73 is a perspective similar to FIG. 64, but showing finger position indicia of another version.

FIG. 73 is similar to FIG. 64 in that the baseball 1101 has finger positioning indicia 1107 arranged to show where to position the fingers for throwing a palmball. However, in this embodiment, the finger positioning indicia takes the form of markings on the surface of the baseball 1101. The markings are not depressed into the surface of the baseball 1101, and outline at least a portion of the finger to be received in a particular position. The markings including an outline of a portion of the index finger 1107I, an outline of a portion of the middle finger 1107M and an outline of a portion of the ring finger 1107R. Other markings (e.g., for the thumb and pinky) could be used, but are not visible in FIG. 73. Moreover, alphanumeric characters (in this case letters "I", "M", "R") are provided to indicate which fingers are to be positioned at which location. The letters could be used instead of the markings 1107 within the scope of the present invention. As discussed elsewhere, the marking and characters may take on other configurations within the scope of the present invention.

As would be readily understood by one skilled in the art, a single ball, such as a baseball, may be adapted to serve as a grip training device for several different pitches. For example, where the surface features are finger outlines, descriptive labels, and/or color-coding, multiple finger positions corresponding to two or more grip positions may be included on a single ball. This combination of surface features allows a single ball to function as a grip training device for multiple pitch types, depending upon which surface features are utilized by the user.

The grip training devices may also include other features for enhancing movement, or action, of the ball during flight. Such movement-enhancing features will allow the user to see exaggerated movement of the ball in the air, as compared with a conventional baseball, for example, thereby providing feedback regarding whether the ball was properly gripped and/or thrown. Such movement-enhancing features may be incorporated into any type of ball, including solid balls and hollow balls (i.e., wiffle balls). For example, a ball may include exaggerated stitching to enhance movement of the ball. The exaggerated stitching can include wider stitching, taller stitching, and/or thicker stitching string, among others. Moreover, the enhanced stitching may not be stitched at all, but may instead be surface enhancements to a molded ball, for example. Other surface features can include openings in the ball for hollow balls, surface ridges and channels, surface grooving, and surface dimpling, among others. In another example, the depressions discussed above for grip training can also be designed as movement-enhancing features. Controlling the depth and width of such depressions can have an impact upon ball movement. Generally speaking, these movement-enhancing features may be included over select portions of the ball or over the entire surface of the ball. Other movement-enhancing features not specifically discussed here are also contemplated as within the scope of the exemplary embodiments of the invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "up", "down", "top" and "bottom" and variations of these terms is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A grip training kit for training a user to properly grip a baseball for throwing a predetermined baseball pitch, said grip training kit comprising:

a plurality of balls sized and shaped to be thrown by a user, finger position indicia positioned on a surface of each of said plurality of balls, said finger position indicia comprising:

a plurality of depressions formed on said surface of said plurality of balls, said plurality of depressions demonstrating to said user proper finger placement for a proper grip of said plurality of balls for throwing a predetermined baseball pitch;

each of said plurality of balls having a different arrangement of depressions corresponding to a different baseball pitch;

at least one of said plurality of balls including a plurality of elongated depressions which angle generally toward a common point on said surface of said plurality of balls;

wherein said elongate depressions tapering in width from a wider end of the elongated depression toward a narrower end of the depression;

wherein said plurality of balls, each including a top portion, a bottom portion and a middle equatorial portion between the top and bottom portions, each of the top, bottom and middle equatorial portions having at least one of said plurality of depressions therein;

at least one of said plurality of balls in said kit having a first surface texture outside of the depression and a second surface texture within the depressions, the second surface texture being different from the first surface texture and corresponding to user finger placement for a proper grip of each one of said plurality of balls; and at least one of said plurality of balls in said kit including a ring finger depression.

2. A grip training kit as set forth in claim 1 wherein the ring finger depression is generally oval in shape.

3. A grip training kit as set forth in claim 1 wherein at least one of the balls of the kit has one of the depressions for each of five fingers.

4. A grip training kit as set forth in claim 1 wherein each of the balls in the kit comprises alphanumeric symbols in the depressions corresponding to individual finger placement for a proper grip of the ball for throwing.

* * * * *